US010391368B2

(12) United States Patent
Cleghorn et al.

(10) Patent No.: US 10,391,368 B2
(45) **Date of Patent: *Aug. 27, 2019**

(54) GOLF CLUB WITH MOVABLE WEIGHT

(71) Applicant: Acushnet Company, Fairhaven, MA (US)

(72) Inventors: Richard L. Cleghorn, Oceanside, CA (US); Nick Frame, Vista, CA (US); Darryl C. Galvan, El Cajon, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/046,789

(22) Filed: Jul. 26, 2018

(65) Prior Publication Data

US 2018/0326265 A1 Nov. 15, 2018

Related U.S. Application Data

(63) Continuation of application No. 15/365,471, filed on Nov. 30, 2016, now Pat. No. 10,035,051, which is a (Continued)

(51) Int. Cl.
*A63B 53/06* (2015.01)
*A63B 53/04* (2015.01)
(Continued)

(52) U.S. Cl.
CPC ..... *A63B 53/0466* (2013.01); *A63B 53/047* (2013.01); *A63B 60/02* (2015.10);
(Continued)

(58) Field of Classification Search
CPC .... A63B 2053/0491; A63B 2053/0433; A63B 53/0466; A63B 53/06; A63B 53/047
(Continued)

(56) References Cited

U.S. PATENT DOCUMENTS 80,435 A 7/1868 Way
996,937 A 7/1911 Mulock
(Continued)

FOREIGN PATENT DOCUMENTS

GB 2133295 7/1984
JP H06-238022 8/1994
(Continued)

*Primary Examiner* — Benjamin Layno
(74) *Attorney, Agent, or Firm* — Kevin N. McCoy

(57) ABSTRACT

A golf club head having an exterior surface opposite the hollow golf club interior, the body having a center of gravity, wherein the body comprises an elongate weight receptacle, a weight retainer located in the weight receptacle, wherein the weight receptacle comprises a plurality of weight mounts, wherein the weight retainer is configured to slide along the weight receptacle between each of the plurality of weight mounts when the weight retainer is unlocked, and wherein the weight retainer is configured to reside in any of the plurality of weight mounts when the weight retainer is locked, and wherein the weight receptacle comprises a weight receptacle installation feature configured to receive the weight retainer, wherein the weight receptacle installation feature is located between two of the plurality of weight mounts, wherein the two of the plurality of weight mounts are located adjacent one another.

17 Claims, 42 Drawing Sheets

Related U.S. Application Data continuation-in-part of application No. 15/282,854, filed on Sep. 30, 2016, now Pat. No. 9,975,019, which is a continuation-in-part of application No. 15/257,692, filed on Sep. 6, 2016, now Pat. No. 9,914,028, and a continuation-in-part of application No. 14/979,151, filed on Dec. 22, 2015, now Pat. No. 9,744,415.

(51) Int. Cl.
*A63B 60/52* (2015.01)
*A63B 60/02* (2015.01)

(52) U.S. Cl.
CPC ..... *A63B 60/52* (2015.10); *A63B 53/06* (2013.01); *A63B 2053/0433* (2013.01); *A63B 2053/0491* (2013.01)

(58) Field of Classification Search
USPC ..... 473/335–339, 344, 345
See application file for complete search history.

(56) References Cited

U.S. PATENT DOCUMENTS 1,133,129 A 3/1915 Govan
1,167,106 A 1/1916 Palmer
1,320,163 A 10/1919 Murice Fitz
1,322,182 A 11/1919 Duncan
1,534,600 A 4/1925 Mattern
2,155,830 A 4/1939 Howard
2,171,383 A 8/1939 Wettlaufer
2,214,356 A 9/1940 Wettlaufer
2,517,245 A 8/1950 Scott
2,545,045 A 3/1951 Rosan
2,592,013 A 4/1952 Curley
2,652,256 A 9/1953 Thomas
3,064,980 A 11/1962 Steiner
3,212,783 A 10/1965 Bradley et al.
3,220,733 A 11/1965 Saleeby
3,259,404 A 7/1966 Papenguth
3,466,047 A 9/1969 Rodia et al.
3,556,533 A 1/1971 Hollis
3,604,755 A 9/1971 Krekeler
3,652,094 A 3/1972 Glover
3,692,306 A 9/1972 Glover
3,979,123 A 9/1976 Belmont
4,026,183 A 5/1977 Bart
4,027,881 A 6/1977 Hufenus
4,043,563 A 8/1977 Churchward
4,052,075 A 10/1977 Daly
4,085,934 A 4/1978 Churchward
4,194,547 A 3/1980 Sidor et al.
4,340,230 A 7/1982 Churchward
4,423,874 A 1/1984 Stuff, Jr.
4,443,145 A 4/1984 Peschges
4,450,904 A 5/1984 Volz
4,538,790 A 9/1985 Williams et al.
4,602,787 A 7/1986 Sugioka et al.
4,795,159 A 1/1989 Nagamoto
4,867,458 A 9/1989 Sumikawa et al.
4,869,507 A 9/1989 Sahm
4,895,371 A 1/1990 Bushner
4,958,970 A 9/1990 Rose et al.
5,050,879 A 9/1991 Sun et al.
5,154,424 A 10/1992 Lo
5,168,767 A 12/1992 Morita
5,230,509 A 7/1993 Chavez
5,236,164 A 8/1993 Lorizzo
5,297,794 A 3/1994 Lu
5,316,305 A 5/1994 McCabe
5,320,005 A 6/1994 Hsiao
5,518,243 A 5/1996 Redman
5,547,326 A 8/1996 Overhues
5,571,053 A 11/1996 Lane
5,683,309 A 11/1997 Reimers
5,688,189 A 11/1997 Bland
5,720,674 A 2/1998 Galy
5,769,737 A 6/1998 Holladay
5,795,245 A 8/1998 Chang et al.
5,860,779 A 1/1999 Toosky et al.
5,904,460 A 5/1999 Kawabata
5,916,042 A 6/1999 Reimers
5,935,019 A 8/1999 Yamamoto
5,947,840 A 9/1999 Ryan
5,967,905 A 10/1999 Nakahara et al.
6,015,354 A 1/2000 Ahn
6,017,177 A 1/2000 Lanham
6,056,649 A 5/2000 Imai
6,089,994 A 7/2000 Sun
6,123,627 A 9/2000 Antonious
6,162,132 A 12/2000 Yoneyama
6,217,461 B1 4/2001 Galy
6,277,032 B1 8/2001 Smith
6,296,574 B1 10/2001 Kaldis
6,306,048 B1 10/2001 McCabe et al.
6,348,014 B1 2/2002 Chiu
6,379,264 B1 4/2002 Forzano
6,379,265 B1 4/2002 Hirakawa et al.
6,409,612 B1 6/2002 Evans et al.
6,436,142 B1 8/2002 Paes et al.
6,458,044 B1 10/2002 Vincent et al.
6,648,772 B2 11/2003 Vincent et al.
6,719,510 B2 4/2004 Cobzaru
6,749,523 B1 6/2004 Forzano
6,773,360 B2 8/2004 Willett et al.
6,811,496 B2 11/2004 Wahl et al.
6,860,818 B2 3/2005 Mahaffey et al.
6,881,158 B2 4/2005 Yang et al.
6,988,960 B2 1/2006 Mahaffey et al.
7,121,956 B2 10/2006 Lo
7,147,573 B2 12/2006 DiMarco
7,153,220 B2 12/2006 Lo
7,166,040 B2 1/2007 Hoffman et al.
7,166,041 B2 1/2007 Evans
7,179,034 B2 2/2007 Ladouceur
7,186,190 B1 3/2007 Beach et al.
7,189,169 B2 3/2007 Billings
7,201,669 B2 4/2007 Stites
7,223,180 B2 5/2007 Willett et al.
7,294,065 B2 11/2007 Liang et al.
7,326,472 B2 2/2008 Shimazaki et al.
7,351,161 B2 4/2008 Beach
7,404,772 B2 7/2008 Koide
7,407,447 B2 8/2008 Beach
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,452,286 B2 11/2008 Lin
7,520,820 B2 4/2009 Dimarco
7,530,901 B2 5/2009 Imamoto
7,530,904 B2 5/2009 Beach et al.
7,540,811 B2 6/2009 Beach et al.
7,568,985 B2 8/2009 Beach et al.
7,578,753 B2 8/2009 Beach et al.
7,591,738 B2 9/2009 Beach
7,604,548 B2 10/2009 Cole
7,611,424 B2 11/2009 Nagai
7,621,823 B2 11/2009 Beach
7,628,707 B2 12/2009 Beach
7,628,711 B2 12/2009 Akinori et al.
7,632,194 B2 12/2009 Beach et al.
7,670,235 B2 3/2010 Lo
7,704,163 B2 4/2010 Stites
7,713,142 B2 5/2010 Hoffman et al.
7,717,803 B2 5/2010 DiMarco
7,717,804 B2 5/2010 Beach et al.
7,717,805 B2 5/2010 Beach et al.
D617,858 S 6/2010 Llewellyn
7,744,484 B1 6/2010 Chao et al.
7,758,452 B2 7/2010 Soracco
7,771,290 B2 8/2010 Bezilla et al.
7,775,905 B2 8/2010 Beach et al.

(56) References Cited

U.S. PATENT DOCUMENTS

| | | | | |
|---|---|---|---|---|
| 7,806,781 | B2 | 10/2010 | Imamoto | |
| 7,806,782 | B2 | 10/2010 | Stites | |
| 7,846,041 | B2 | 12/2010 | Beach | |
| 7,927,231 | B2 | 4/2011 | Sato | |
| 7,963,861 | B2 | 6/2011 | Beach | |
| 8,016,694 | B2 * | 9/2011 | Llewellyn | A63B 53/0466 473/334 |
| 8,043,167 | B2 | 10/2011 | Boyd et al. | |
| 8,066,584 | B2 | 11/2011 | Stites | |
| 8,092,316 | B2 | 1/2012 | Breier et al. | |
| 8,105,175 | B2 | 1/2012 | Breier et al. | |
| 8,182,363 | B2 | 5/2012 | Bezilla et al. | |
| 8,192,302 | B2 | 6/2012 | Knutson et al. | |
| 8,192,303 | B2 | 6/2012 | Ban | |
| 8,202,175 | B2 | 6/2012 | Ban | |
| 8,206,243 | B2 | 6/2012 | Stites | |
| 8,292,757 | B2 | 10/2012 | Soracco | |
| 8,298,096 | B2 | 10/2012 | Stites | |
| 8,308,583 | B2 | 11/2012 | Morris | |
| 8,388,465 | B2 | 3/2013 | De La Cruz et al. | |
| 8,435,135 | B2 | 5/2013 | Stites et al. | |
| 8,435,136 | B2 | 5/2013 | Stites | |
| 8,444,505 | B2 | 5/2013 | Beach | |
| 8,540,589 | B2 | 9/2013 | Bezilla et al. | |
| 8,562,457 | B2 | 10/2013 | Beach | |
| 8,684,863 | B2 | 4/2014 | Bezilla et al. | |
| 8,690,706 | B2 | 4/2014 | Stites | |
| 8,696,491 | B1 | 4/2014 | Myers | |
| 8,734,271 | B2 | 5/2014 | Beach | |
| D709,571 | S | 7/2014 | Sargent | |
| D709,572 | S | 7/2014 | Sargent | |
| 8,790,195 | B1 | 7/2014 | Myers | |
| 8,834,294 | B1 | 9/2014 | Seluga | |
| 8,870,678 | B2 | 10/2014 | Beach | |
| 8,888,607 | B2 | 11/2014 | Harbert | |
| 8,894,506 | B1 | 11/2014 | Myers | |
| 8,900,069 | B2 | 12/2014 | Beach | |
| 8,968,116 | B1 | 3/2015 | Myers | |
| 9,084,921 | B1 | 7/2015 | Liang | |
| 9,174,096 | B2 | 11/2015 | Sargent | |
| 9,186,560 | B2 | 11/2015 | Harbert | |
| 9,199,145 | B1 | 12/2015 | Myers | |
| 9,211,447 | B2 | 12/2015 | Harbert | |
| 9,211,453 | B1 | 12/2015 | Foster | |
| 9,220,953 | B2 | 12/2015 | Beach | |
| 9,220,957 | B1 | 12/2015 | Myers | |
| 9,238,162 | B2 | 1/2016 | Breier | |
| 9,259,625 | B2 | 2/2016 | Sargent | |
| 9,259,627 | B1 | 2/2016 | Myers | |
| 9,278,262 | B2 | 3/2016 | Sargent | |
| 9,289,660 | B1 | 3/2016 | Myers | |
| 9,308,423 | B1 | 4/2016 | Tang | |
| 9,364,728 | B1 | 6/2016 | Myers | |
| 9,364,729 | B2 | 6/2016 | Myers | |
| 9,375,618 | B2 | 6/2016 | Myers | |
| 9,387,376 | B1 | 7/2016 | Hall | |
| 9,387,377 | B2 | 7/2016 | Liang | |
| 9,975,019 | B2 * | 5/2018 | Frame | A63B 53/06 |
| 10,035,051 | B2 * | 7/2018 | Cleghorn | A63B 53/0466 |
| 2003/0148818 | A1 | 8/2003 | Myrhum et al. | |
| 2006/0058112 | A1 | 3/2006 | Haralason et al. | |
| 2006/0100029 | A1 | 5/2006 | Lo | |
| 2006/0122004 | A1 | 6/2006 | Chen et al. | |
| 2006/0217216 | A1 | 9/2006 | Iizuka | |
| 2006/0240908 | A1 | 10/2006 | Adams | |
| 2007/0135231 | A1 | 6/2007 | Lo | |
| 2007/0155534 | A1 | 7/2007 | Tsai et al. | |
| 2007/0178988 | A1 | 8/2007 | Tavares | |
| 2008/0020861 | A1 | 1/2008 | Adams | |
| 2008/0039229 | A1 | 2/2008 | Lo | |
| 2008/0132353 | A1 | 6/2008 | Hsiao | |
| 2008/0261715 | A1 | 10/2008 | Carter | |
| 2010/0075773 | A1 | 3/2010 | Casati | |
| 2014/0018185 | A1 | 1/2014 | Mizutani | |
| 2014/0113741 | A1 | 4/2014 | Bezilla | |
| 2015/0038258 | A1 | 2/2015 | Beach | |
| 2015/0306474 | A1 * | 10/2015 | Breier | A63B 53/0466 473/332 |
| 2015/0306475 | A1 | 10/2015 | Curtis | |
| 2015/0378107 | A1 | 12/2015 | Akashi | |
| 2016/0001146 | A1 | 1/2016 | Sargent | |
| 2016/0008687 | A1 | 1/2016 | Sargent | |
| 2016/0023060 | A1 | 1/2016 | Harbert | |
| 2016/0051869 | A1 | 2/2016 | Foster | |
| 2016/0059093 | A1 | 3/2016 | Nielson | |
| 2016/0059094 | A1 | 3/2016 | Mata | |
| 2016/0089583 | A1 | 3/2016 | Breier | |
| 2016/0129323 | A1 | 5/2016 | Myers | |
| 2016/0136490 | A1 | 5/2016 | Sargent | |
| 2016/0175668 | A1 | 6/2016 | Tang | |
| 2017/0173420 | A1 | 6/2017 | Frame | |

FOREIGN PATENT DOCUMENTS

| | | |
|---|---|---|
| JP | 10137374 | 5/1998 |
| JP | 10234902 | 9/1998 |
| JP | 10248964 | 9/1998 |
| JP | 11319167 | 11/1999 |
| JP | 2000005350 | 1/2000 |
| JP | 2000176059 | 6/2000 |
| JP | 2001000606 | 1/2001 |
| JP | 2001149514 | 6/2001 |
| JP | 2002011124 | 1/2002 |
| JP | 2004-307011 | 11/2004 |
| JP | 3109501 | 3/2005 |
| JP | 2005160947 | 6/2005 |
| JP | 2005-296582 | 10/2005 |
| JP | 2005-323978 | 11/2005 |
| JP | 2006000435 | 1/2006 |
| JP | 2006081862 | 3/2006 |
| JP | 2006122334 | 5/2006 |
| JP | 2006187489 | 7/2006 |
| JP | 2006198251 | 8/2006 |
| JP | 2006239154 | 9/2006 |
| JP | 2006-320493 | 11/2006 |
| JP | 2007313304 | 12/2007 |
| JP | 2011-229914 | 11/2011 |
| WO | WO 2009/102661 | 8/2009 |

* cited by examiner

GOLF CLUB WITH MOVABLE WEIGHT

RELATED APPLICATIONS

The current application is a continuation of U.S. patent application Ser. No. 15/365,471, GOLF CLUB WITH MOVEABLE WEIGHT, to Cleghorn et al., filed Nov. 30, 2016, now U.S. Pat. No. 10,035,051, which is a continuation-in-part of U.S. patent application Ser. No. 15/282,854, GOLF CLUB WITH MOVABLE WEIGHT, to Frame et al., filed Sep. 30, 2016, now U.S. Pat. No. 9,975,019, which is a continuation-in-part of U.S. patent application Ser. No. 14/979,151, GOLF CLUB HAVING REMOVABLE WEIGHT, to Frame et al., filed on Dec. 22, 2015, now U.S. Pat. No. 9,744,415, as well as U.S. patent application Ser. No. 15/257,692, GOLF CLUB WITH MOVABLE WEIGHT, to Cleghorn et al., filed on Sep. 6, 2016, now U.S. Pat. No. 9,914,028, the disclosure of which are incorporated by reference in their entirety.

TECHNICAL FIELD

This present technology generally relates to systems, devices, and methods related to golf clubs, and more specifically to golf club heads having movable weights.

DESCRIPTION OF THE RELATED TECHNOLOGY

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts. Additionally, discretionary mass placement has allowed the club to more optimally locate the center of gravity (CG) of the golf club head, and sometimes make that CG location adjustable through the use of adjustable and/or moveable weights.

Various methods are used to selectively locate mass throughout golf club heads, including thickening portions of the body casting itself or strategically adding separate weight elements during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize composite multi-material structures. These composite structures utilize two, three, or more materials that have different physical properties including different densities. An example of this type of composite club head is shown in U.S. Pat. No. 5,720,674. The club head comprises an arcuate portion of high-density material bonded to a recess in the back-skirt. Because composite materials like those found in the club head must be bonded together, for example by welding, swaging, or using bonding agents such as epoxy, they may be subject to delamination or corrosion over time. This component delamination or corrosion results in decreased performance in the golf club head and can lead to club head failure.

One aspect of the present technology is the realization that position of weight elements in existing golf club head designs are not easily adjustable. Thus, there exists a need for an improved golf club head.

SUMMARY

The systems, methods, and devices described herein have innovative aspects, no single one of which is indispensable or solely responsible for their desirable attributes. Without limiting the scope of the claims, some of the advantageous features will now be summarized.

Though many methods of optimizing the mass properties of golf club heads exist, there remains a need in the art for a golf club head comprising at least one easily and quickly movable weight having a secure attachment. The present invention is directed to an improved weighting system for golf clubs that increases the club's playability.

The present technology is directed to a golf club head incorporating a position adjustable weight system. The position adjustable weight system provides the ability to fine tune the performance characteristics of the golf club via manipulation of the position of an adjustable weight, thereby manipulating the location of the center of gravity and the moment of inertia of the golf club to suit the golfer's preference and increase the club's playability.

One non-limiting embodiment of the present technology includes a golf club head, including: a body having a face, a sole, a crown, and a skirt joining the face, sole, and crown; a hollow golf club interior within the body; the body having an exterior surface opposite the hollow golf club interior; the body having a center of gravity; wherein the body comprises an elongate weight receptacle; a weight retainer located in the weight receptacle; wherein the weight receptacle comprises a plurality of weight mounts; wherein each of the plurality of weight mounts comprises a recess, and wherein the recess comprises a locking wall; wherein the weight retainer is configured to slide along the weight receptacle between each of the plurality of weight mounts when the weight retainer is unlocked, and wherein the weight retainer is configured to reside in any of the plurality of weight mounts when the weight retainer is locked; wherein the weight receptacle comprises a pair of locking rails running along each side of the weight receptacle and a channel formed between the locking rails; wherein the pair of locking rails comprise thick portions and thin portions, the thin portions located adjacent the recesses, and wherein the locking walls are formed between the thin portions and the thick portions; and wherein the weight receptacle comprises a weight receptacle installation feature configured to receive the weight retainer, wherein the weight receptacle installation feature comprises recesses formed in each of the pair of locking rails.

In an additional non-limiting embodiment of the present technology the weight receptacle comprises a weight port configured to receive a weight member, the weight port formed in a floor of the weight receptacle adjacent the hollow golf club interior In an additional non-limiting embodiment of the present technology the recesses of the weight receptacle installation feature comprise a central protrusion, and wherein the weight retainer comprises a weight retainer installation feature configured to clear the central protrusion when installing the weight retainer in the weight receptacle.

In an additional non-limiting embodiment of the present technology the weight receptacle installation feature is located between two of the plurality of weight mounts, wherein the two of the plurality of weight mounts are located adjacent one another.

In an additional non-limiting embodiment of the present technology the weight retainer comprises a rotating portion and a non-rotating portion, the rotating portion rotatably affixed to the non-rotating portion, and wherein rotating less than 100 degrees of rotation of the rotating portion in a first direction relative to the non-rotating portion locks the weight retainer, and wherein less than 100 degrees of rotation of the rotating portion in a second direction relative to the non-rotating portion unlocks the weight retainer.

One non-limiting embodiment of the present technology includes a golf club head, including: a body having a face, a sole, a crown, and a skirt joining the face, sole, and crown; a hollow golf club interior within the body; the body having an exterior surface opposite the hollow golf club interior; the body having a center of gravity; wherein the body comprises an elongate weight receptacle; a weight retainer located in the weight receptacle; wherein the weight receptacle comprises a plurality of weight mounts; wherein each of the plurality of weight mounts comprises a recess, and wherein the recess comprises a locking wall; wherein the weight retainer is configured to slide along the weight receptacle between each of the plurality of weight mounts when the weight retainer is unlocked, and wherein the weight retainer is configured to reside in any of the plurality of weight mounts when the weight retainer is locked; wherein the weight receptacle comprises a pair of locking rails running along each side of the weight receptacle and a channel formed between the locking rails; wherein the pair of locking rails comprise thick portions and thin portions, the thin portions located adjacent the recesses, and wherein the locking walls are formed between the thin portions and the thick portions; and wherein the weight receptacle comprises a weight receptacle installation feature configured to receive the weight retainer, wherein the weight receptacle installation feature comprises a recess formed in one of the pair of locking rails.

In an additional non-limiting embodiment of the present technology the weight receptacle comprises a weight port configured to receive a weight member, the weight port formed in a floor of the weight receptacle adjacent the hollow golf club interior In an additional non-limiting embodiment of the present technology the recess of the weight receptacle installation feature comprises a central protrusion, and wherein the weight retainer comprises a weight retainer installation feature configured to clear the central protrusion when installing the weight retainer in the weight receptacle.

In an additional non-limiting embodiment of the present technology the weight receptacle installation feature is located between two of the plurality of weight mounts, wherein the two of the plurality of weight mounts are located adjacent one another.

In an additional non-limiting embodiment of the present technology the weight receptacle installation feature comprises recesses formed in each of the pair of locking rails.

In an additional non-limiting embodiment of the present technology the weight retainer comprises a rotating portion and a non-rotating portion, the rotating portion rotatably affixed to the non-rotating portion, and wherein rotating less than 100 degrees of rotation of the rotating portion in a first direction relative to the non-rotating portion locks the weight retainer, and wherein less than 100 degrees of rotation of the rotating portion in a second direction relative to the non-rotating portion unlocks the weight retainer.

One non-limiting embodiment of the present technology includes a golf club head, including: a body having a face, a sole, a crown, and a skirt joining the face, sole, and crown; a hollow golf club interior within the body; the body having an exterior surface opposite the hollow golf club interior; the body having a center of gravity; wherein the body comprises an elongate weight receptacle; a weight retainer located in the weight receptacle; wherein the weight receptacle comprises a plurality of weight mounts; wherein the weight retainer is configured to slide along the weight receptacle between each of the plurality of weight mounts when the weight retainer is unlocked, and wherein the weight retainer is configured to reside in any of the plurality of weight mounts when the weight retainer is locked; and wherein the weight receptacle comprises a weight receptacle installation feature configured to receive the weight retainer, wherein the weight receptacle installation feature is located between two of the plurality of weight mounts, wherein the two of the plurality of weight mounts are located adjacent one another.

In an additional non-limiting embodiment of the present technology the weight receptacle comprises a weight port configured to receive a weight member, the weight port formed in a floor of the weight receptacle adjacent the hollow golf club interior In an additional non-limiting embodiment of the present technology the recesses of the weight receptacle installation feature comprises a central protrusion, and wherein the weight retainer comprises a weight retainer installation feature configured to clear the central protrusion when installing the weight retainer in the weight receptacle.

In an additional non-limiting embodiment of the present technology the weight receptacle installation feature is located between two of the plurality of weight mounts, wherein the two of the plurality of weight mounts are located adjacent one another.

In an additional non-limiting embodiment of the present technology each of the plurality of weight mounts comprises a recess, and wherein the recess comprises a locking wall.

In an additional non-limiting embodiment of the present technology the weight receptacle comprises a pair of locking rails running along each side of the weight receptacle and a channel formed between the locking rails, wherein the pair of locking rails comprise thick portions and thin portions, the thin portions located adjacent the recesses, and wherein the locking walls are formed between the thin portions and the thick portions.

In an additional non-limiting embodiment of the present technology the weight receptacle installation feature comprises a recess formed in one of the pair of locking rails.

In an additional non-limiting embodiment of the present technology the weight receptacle installation feature comprises recesses formed in each of the pair of locking rails.

In an additional non-limiting embodiment of the present technology the weight retainer comprises a rotating portion and a non-rotating portion, the rotating portion rotatably affixed to the non-rotating portion, and wherein rotating less than 100 degrees of rotation of the rotating portion in a first direction relative to the non-rotating portion locks the weight retainer, and wherein less than 100 degrees of rotation of the rotating portion in a second direction relative to the non-rotating portion unlocks the weight retainer.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
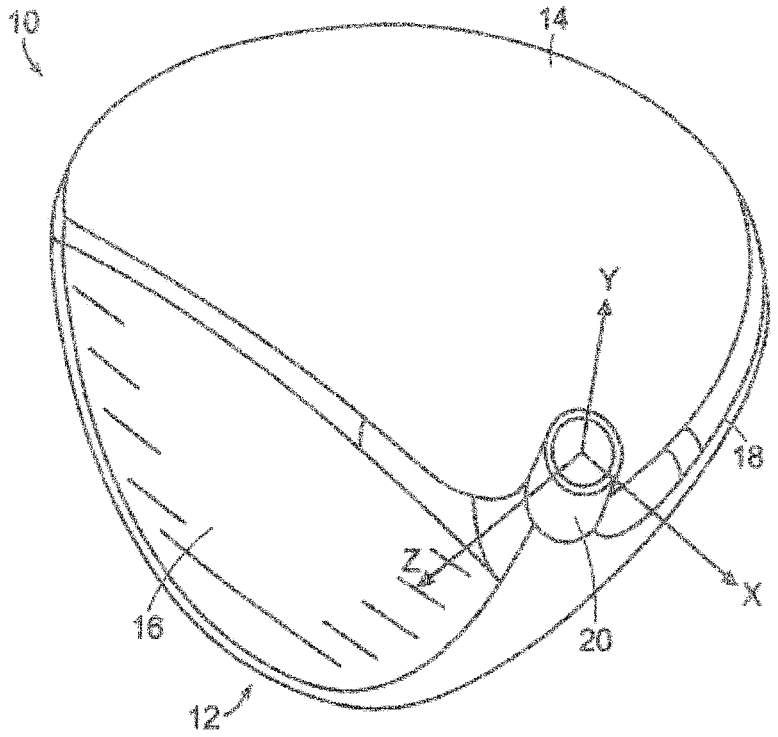
FIG. 1 illustrates a perspective view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

The golf club head of the present invention is preferably hollow, such as a metal wood type golf club head, but may include any club head type, such as iron-type club heads. The golf club head generally includes a hosel, a striking face, a crown, a sole, and a skirt that combine to define a hollow interior cavity.

Figure 2:
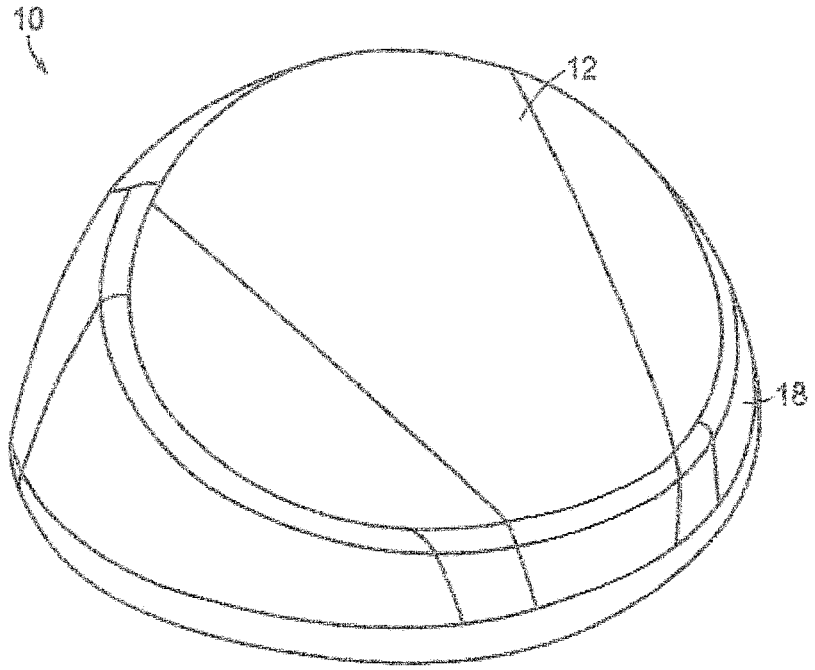
FIG. 2 illustrates a perspective view of the bottom of the golf club head of FIG. 1.
Figure 3:
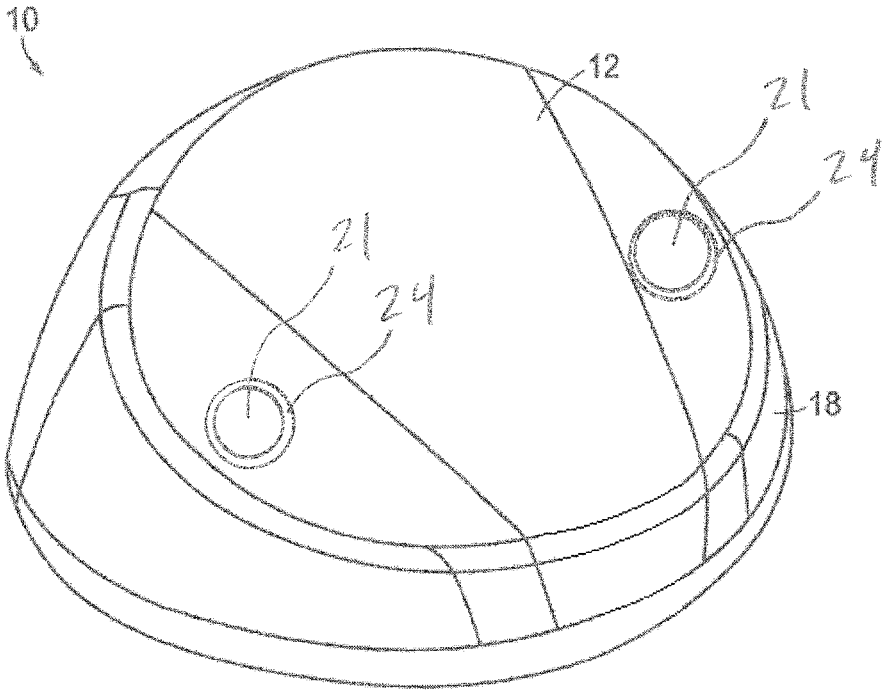
FIG. 3 illustrates a perspective view of the bottom of the golf club head including a plurality of weight members received in weight mounts.
Figure 4:
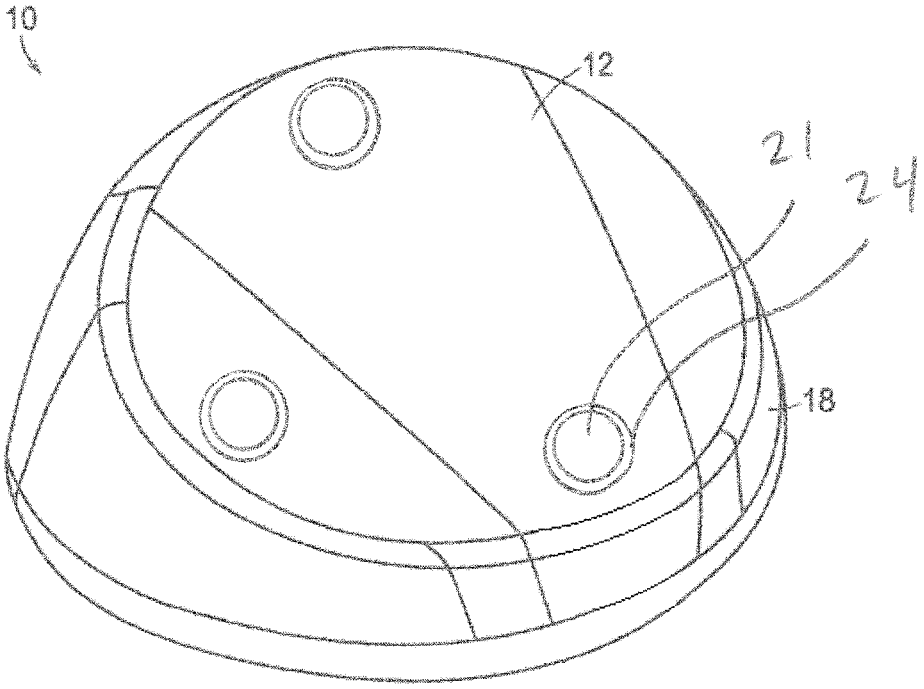
FIG. 4 illustrates a perspective view of the bottom of an additional embodiment of the golf club head including a plurality of weight members received in weight mounts.

The inventive golf club head also has a low profiled weight member disposed on a portion of the club head, and preferably on the crown, sole and/or skirt of the golf club head. The embodiments described below are generally illustrated so that the weight member is attached at least partially to the sole for convenience. FIG. 1 illustrates a perspective view of a golf club head 10. FIG. 2 illustrates a perspective view of the bottom of the golf club head 10 of FIG. 1. Club head 10 includes a sole 12, a crown 14, a striking face 16, a skirt 18, and a hosel 20. Sole 12 generally provides the lower surface of golf club head 10 when the club head is placed in an address position. FIG. 3 illustrates a perspective view of the bottom of the golf club head 10 including a plurality of weight members 21 received in weight mounts 24. FIG. 4 illustrates a perspective view of the bottom of an additional embodiment of the golf club head 10 including a plurality of weight members 21 received in weight mounts 24.

The embodiments described herein are generally illustrated so that the weight members are attached at least partially to the sole for convenience. However, as will be appreciated by a person having ordinary skill, weight mounts, weight members, and weight retainers having the same structures as those described may be located on any portion of the golf club head, such as the crown and/or skirt. Additionally, weight mounts are illustrated separate from the golf club head for convenience. However, as will be appreciated by a person having ordinary skill, weight mounts described herein are intended to be either permanently affixed to the golf club head or formed integrally with the golf club head.

The inventive golf club head 10 includes removable weight members 21 configured to alter the location of the center of gravity (C.G.) of the golf club head 10 when the weight members 21 are added, removed, and/or exchanged with weight members 21 of different weight. The weight members 21 are retained in weight mounts 24, configured to couple the weight members 21 to the golf club head 10. The golf club head 10 preferably includes a plurality of weight mounts 24. In some embodiments, the C.G. can be manipulated by exchanging one or more weight members 21 on the golf club head 10 with another weight member 21 on the golf club head 10. In other embodiments, a single weight member 21 may be transferred from one weight mount 24 to another weight mount 24. In additional embodiments, one or more weight members 21 may be exchanged with a different weight member 21 having a different mass.

It is generally preferable to have the capability of adjusting the C.G. quickly and easily. Several inventive embodiments of weight members and weight mounts are described herein which allow the user to remove and install weight members from weight mounts quickly and easily. Additionally, the weight mounts must retain the weight members to the golf club head when the golf club head strikes a golf ball, without causing any rattling, vibration, or loosening of the weight member relative to the golf club head. Traditionally, weight members are retained by a combination of male and female threads. The weight member is rotated relative to the weight mount a plurality of turns until the weight member bottoms out against a portion of the golf club head, and the threads begin to bind as the male threads are loaded against the female threads, locking the weight member in place. This however takes multiple rotations of the weight member relative to the golf club head. Additionally, threads add the possibility of cross threading, which can destroy the ability to either remove or install the weight member into the weight mount. The weight members, weight mounts, and weight retainers described herein, are configured to be locked to the golf club head with one rotation or less of the weight retainer, in other words, less than or equal to 360 degrees, relative to the weight mount of the golf club head, and more preferably, with 180 degrees or less, and most preferably with 90 degrees or less.

Several embodiments herein utilize either a spring force of some kind or a binding to lock the weight member relative to the weight mount. Some of the embodiments utilize a spring exerting a force which is substantially parallel to the axis of rotation of the weight member to lock the weight member in place. Other embodiments utilize a spring exerting a force which is substantially perpendicular to the axis of rotation of the weight retainer to lock the weight member in place.

Both weight members and weight retainers are discussed herein. In some embodiments, the weight members are generally utilized to change the overall weight of the golf club head, move the CG of the golf club head, or alter the MOI of the golf club head. The weight retainers are configured to lock the weight members into the weight mounts of the golf club head. In some embodiments, the weight retainer can be affixed to or formed integrally with the weight member. In other embodiments, the weight retainer may be separate from the weight member. The term weight retainer, when used herein, can be used to describe both weight retainers formed and operating separately from a weight member to retain the weight member, as well as weight members formed integrally with weight retainers, the latter being the default definition. The description and claims will refer to a weight member particularly if the particular embodiment being described includes a weight member as a separate piece from the weight retainer.

Figure 5:
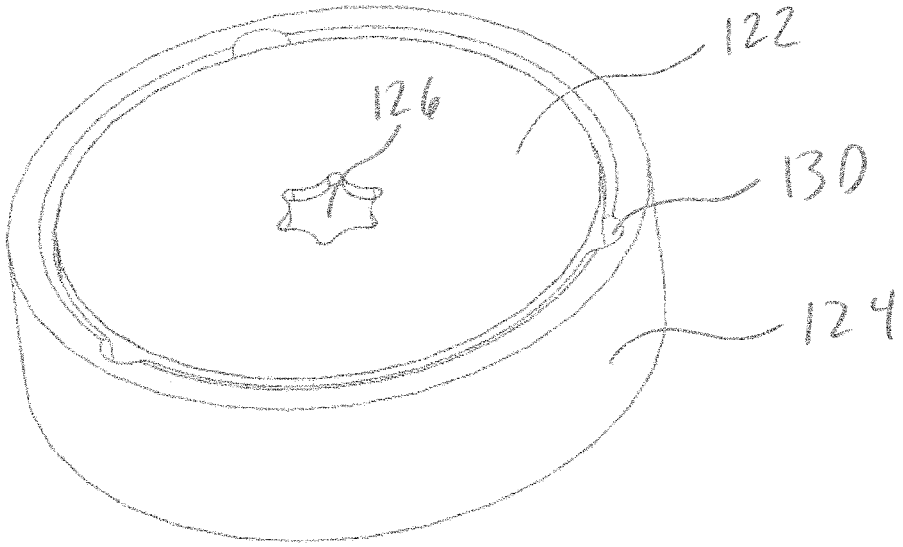
FIG. 5 illustrates a perspective view of one embodiment of a weight retainer locked in a weight mount.
Figure 6:
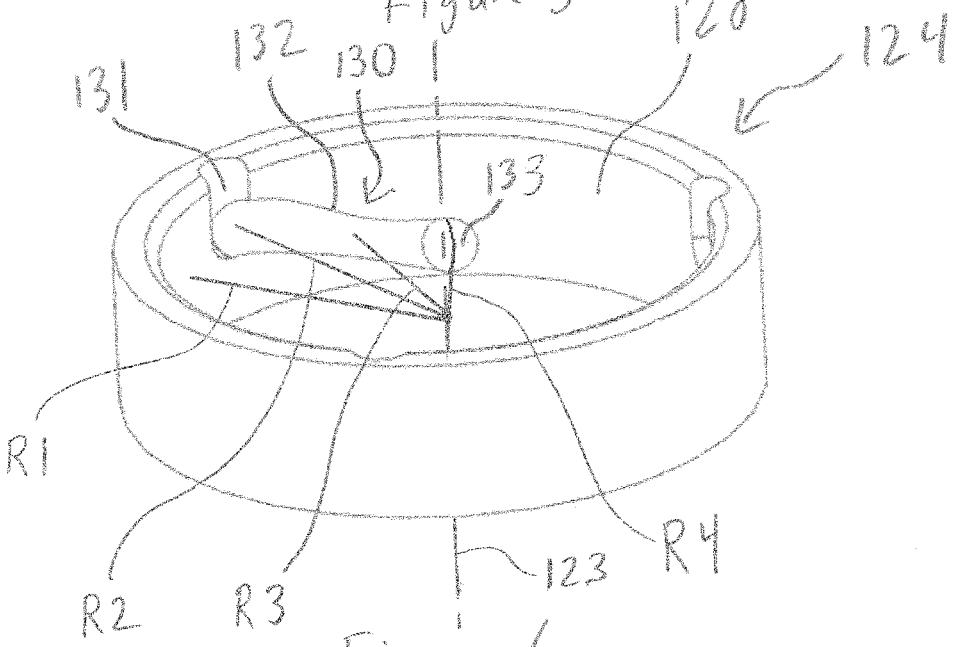
FIG. 6 illustrates a perspective view of the weight mount of FIG. 5.
Figure 7:
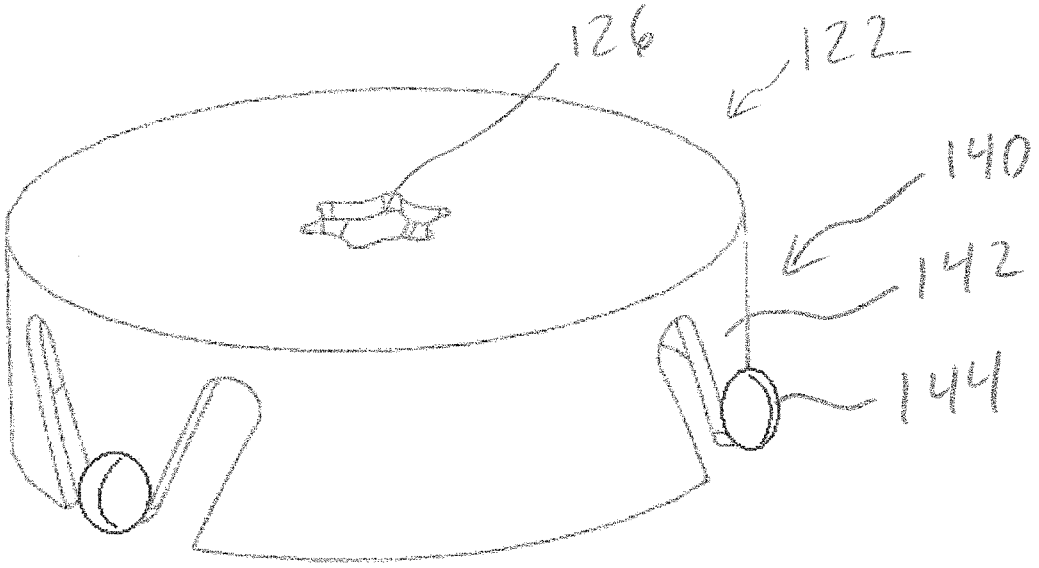
FIG. 7 illustrates a perspective view of the weight retainer of FIG. 5.
Figure 8:
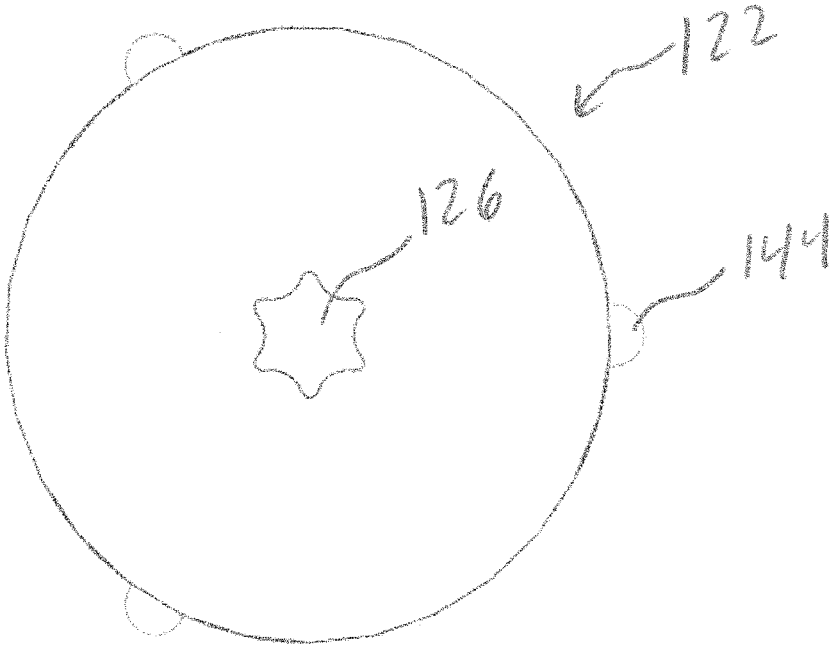
FIG. 8 illustrates a top view of the weight retainer of FIG. 5.

FIG. 5 illustrates a perspective view of one embodiment of a weight retainer 122 locked in a weight mount 124. FIG. 6 illustrates a perspective view of the weight mount 124 of FIG. 5. FIG. 7 illustrates a perspective view of the weight retainer 122 of FIG. 5. FIG. 8 illustrates a top view of the weight retainer 122 of FIG. 5. The weight retainer 122 includes a tool receiving feature 126. A user can install a tool into the tool receiving feature 126 and apply a torque to the weight retainer 122, rotating it relative to the weight mount 124 to either lock, or unlock the weight retainer 122 to the golf club head. The weight mount 124 includes a substantially cylindrical cavity configured to receive the weight retainer 122 and includes an inner wall 128. The weight mount 124 includes a locking feature 130 configured to lock the weight retainer 122 in place. As illustrated in FIG. 6, the locking feature can be a slot 130 configured to receive a portion of the weight retainer 122. The slot 130 is formed into the inner wall 128 of the weight mount 124. In some embodiments, the weight retainer 122 is integrally formed with a weight member 121. In some embodiments, the weight retainer 122 can include a cavity within to house a separate weight member 121.

The weight retainer 122 can include at least one engagement feature 140 configured to engage the locking feature 130 of the weight mount and lock the weight retainer 122 to the golf club head. As illustrated in FIGS. 7 and 8, the engagement feature 140 can include a deflectable arm 142 and a protrusion 144. The deflectable arm 142 is configured so that the protrusion 144 can deflect in a direction substantially perpendicular to the axis of rotation of the weight retainer 122. The protrusion 144 is configured to engage the locking feature 130 of the weight mount. The protrusion 144 can be substantially spherical in shape as illustrated in FIGS. 7 and 8.

The slot 130 can include an entry portion 131, a transition portion 132, and a detent 133. The slot 130 is configured to deflect the deflectable arm 142 of the weight retainer 122 as the weight retainer 122 is rotated relative to the weight mount 124. The entry portion 131 is configured to receive the engagement feature 140 of the weight retainer 122 as the weight retainer 122 is installed into the golf club head. The transition portion 132, is configured to deflect the deflectable arm 142 of the weight retainer 122 as the weight retainer 122 is rotated. The detent 133 is configured to receive the protrusion 144 of the engagement feature 140. As illustrated in FIG. 6, the inner wall 128 of the weight mount 124 has a radius R1 from the axis of rotation 123 of the weight retainer 122. Additionally, the entry portion 131 of the slot 130 has an effective radius R2. Effective radius is defined as the distance from the axis of rotation 123 to the portion of the slot which contacts and deflects the engagement feature 140 of the weight retainer. Radius R2 is greater than R1, which forces the engagement feature 140 of the weight retainer to follow the slot 130 once the weight retainer 122 is inserted into the weight mount 124. The transition portion 132 has an effective radius R3 that begins substantially similar to radius R2 and decreases in length as the transition portion 132 approaches the detent 133. Then the detent has an effective radius R4 which is greater than the Radius R3 adjacent the detent 133. The slot geometry described above causes the engagement feature 140 of the weight retainer 122 to deflect as the weight retainer 122 is rotated in a first direction (clockwise as illustrated in FIG. 6) and the protrusion 144 slides along the transition portion 132. Once the protrusion reaches the detent 133, the energy stored in the engagement feature 140 from being deflected forces the protrusion 144 into the detent 133, locking the weight retainer 122 to the weight mount 124 and the golf club head. In order to unlock the weight retainer 122 and remove it from the golf club head, the user must apply a torque to the weight retainer 122 in a second direction, (counter clockwise as illustrated in FIG. 6), opposite the first direction. The torque must be large enough to deflect the engagement feature 140 of the weight retainer 122 such that the protrusion 133 leaves the detent and slides through the transition portion 132 as the weight retainer 122 rotates relative to the weight mount 124. In addition to the varying effective radii R2, R3, and R4 of the slot 130, the slot can also drive the weight retainer 122 towards the golf club head as it is rotated in a first direction, as illustrated in FIG. 6, by angling at least a portion of the slot 130.

Figure 9:
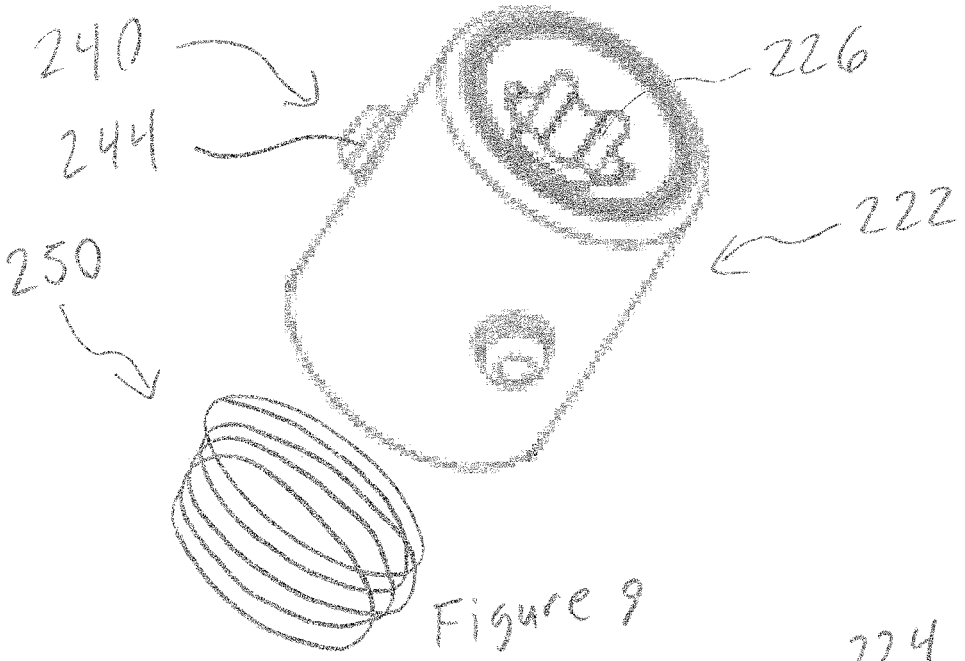
FIG. 9 illustrates a perspective view of one embodiment of a weight retainer and spring.
Figure 10:
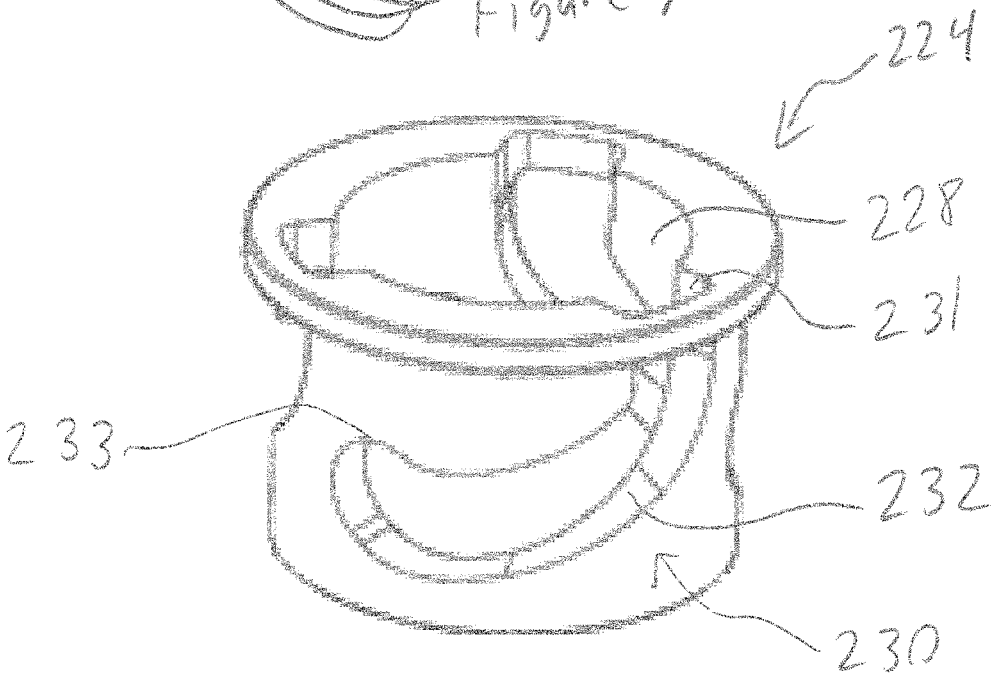
FIG. 10 illustrates a perspective view of one embodiment of a weight mount.

Rather than utilize a spring force that acts substantially perpendicular to the axis of rotation like the embodiment illustrated in FIGS. 5-8, many of the embodiments below generally utilize a spring force acting substantially parallel to the axis of rotation. FIG. 9 illustrates a perspective view of one embodiment of a weight retainer 222 and spring 250. FIG. 10 illustrates a perspective view of one embodiment of a weight mount 224. The weight retainer 222 includes at least one engagement feature 240 configured to engage the weight mount 224 and lock the weight retainer 222 to the golf club head. As illustrated in FIG. 9, the engagement feature can be a protrusion 244. The weight mount 224 includes a substantially cylindrical cavity configured to receive the weight retainer 222 and includes an inner wall 228. The weight mount 224 includes a locking feature 230 configured to lock the weight retainer 222 in place. As illustrated in FIG. 10, the locking feature 230 can be a slot 230 configured to receive a portion of the weight retainer 222. The slot 230 can include an entry portion 231, a transition portion 232, and a detent 233. The entry portion 231 is configured to receive the engagement feature 240 of the weight retainer 222 as the weight retainer 222 is installed into the golf club head. The transition portion 232, is configured to force the engagement feature 240 and the weight retainer 222 towards the golf club head as the weight retainer 222 is rotated. The spring 250 is configured to be located between the weight retainer 222 or weight member, if formed separately from the weight retainer 222, and the golf club head, forcing the weight retainer 222 away from the golf club head. The transition portion 232 of the slot is angled relative to the axis of rotation, such that the torque the user applies when rotating the weight retainer 222 in a first direction in combination with angle of the slot 230 causes the weight retainer to compress the spring 250. The detent 233 is configured to receive the protrusion 244 of the engagement feature 240 and lock the weight retainer 222 in place once the engagement feature 240 passes the end of the transition portion of 232 of the slot 230 and the spring 250 forces the engagement feature 240 into the detent 233.

Figure 11:
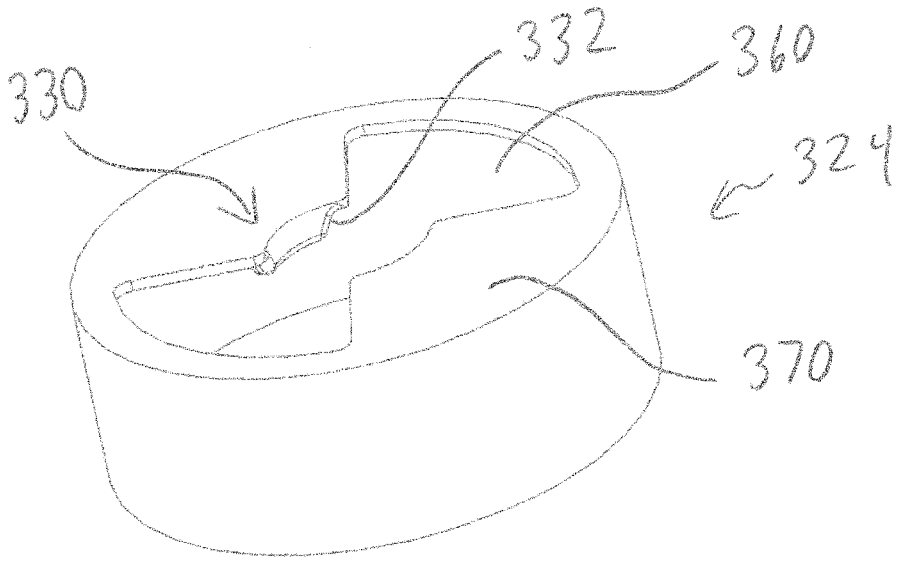
FIG. 11 illustrates a perspective view of an additional embodiment of a weight mount.
Figure 12:
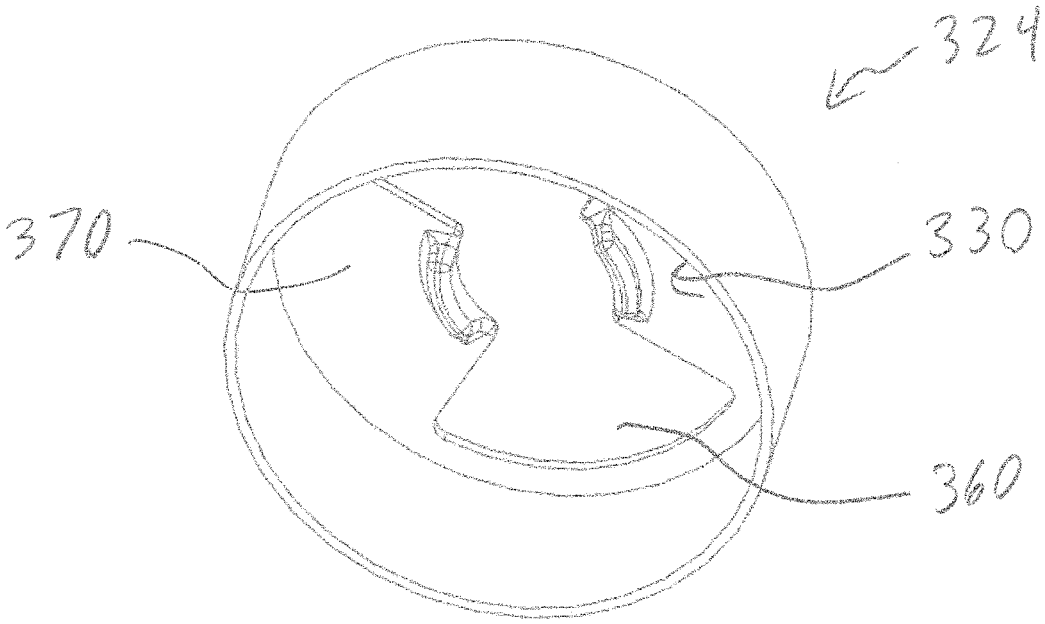
FIG. 12 illustrates an additional perspective view the weight mount of FIG. 11.
Figure 13:
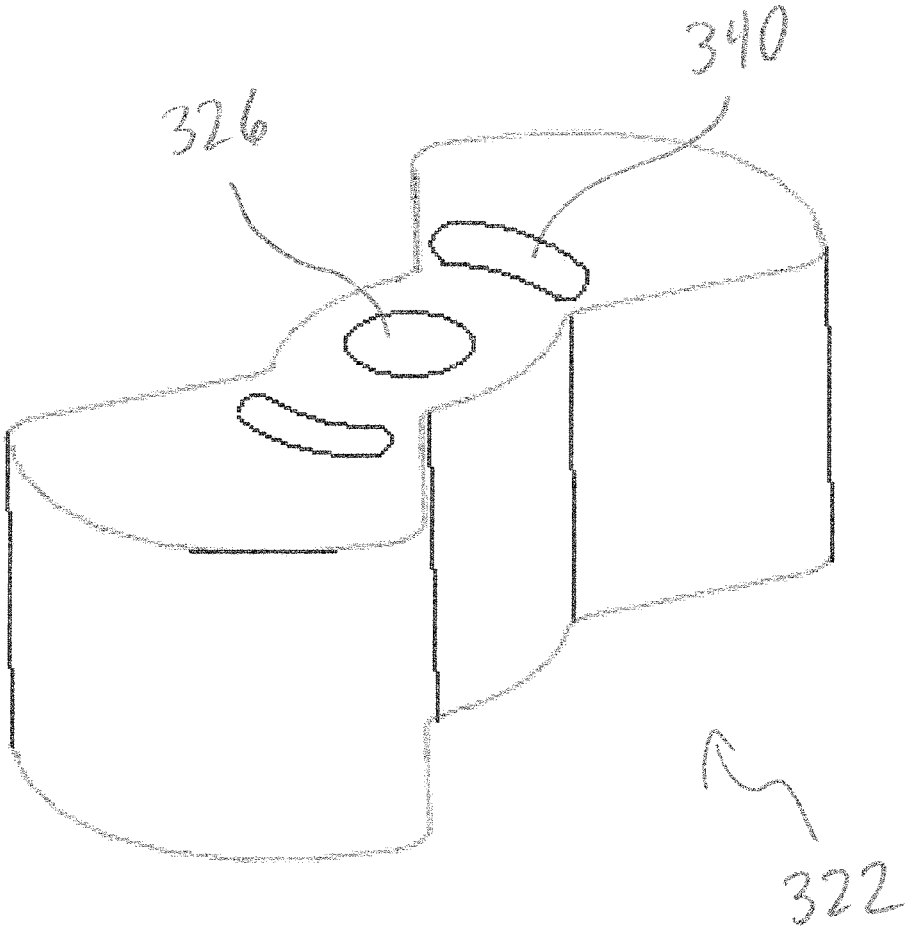
FIG. 13 illustrates a perspective view of an additional embodiment of a weight retainer.
Figure 14:
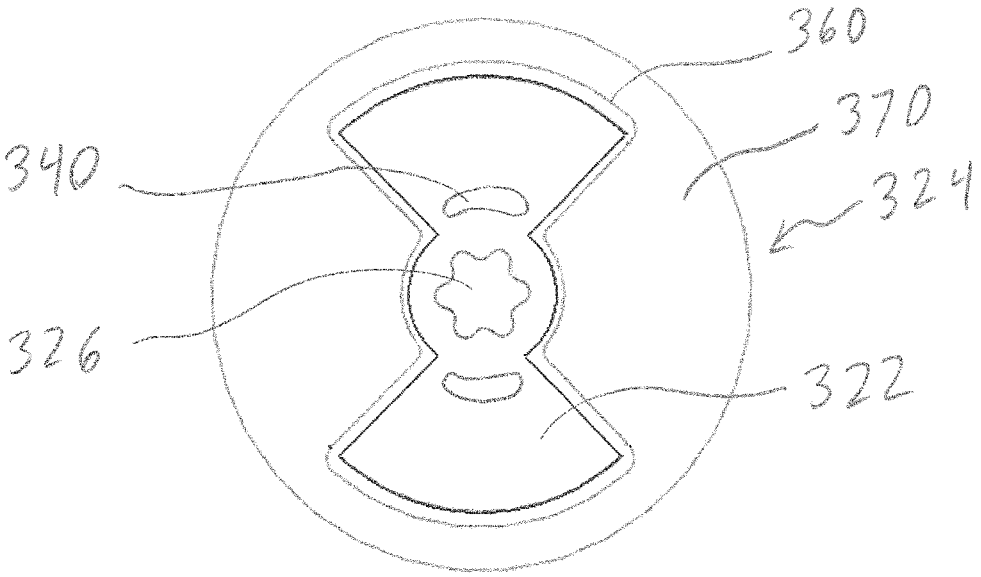
FIG. 14 illustrates a top view of the weight retainer of FIG. 13 in an unlocked position inside the weight mount of FIG. 11.
Figure 15:
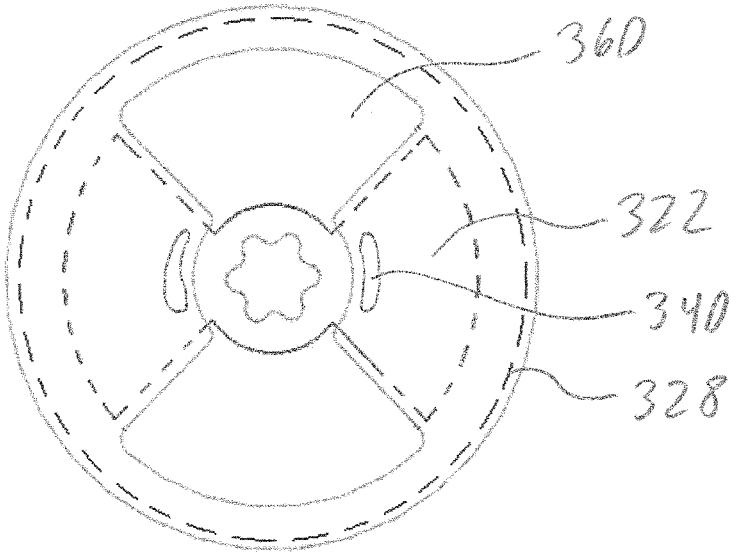
FIG. 15 illustrates a top view of the weight retainer of FIG. 13 in a locked position inside the weight mount of FIG. 11.
Figure 16:
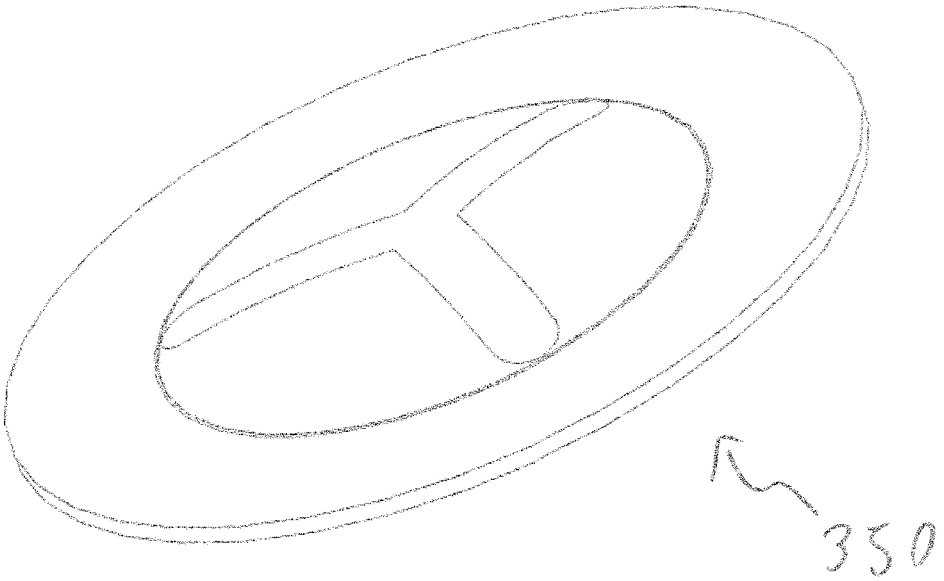
FIG. 16 illustrates a perspective view of one embodiment of a spring.
Figure 17:
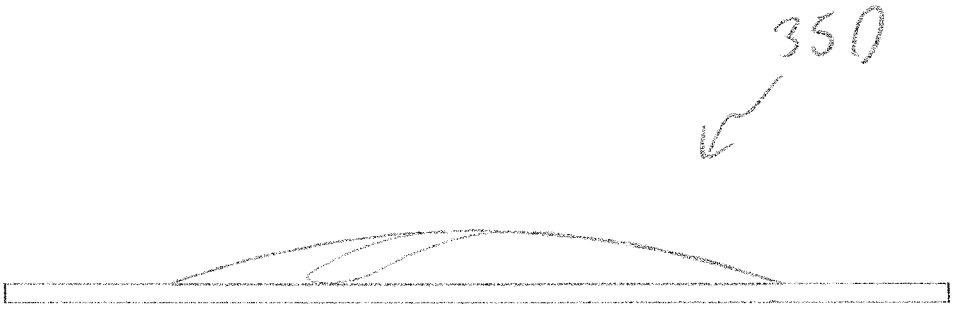
FIG. 17 illustrates a side view of the spring of FIG. 16.

FIG. 11 illustrates a perspective view of an additional embodiment of a weight mount 324. FIG. 12 illustrates an additional perspective view the weight mount 324 of FIG. 11. FIG. 13 illustrates a perspective view of an additional embodiment of a weight retainer 322. FIG. 14 illustrates a top view of the weight retainer 322 of FIG. 13 in an unlocked position inside the weight mount 324 of FIG. 11. FIG. 15 illustrates a top view of the weight retainer 322 of FIG. 13 in a locked position inside the weight mount 324 of FIG. 11. FIG. 16 illustrates a perspective view of one embodiment of a spring 350. FIG. 17 illustrates a side view of the spring 350 of FIG. 16.

The weight mount 324 includes a ceiling 370 with an aperture 360 formed through it. The aperture 360 is configured to receive the weight retainer 322. The weight mount 324 includes at least one locking feature 330. The locking feature 330 can be a protrusion extending from the inside of the ceiling 370 as illustrated in FIGS. 11 and 12. The protrusion 330 can include a transition portion 332 at the end angled relative to the axis of rotation of the weight retainer 322. The weight retainer 322 can include at least one engagement feature 340 configured to engage the locking feature 330 of the weight mount 324. The engagement feature 340 can be a detent 340 as illustrated in FIG. 13. The detent 340 can also be tapered to complement the transition portion 332 of the protrusion 330. Additionally, the protrusion 330 and detent 340 can be configured for a wedge fit to minimize rattling and vibration. A spring 350, such as the one illustrated in FIGS. 16 and 17, can be located inside the weight mount 324, and configured to force the weight retainer 322 away from the club head. The weight mount 324 is illustrated without a floor for convenience, but the spring would preferably be located against the floor of the weight mount 324, which would be opposite the ceiling 370. In some embodiments, the ceiling 370 can be flush with an external surface of the golf club head such as the sole. In other embodiments, the ceiling 370 may be raised away from the external surface of the golf club head. In yet another embodiment, the ceiling 370 may be recessed into the golf club head relative to the external surface.

The weight retainer 322 could be inserted into the weight mount 324 through the aperture 360 in an unlocked position as illustrated in FIG. 14. Then the weight retainer 322 can be rotated relative to the weight mount 324. As the weight retainer 322 contacts the transition portion 332 of the protrusion 330, the protrusion 330 forces the weight retainer 322 towards the golf club head, against the spring 350, until the weight retainer 322 reaches a locked position, as illustrated in FIG. 15, where the protrusion 330 can engage the engagement feature 340 of the weight retainer 320, allowing the weight retainer 322 to move away from the golf club head as the protrusion 330 enters the detent 340, and the spring forces the weight retainer 322 into the ceiling 370, locking the weight retainer 322 in place.

The spring 350 illustrated in FIGS. 16 and 17 is different than a conventional compression spring, such as the one illustrated in FIG. 9. The spring 350 is at least partially dome shaped and may include channels formed therein as illustrated in FIGS. 16 and 17. The dome portion can deform as force is applied by the weight retainer 322, the spring 350 applying a force against the weight retainer 322.

Figure 18:
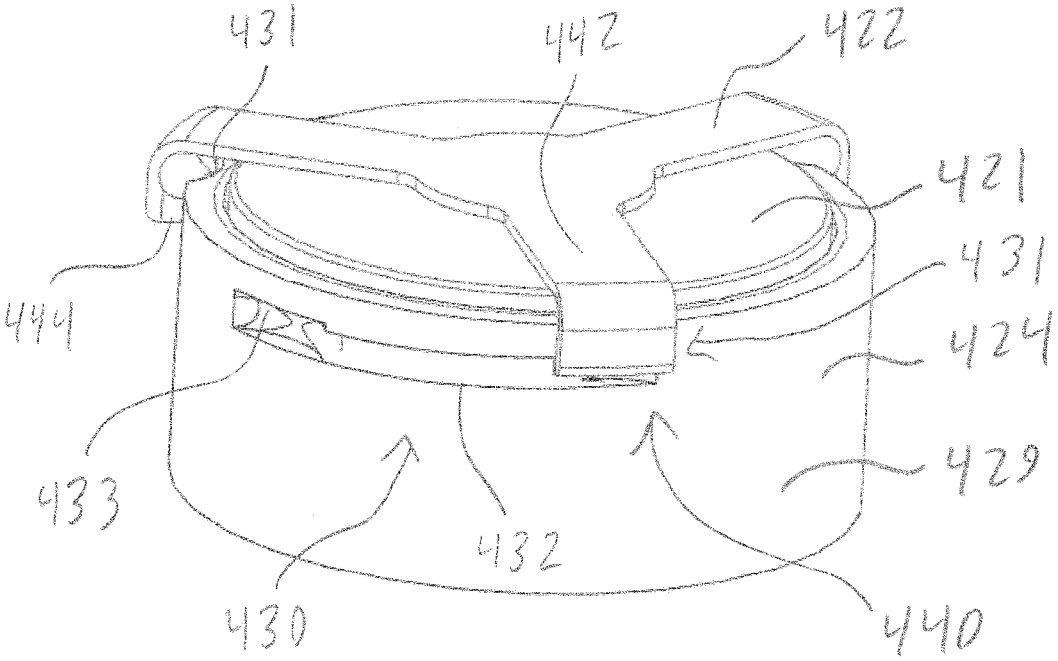
FIG. 18 illustrates a perspective view of additional embodiments of a weight member retained by a weight retainer in a weight mount.
Figure 19:
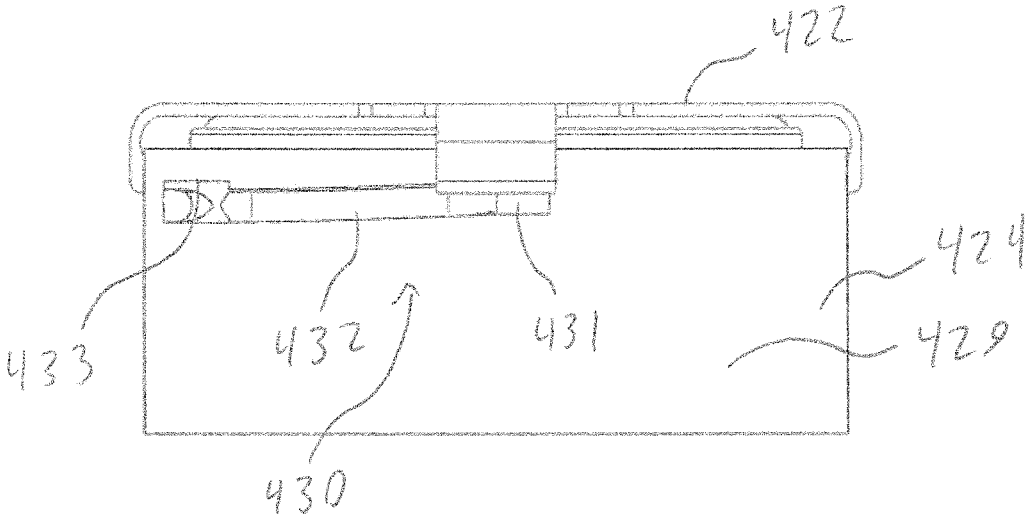
FIG. 19 illustrates a side view of the weight member, weight retainer, and weight mount illustrated in FIG. 18.

FIG. 18 illustrates a perspective view of additional embodiments of a weight member 421 retained by a weight retainer 422 in a weight mount 424. FIG. 19 illustrates a side view of the weight member 421, weight retainer 422, and weight mount 424 illustrated in FIG. 18. In this embodiment, the weight member 421 can be a separate component from the weight retainer 422 or they could be affixed to one another. The weight mount includes a locking feature 430 configured to lock the weight retainer 422 in place. As illustrated in FIGS. 18 and 19, the locking feature can be a slot 430 configured to receive a portion of the weight retainer 422. The slot 430 is formed into an outer wall 429 of the weight mount 424.

The weight retainer can include at least one engagement feature 440 configured to engage the locking feature 430 of the weight mount 424 and lock the weight retainer 422 to the weight mount 424. As illustrated in FIGS. 18 and 19, the engagement feature 440 can include a deflectable arm 442 and a protrusion 444. The deflectable arm 442 is configured to deflect so that the protrusion 444 can move in a direction substantially parallel to the axis of rotation of the weight retainer 422. The protrusion 444 is configured to engage the locking feature 430 of the weight mount.

The slot 430 can include an entry portion 431, a transition portion 432, and a detent 433. The slot 430 is configured to deflect the deflectable arm 442 of the weight retainer 424 as the weight retainer 422 is rotated relative to the weight mount 424. The entry portion 431 is configured to receive the engagement feature 440 of the weight retainer 422 as the weight retainer 422 is installed into the golf club head. The transition portion 432, is configured to deflect the deflectable arm 442 of the weight retainer 422 as the weight retainer 422 is rotated. The detent 433 is configured to receive the protrusion 444 of the engagement feature 440. As illustrated in FIGS. 18 and 19, the transition portion 432 is angled such that the distance of the slot 430 from the outer edge of the weight mount 424, in a direction parallel to the rotation axis of the weight retainer 422, increases along its length from the entry portion 431 to the detent 433. As the weight retainer 424 is rotated in a first direction, the deflectable arm 442 is loaded and deflected. Then the detent decreases the distance of the slot 430 from the outer edge of the weight mount 424. As the protrusion 444 enters the detent 433, the deflectable arm 442 forces the protrusion 444 into the detent 433, locking the weight retainer 424 and thusly the weight member 422 in place.

Figure 20:
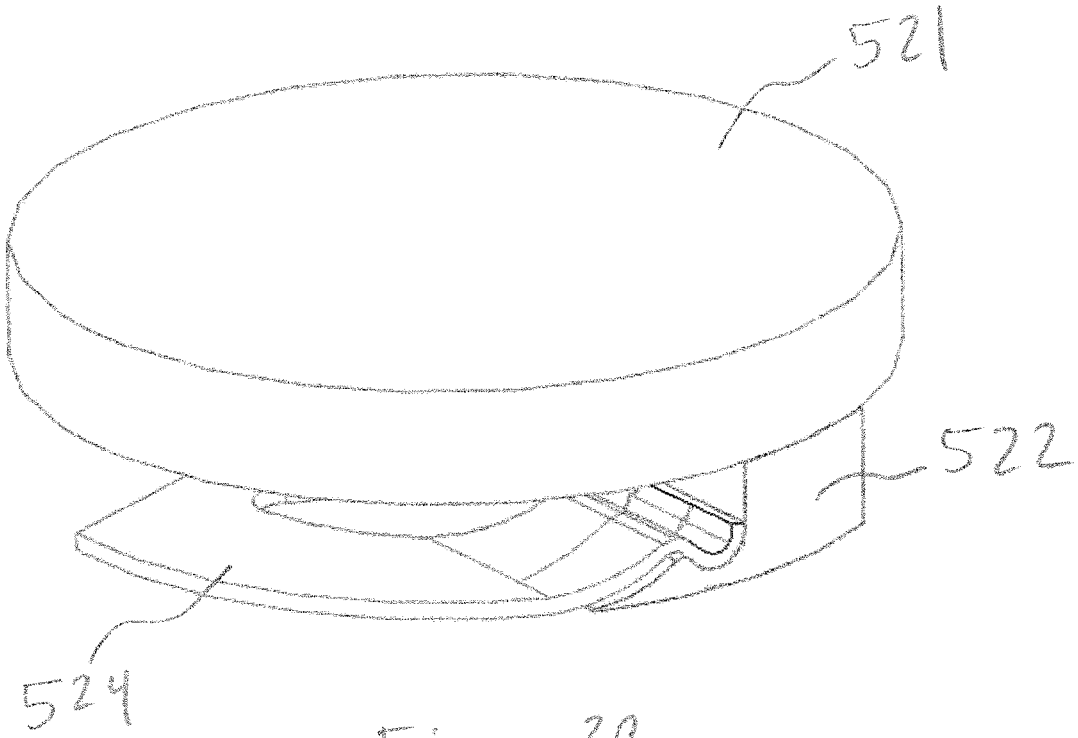
FIG. 20 illustrates a perspective view of additional embodiments of a weight member, weight retainer, and weight mount.
Figure 21:
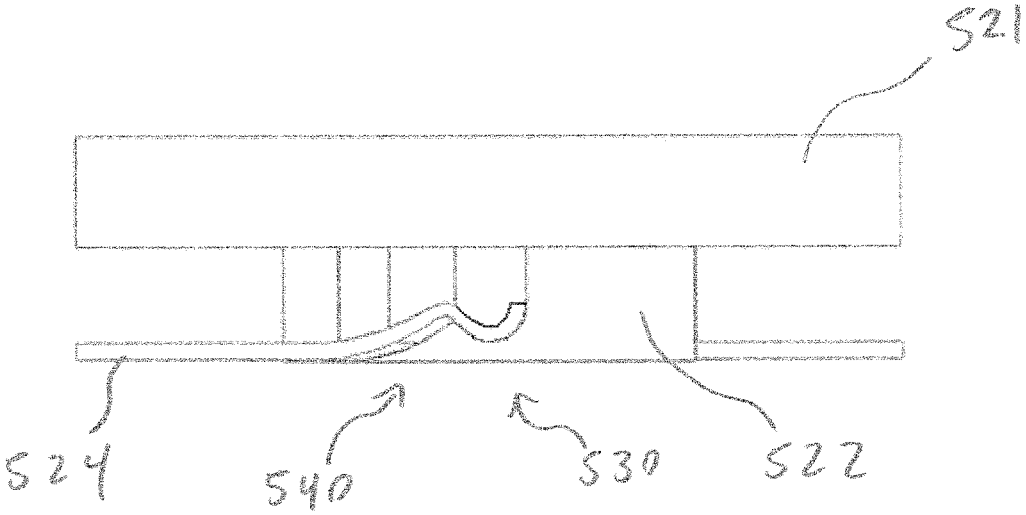
FIG. 21 illustrates a side view of the weight member, weight retainer, and weight mount of FIG. 20.
Figure 22:
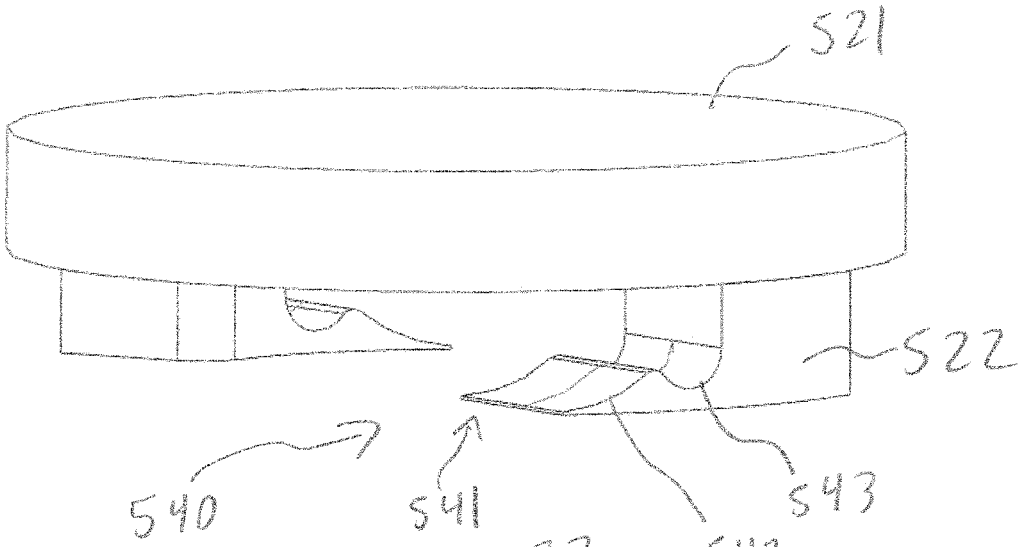
FIG. 22 illustrates a perspective view of the weight member and weight retainer of FIG. 20.
Figure 23:
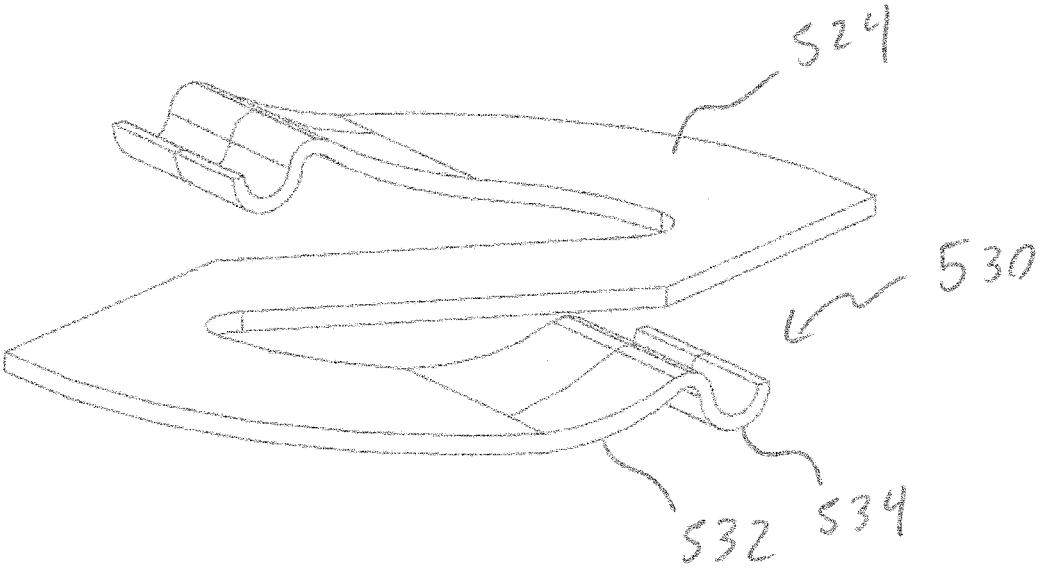
FIG. 23 illustrates a perspective view of the weight mount of FIG. 20.

FIG. 20 illustrates a perspective view of additional embodiments of a weight member 521, weight retainer 522, and weight mount 524. FIG. 21 illustrates a side view of the weight member 521, weight retainer 522, and weight mount 524 of FIG. 20. FIG. 22 illustrates a perspective view of the weight member 521 and weight retainer 522 of FIG. 20. FIG. 23 illustrates a perspective view of the weight mount 524 of FIG. 20. In this embodiment, rather than integrating a deflectable arm into the weight retainer as illustrated in other embodiments, the deflectable arm 532 is integrated into the weight mount 524. The weight retainer includes an engagement feature 540 configured to engage the locking feature 530 of the weight mount 524 and lock the weight retainer 522 to the weight mount 524. The engagement feature 540 can be a ramp 540 including an entry portion 541, a transition portion 542, and a detent 543. The weight mount 524 includes a locking feature 530 configured to engage the engagement feature 540 of the weight retainer 522. The locking feature 530 can include a deflectable arm 532 and a protrusion 534. As the weight member 521 and weight retainer 522 are rotated in a first direction, the locking feature enters the entry portion 541 of the ramp 540, and then the deflectable arm 532 begins to deflect as the protrusion 534 is forced away from the golf club head and towards the weight member 521 by the incline of the transition portion 542 of the ramp 540, until the protrusion 534 reaches the end of the transition portion 542 and is forced into the detent 543 by the spring force of the deflectable arm 532, as illustrated in FIGS. 20 and 21, locking the weight retainer 522 and weight member 521 in place.

Figure 24:
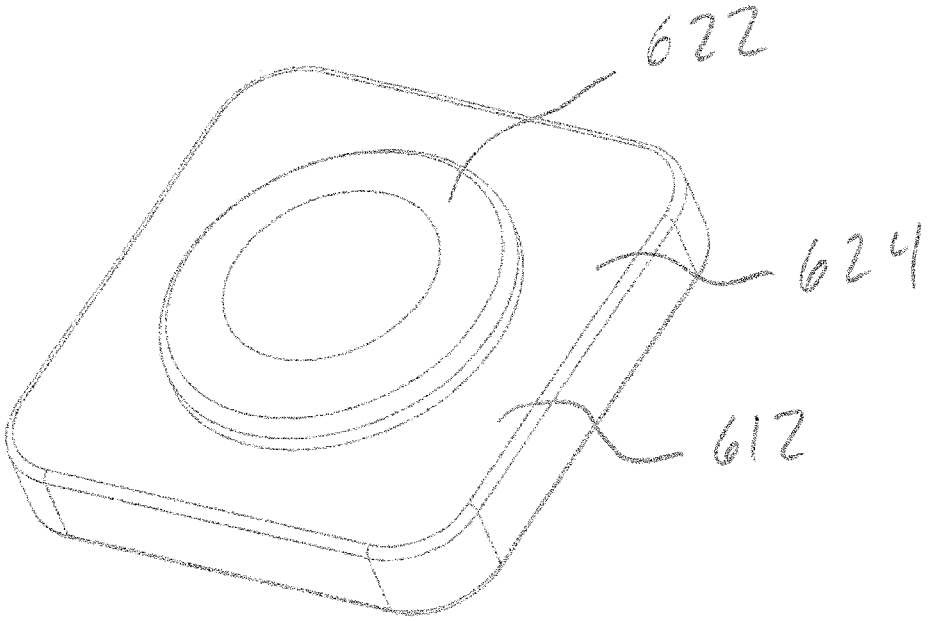
FIG. 24 illustrates an external perspective view of additional embodiments of a weight retainer locked in a weight mount.
Figure 25:
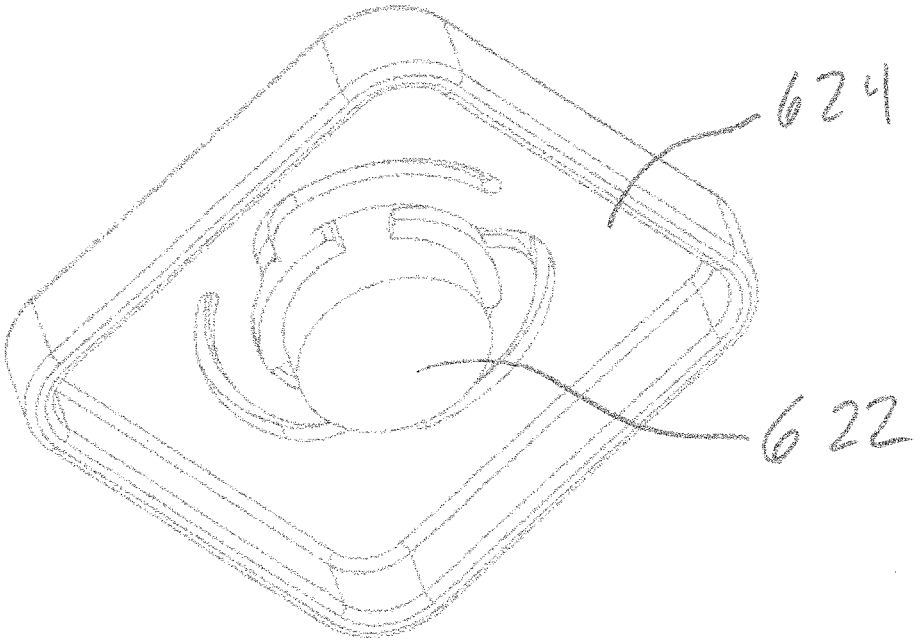
FIG. 25 illustrates an internal perspective view of the weight retainer and weight mount of FIG. 24.
Figure 26:
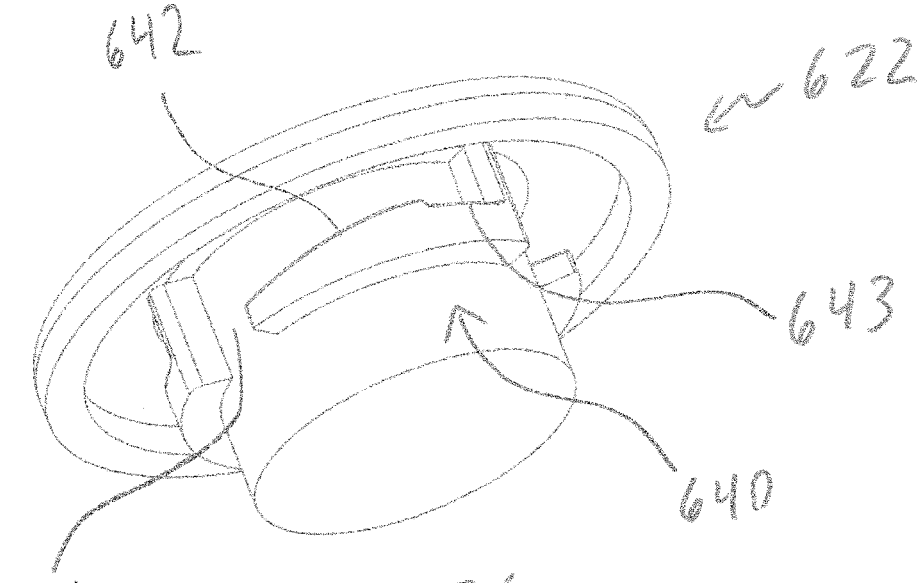
FIG. 26 illustrates a perspective view of the weight retainer of FIG. 24.
Figure 27:
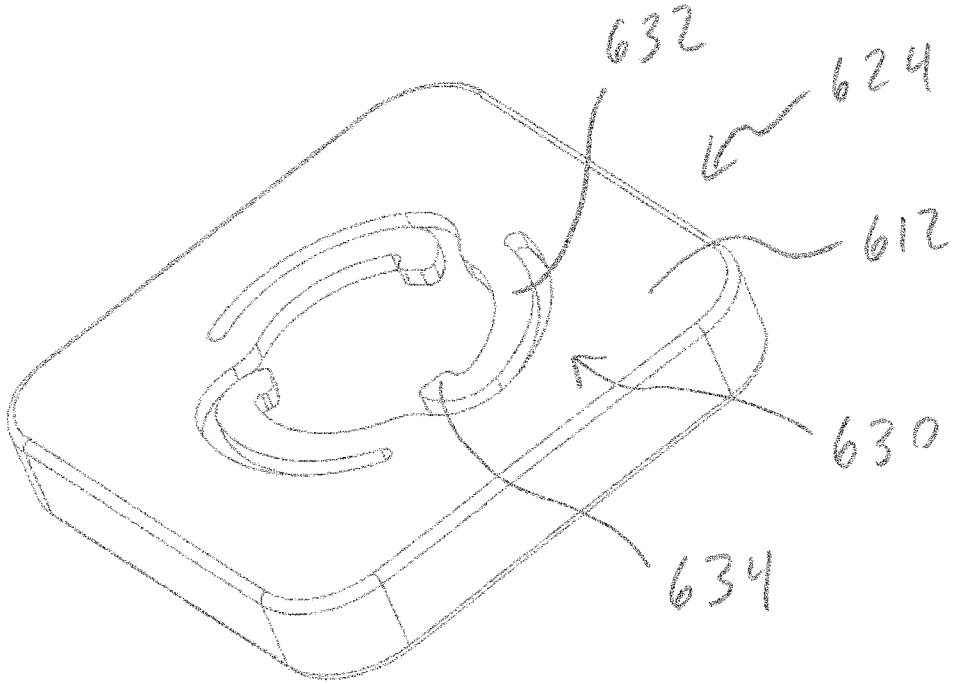
FIG. 27 illustrates an internal perspective view of the weight mount of FIG. 24.
Figure 28:
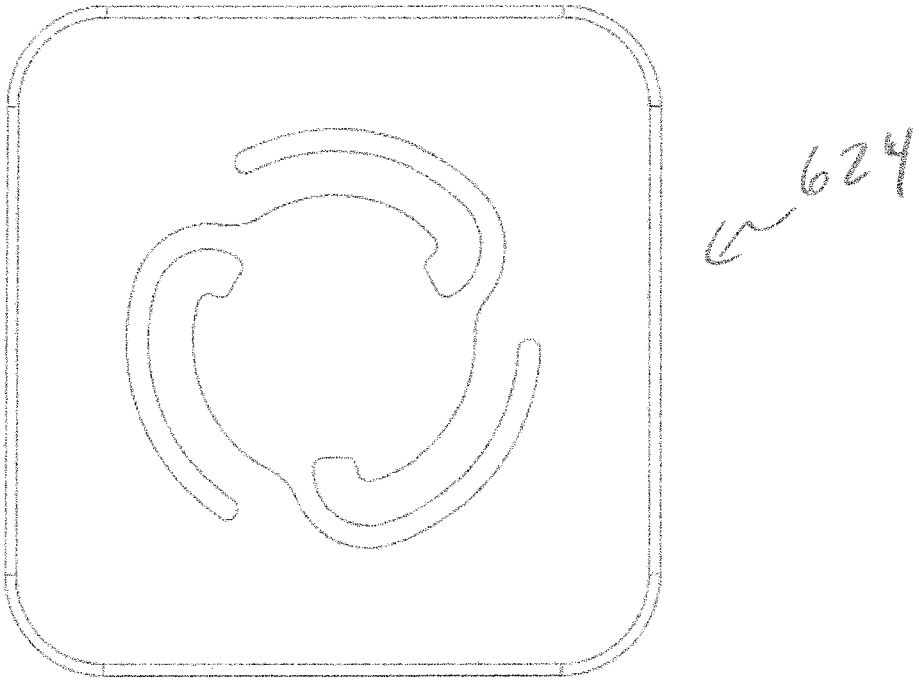
FIG. 28 illustrates an external top view of the weight mount of FIG. 24.
Figure 29:
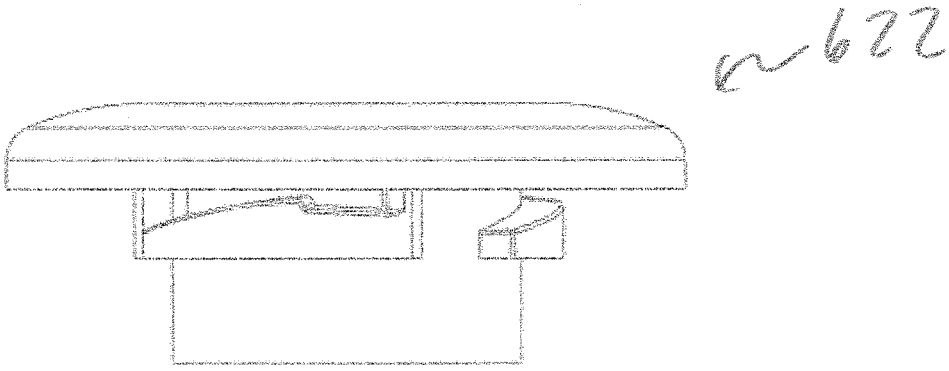
FIG. 29 illustrates a side view of the weight retainer of FIG. 24.
Figure 30:
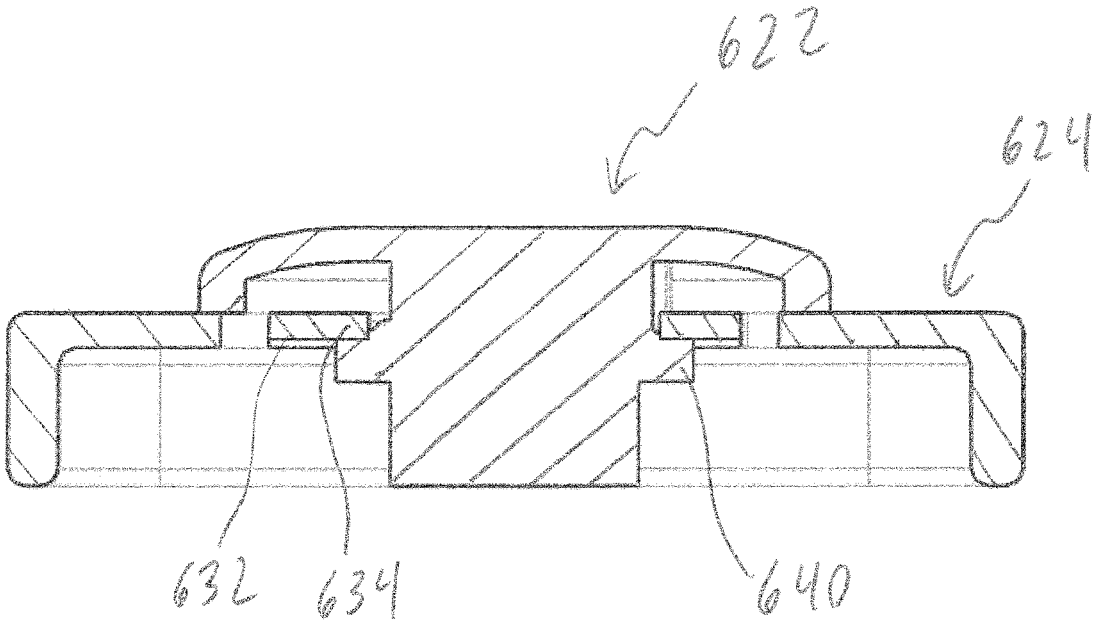
FIG. 30 illustrates a cross-sectional view of the weight retainer locked in the weight mount of FIG. 24.

FIG. 24 illustrates an external perspective view of additional embodiments of a weight retainer 622 locked in a weight mount 624. FIG. 25 illustrates an internal perspective view of the weight retainer 622 and weight mount 624 of FIG. 24. FIG. 26 illustrates a perspective view of the weight retainer 622 of FIG. 24. FIG. 27 illustrates an internal perspective view of the weight mount 624 of FIG. 24. FIG. 28 illustrates an external top view of the weight mount 624 of FIG. 24. FIG. 29 illustrates a side view of the weight retainer 622 of FIG. 24. FIG. 30 illustrates a cross-sectional view of the weight retainer 622 locked in the weight mount 624 of FIG. 24. The weight retainer 622 as illustrated herein, can integrally include a weight member.

The weight retainer 622 and weight mount 624 of FIGS. 24 through 30 share several similarities with the weight retainer 522 and weight mount 524 of FIGS. 20 through 23. The weight retainer 622 includes at least one engagement feature 640. The engagement feature 640 can be a ramp 640 as illustrated in FIG. 26. The ramp 640 can include an entry portion 641, a transition portion 642, and a detent 643.

The weight mount 624 includes at least one locking feature 630 configured to engage the engagement feature 640 of the weight retainer 622 and lock the weight retainer 622 to the weight mount 624. The locking feature 630 includes deflectable arm 632 and a protrusion 634. The protrusion 634 extends inward towards the axis of rotation of the weigh retainer 622 in a direction substantially perpendicular to the axis of rotation as opposed to the protrusion 532 of FIGS. 20-23, which extends towards the club head in a direction substantially parallel to the axis of rotation. Similar to the deflectable arm 532 of FIGS. 20-23, the deflectable arm 632 deflects allowing the protrusion 634 to move in a direction substantially parallel to the axis of rotation.

The entry portion 641 of the ramp 640 allows for the protrusion 634 to enter the transition portion 642 of the ramp 640. As the weight retainer 622 is rotated in a first direction, the protrusion 634 rides up the transition portion 642 of the ramp, deflecting the deflectable arm 632 until the protrusion reaches the end of the transition portion 642 and snaps into the detent 643, locking the weight retainer 624 in place. In some embodiments, the weight mount 624 includes an outer surface 612 configured to flushly integrate into an external surface of the golf club head, such as the sole 12, as illustrated in FIGS. 3 and 4. In some embodiments, and as illustrated in FIGS. 24-30, the locking feature 630 of the weigh mount 624 is all formed substantially planar, substantially minimizing manufacturing costs. Additionally, the weight mount 624, along with other weight mounts described herein, are shown separate from a golf club head for convenience, but are configured to integrate into the golf club head, preferably mounting substantially flush with an external surface of the golf club head, such as the sole.

In additional embodiments, not illustrated, the weight retainer 622 could include a slot similar to the one illustrated in FIG. 6, however it is formed in the weight retainer instead of the weight mount. The locking feature 630, as illustrated or substantially similar, could then deflect in a direction substantially perpendicular to the axis of rotation of the weight retainer, and the protrusion could pop into the detent, locking the weight retainer to the weight mount.

Figure 31:
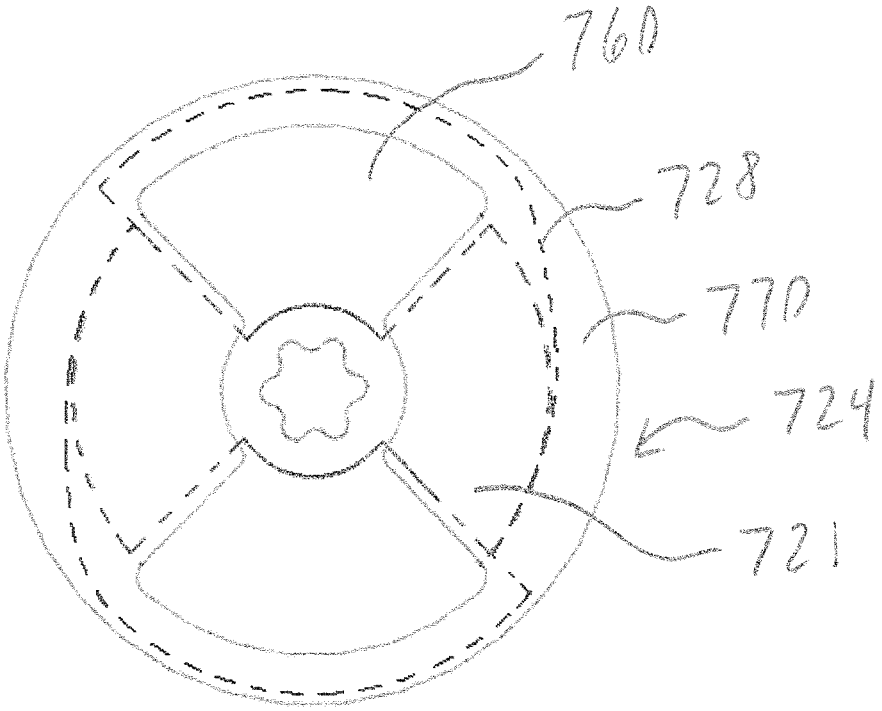
FIG. 31 illustrates a top view of an additional embodiment of a weight member locked in a weight mount.

FIG. 31 illustrates a top view of an additional embodiment of a weight member 721 locked in a weight mount 724. The weight mount 724 is similar to the weight mount of FIGS. 11 and 12, as it has an aperture 760 and an inner wall 728. However, the inner wall 728 of the weight mount 724 varies in distance from the axis of rotation of the weight member 721. The weight member 721 is inserted through the aperture into the weight mount 724, and then rotated in a first direction until the weight member 721 contacts the inner wall 728 of the weight mount 724, binding the weight member 721 and locking it in place. Additionally, the ceiling 770 can prevent the weight member 721 from dislodging from the weight mount 724.

Figure 32:
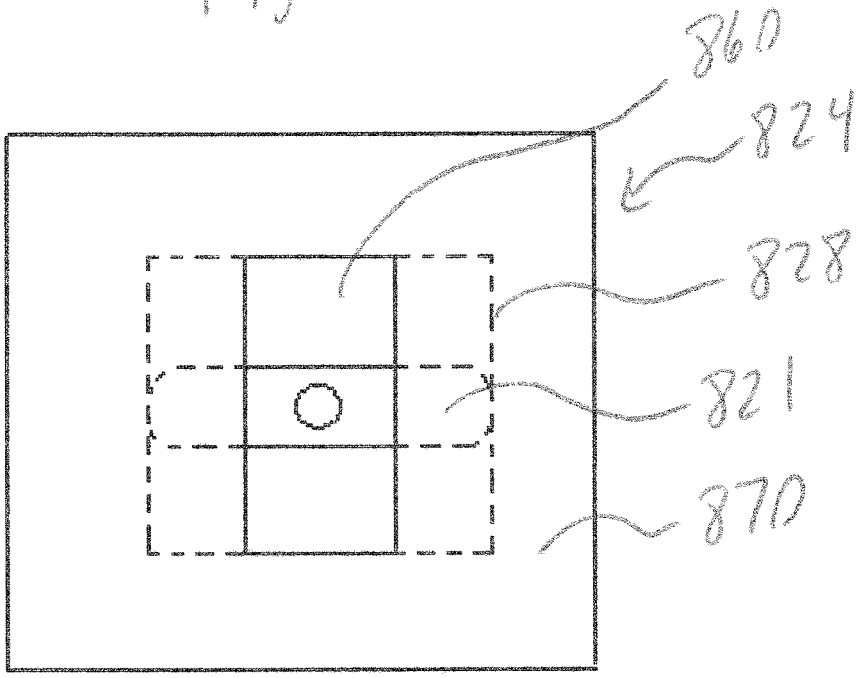
FIG. 32 illustrates a top view of an additional embodiment of a weight member locked in a weight mount.

FIG. 32 illustrates a top view of an additional embodiment of a weight member 821 locked in a weight mount 824. The weight mount 824 includes an aperture 860 configured to receive the weight member 821. The weight member is inserted through the aperture 860 and rotated in a first direction until it binds with the inner wall 828 of the weigh mount 824, locking the weight member 821 in place. Additionally, the ceiling 870 can prevent the weight member 821 from dislodging from the weight mount 824.

Figure 33:
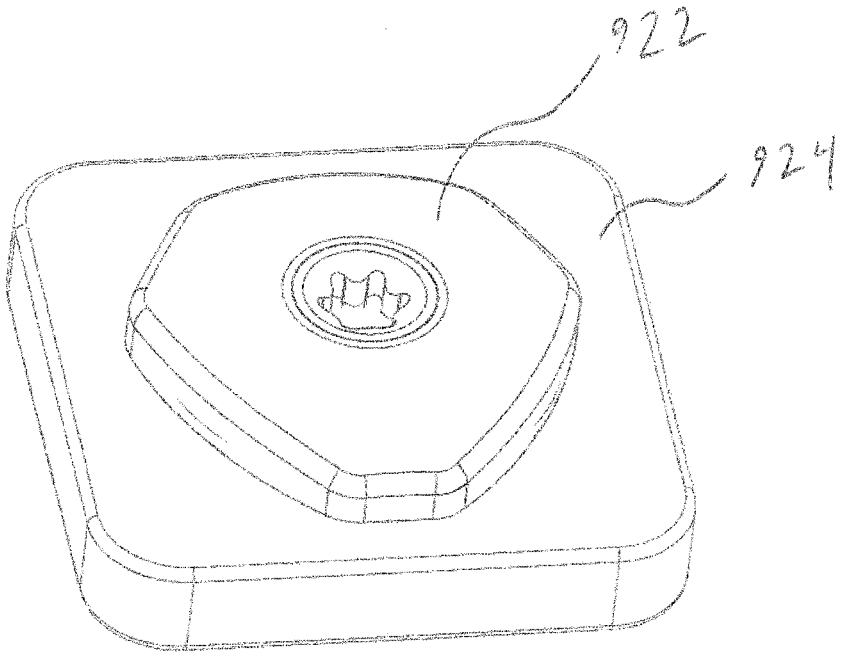
FIG. 33 illustrates an external perspective view of an additional embodiment of a weight retainer and weight member locked in a weight mount.
Figure 34:
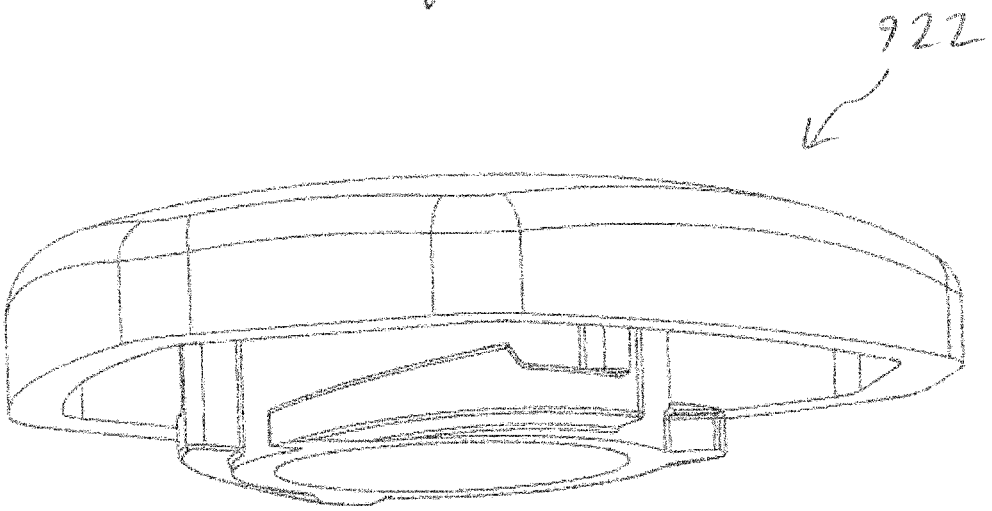
FIG. 34 illustrates a perspective view of the weight retainer and weight member of FIG. 33.
Figure 35:
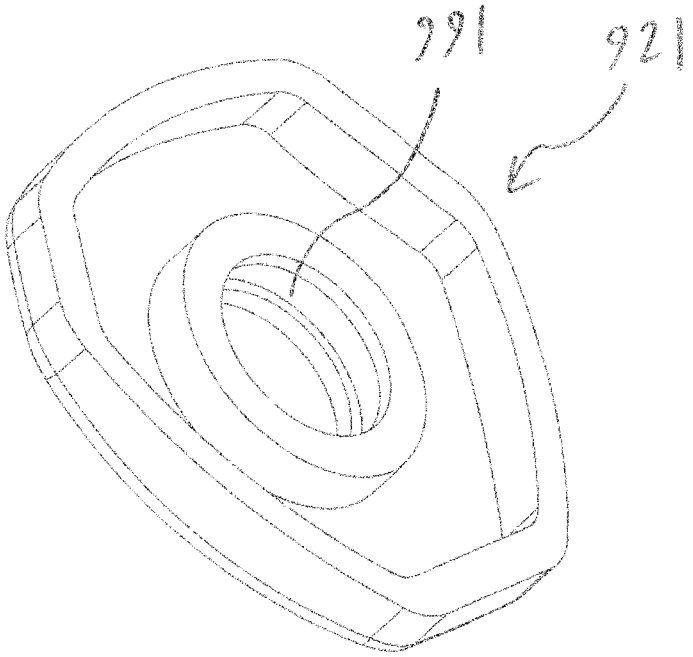
FIG. 35 illustrates a perspective view of the weight member of FIG. 34.
Figure 36:
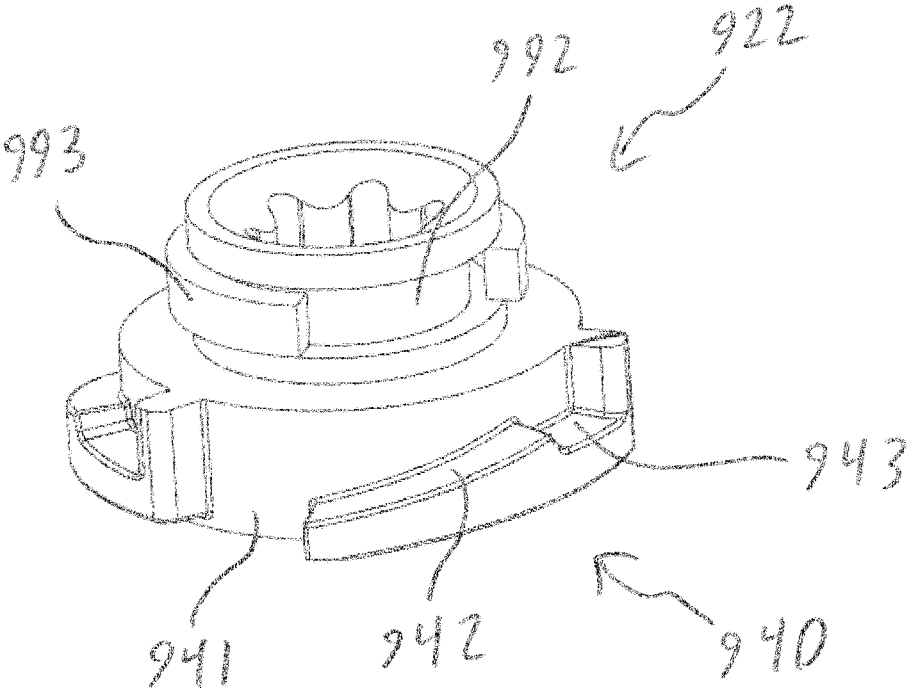
FIG. 36 illustrates a perspective view of the weight retainer of FIG. 34.
Figure 37:
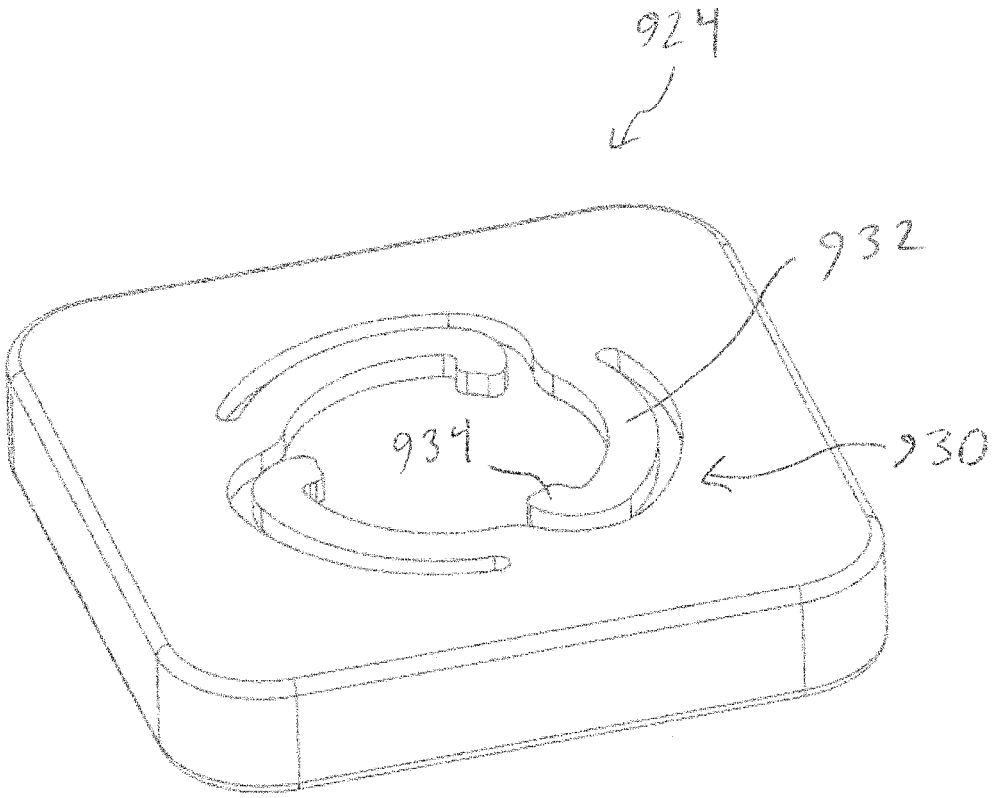
FIG. 37 illustrates a perspective view of the weight mount of FIG. 33.

FIG. 33 illustrates an external perspective view of an additional embodiment of a weight retainer 922 and weight member 921 locked in a weight mount 924. FIG. 34 illustrates a perspective view of the weight retainer 922 and weight member 921 of FIG. 33. FIG. 35 illustrates a perspective view of the weight member 921 of FIG. 34. FIG. 36 illustrates a perspective view of the weight retainer 922 of FIG. 34. FIG. 37 illustrates a perspective view of the weight mount 924 of FIG. 33.

The weight retainer 922 and weight mount 924 of FIGS. 33-37 are similar to those illustrated in FIGS. 24-30. The key difference being that the weight retainer 922 and the weight member 924 are two separate pieces that are rotatably coupled, whereas the weight retainer 622 has the weight member formed integrally. The embodiment illustrated in FIGS. 33-37 allows the weight retainer 922 to rotate relative to the weight member 921. This can be advantageous by preventing impacts and resultant vibrations and movements of the club head from loosening the lock between the weight retainer 922 and the weight mount 924. By allowing the weight member 921 to rotate relative to the weight retainer 922, rotation of the weight member 921 during impacts won't cause any loosening or unlocking of the weight retainer 922 to the weight mount 922 since the weight member 921 can't transfer torque to the weight retainer 922. The weight member 921 can include a groove 991 and the weight retainer 922 can also include a groove 992. The grooves 991, 992 configured to receive a snap-ring 993. The snap-ring 993 is configured to reside within the grooves 991, 992 and rotatably couple the weight member 921 to the weight retainer 922.

The inventive golf club heads described below generally include moveable weight retainers, the movable weight retainers configured to be selectively locked into a plurality of positions in order to manipulate the location of the center of gravity of the golf club head to better suit a golfer's swing characteristics and optimize ball flight. The embodiments described herein are generally illustrated so that the weight retainer is attached at least partially to the sole for convenience, but one skilled in the art will appreciate that the weight retainer could be attached to other portions of the golf club head, which may include for example, the crown, the skirt, etc.

Figure 38:
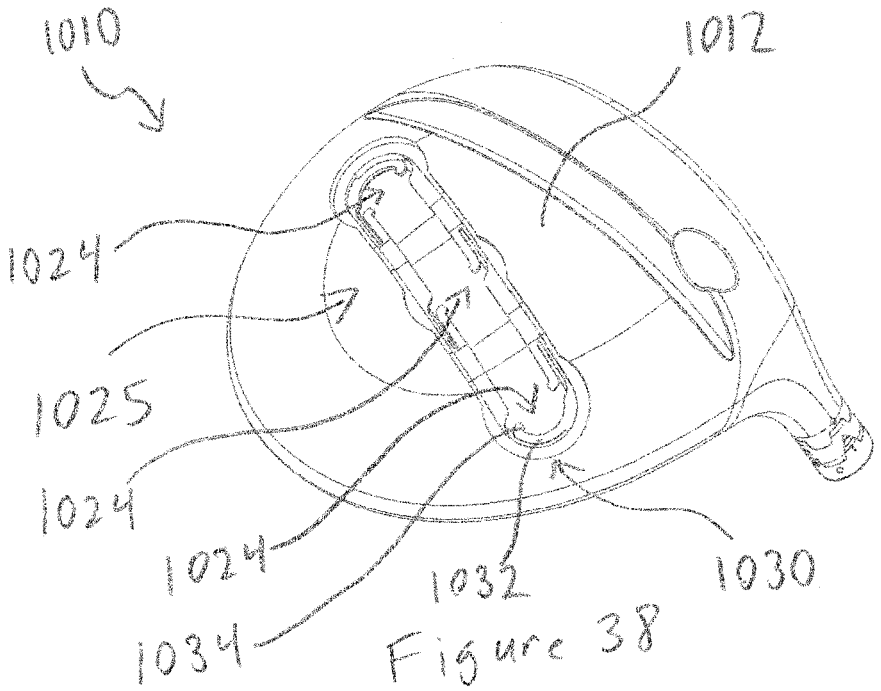
FIG. 38 illustrates a perspective view of one embodiment of a golf club head with a weight receptacle.
Figure 39:
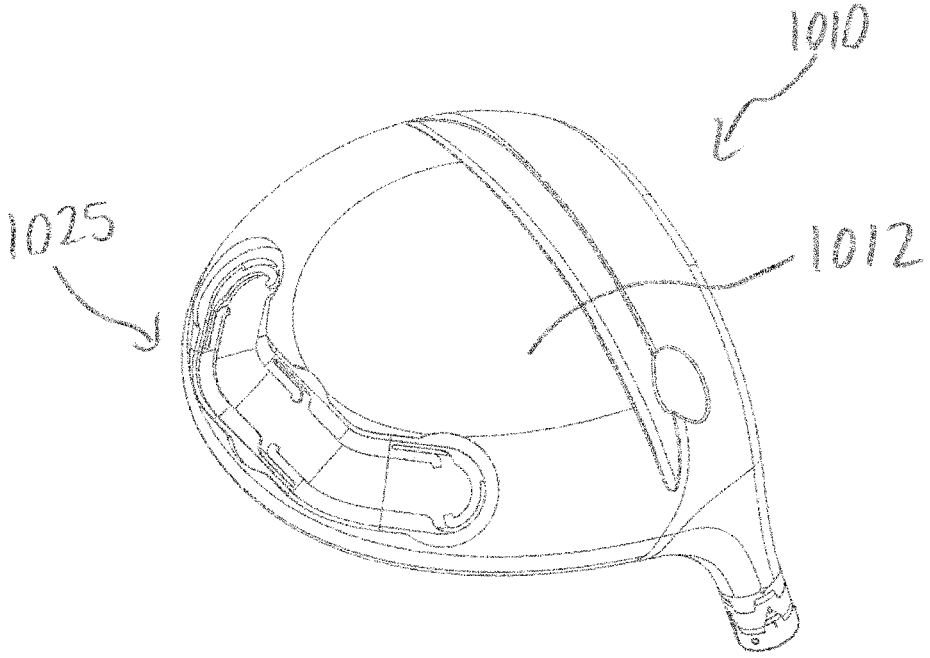
FIG. 39 illustrates a perspective view of an additional embodiment of a golf club head with a weight receptacle.

FIG. 38 illustrates a perspective view of one embodiment of a golf club head 1010 with a weight receptacle 1025. FIG. 39 illustrates a perspective view of an additional embodiment of a golf club head 1010 with a weight receptacle 1025. The golf club heads 1010 include weight receptacles 1025 configured to receive and retain a weight retainer 622 similar to the one illustrated in FIGS. 24-30. The weight receptacle 1025 is configured to selectively lock a weight retainer in one of a plurality of weight mounts 1024, depending on where the golfer would prefer the weight retainer to be located within the weight receptacle 1025. The weight receptacle 1025 is configured to enable a golfer to alter the location of the CG of the golf club head 1010 by manipulating the location of the weight retainer within the weight receptacle 1025.

Each weight receptacle 1025 includes a plurality of weight mounts 1024. Each weight mount 1024 within the weight receptacle is structured similar to the weight mount 624 illustrated in FIGS. 24-30. Each weight mount 1024 includes a locking feature 1030 configured to engage the engagement feature of the weight retainer and lock the weight retainer to the weight mount 1024. The weight receptacle 1025 is structured such that when the weight retainer is rotated into an unlocked position, it can slide along the weight receptacle to another weight mount 1024, and be subsequently locked into place. In some embodiments, as illustrated in FIGS. 38 and 39, the locking features 1030 can include a plurality of deflectable arms 1032 with protrusions 1034 configured to engage the engagement feature of the weight retainer.

Figure 40:
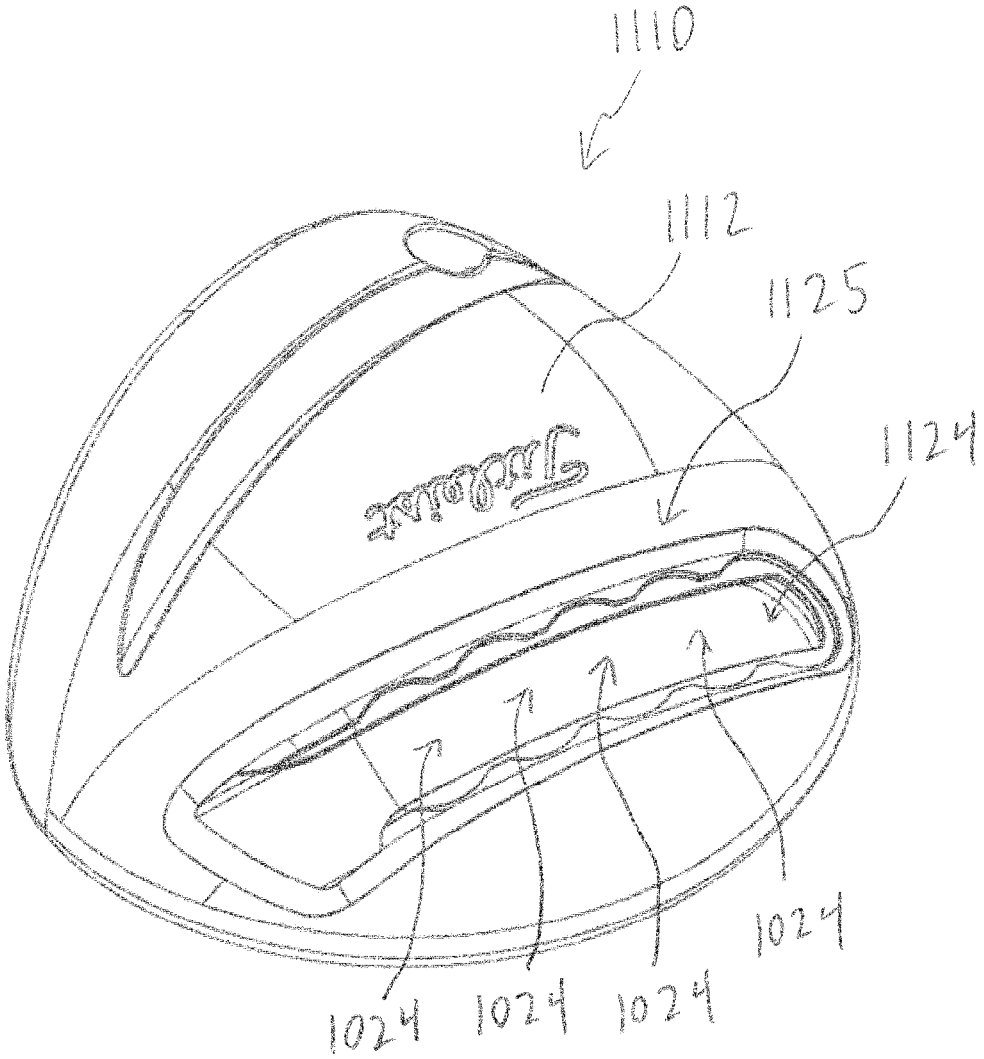
FIG. 40 illustrates an additional embodiment of a golf club head.
Figure 41:
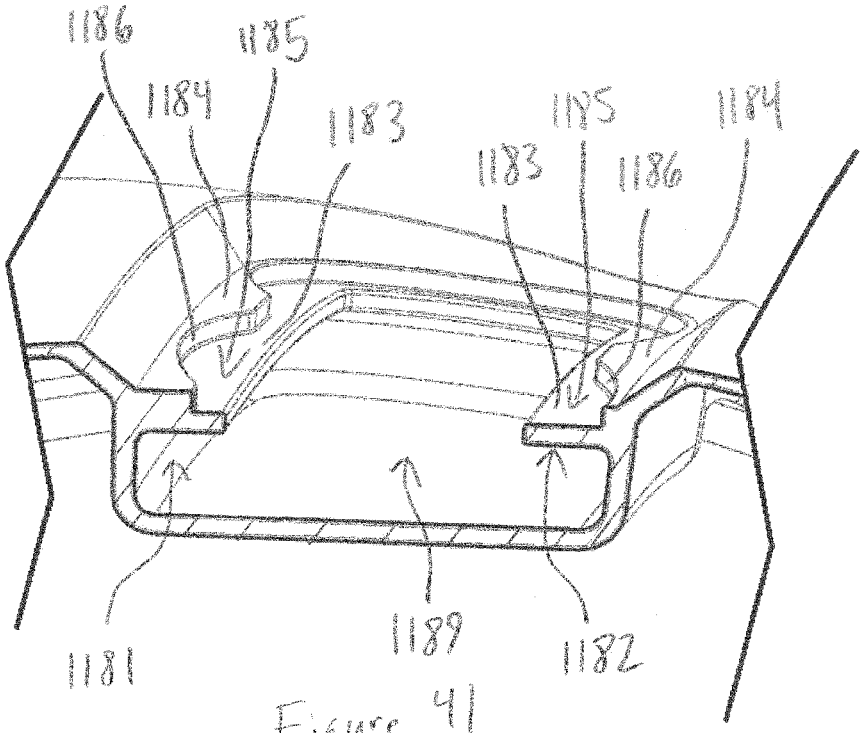
FIG. 41 illustrates a cross-sectional view of the golf club head and weight receptacle of FIG. 40.
Figure 42:
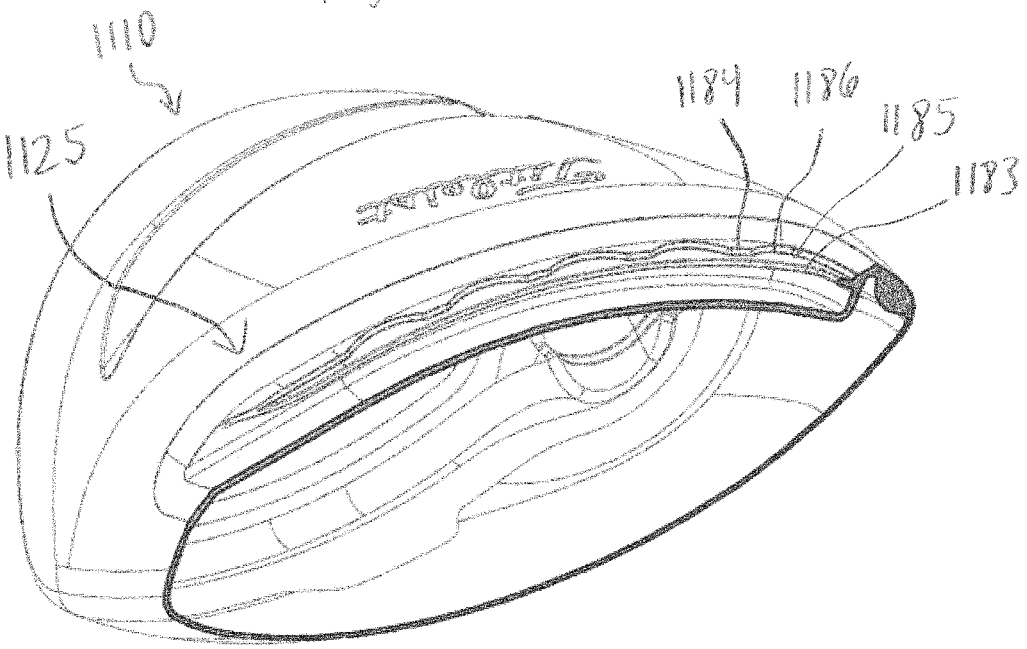
FIG. 42 illustrates an additional cross-sectional view of the golf club head and weight receptacle of FIG. 40.
Figure 43:
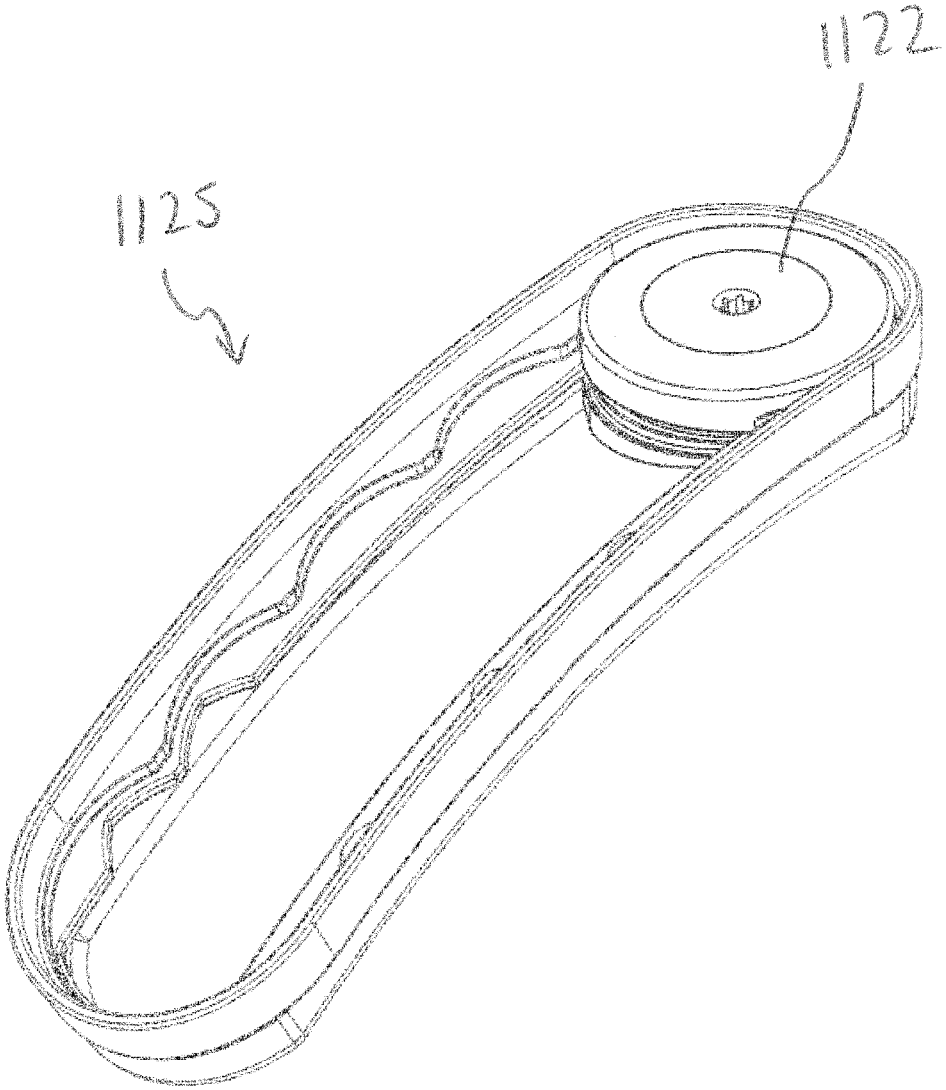
FIG. 43 illustrates one embodiment of an unlocked weight retainer in weight mount in a weight receptacle.

FIG. 40 illustrates an additional embodiment of a golf club head 1110. The golf club head 1110 includes a weight receptacle 1125. FIG. 41 illustrates a cross-sectional view of the golf club head 1110 and weight receptacle 1125 of FIG. 40. FIG. 42 illustrates an additional cross-sectional view of the golf club head 1110 and weight receptacle 1125 of FIG. 40. The weight receptacle 1125 includes a plurality of weight mounts 1125 configured to lock a weight retainer 1122 within each weight mount 1125, as illustrated in FIG. 43. The weight receptacle 1125 is configured so that the weight retainer 1122 can slide along the weight receptacle 1125 when the weight retainer 1122 is unlocked and the weight retainer 1122 can selectively lock in place in each of the weight mounts 1124. The weight receptacle 1125 includes a first locking rail 1181, on a first side of the weight receptacle 1125, which runs along the length of the weight receptacle 1125, and a second locking rail 1182, on a second side of the weight receptacle 1125, which runs along the length of the weight receptacle 1125. A channel 1189 is formed between the locking rails 1181, 1182.

The locking rails 1181, 1182 include a plurality of recesses 1185 located adjacent each weight mount 1124, configured to aid in locking the weight retainer 1122 in place in the weight receptacle 1125. The locking recesses 1185 are regions of the locking rails 1181, 1182 which have reduced thickness, creating thin portions 1183 and thick portions 1184 of the locking rails 1181, 1182. The locking recesses 1185 are configured to receive a portion of the weight retainer 1122 when the weight retainer 1122 is in a locked position. The locking recesses 1185 create a locking wall 1186 which the weight retainer 1122 abuts when locked into the weight mount 1124.

Figure 44:
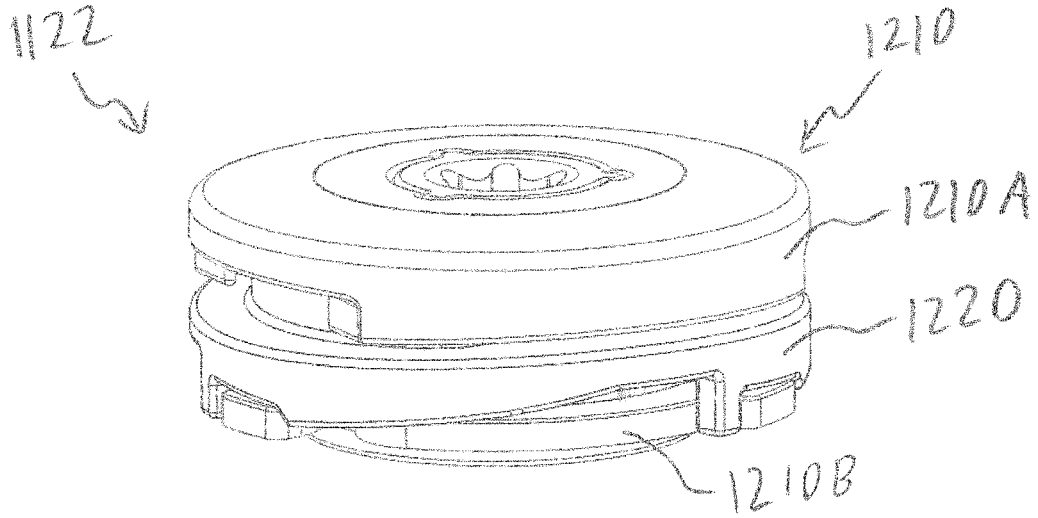
FIG. 44 illustrates a perspective view of the weight retainer of FIG. 43.
Figure 45:
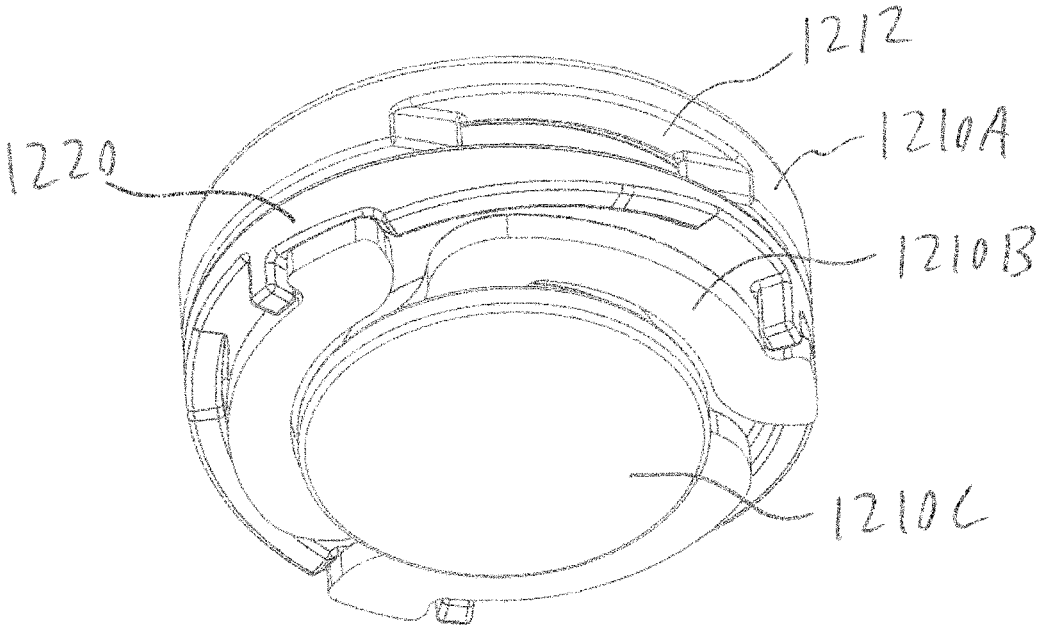
FIG. 45 illustrates an additional perspective view of the weight retainer of FIG. 43.
Figure 46:
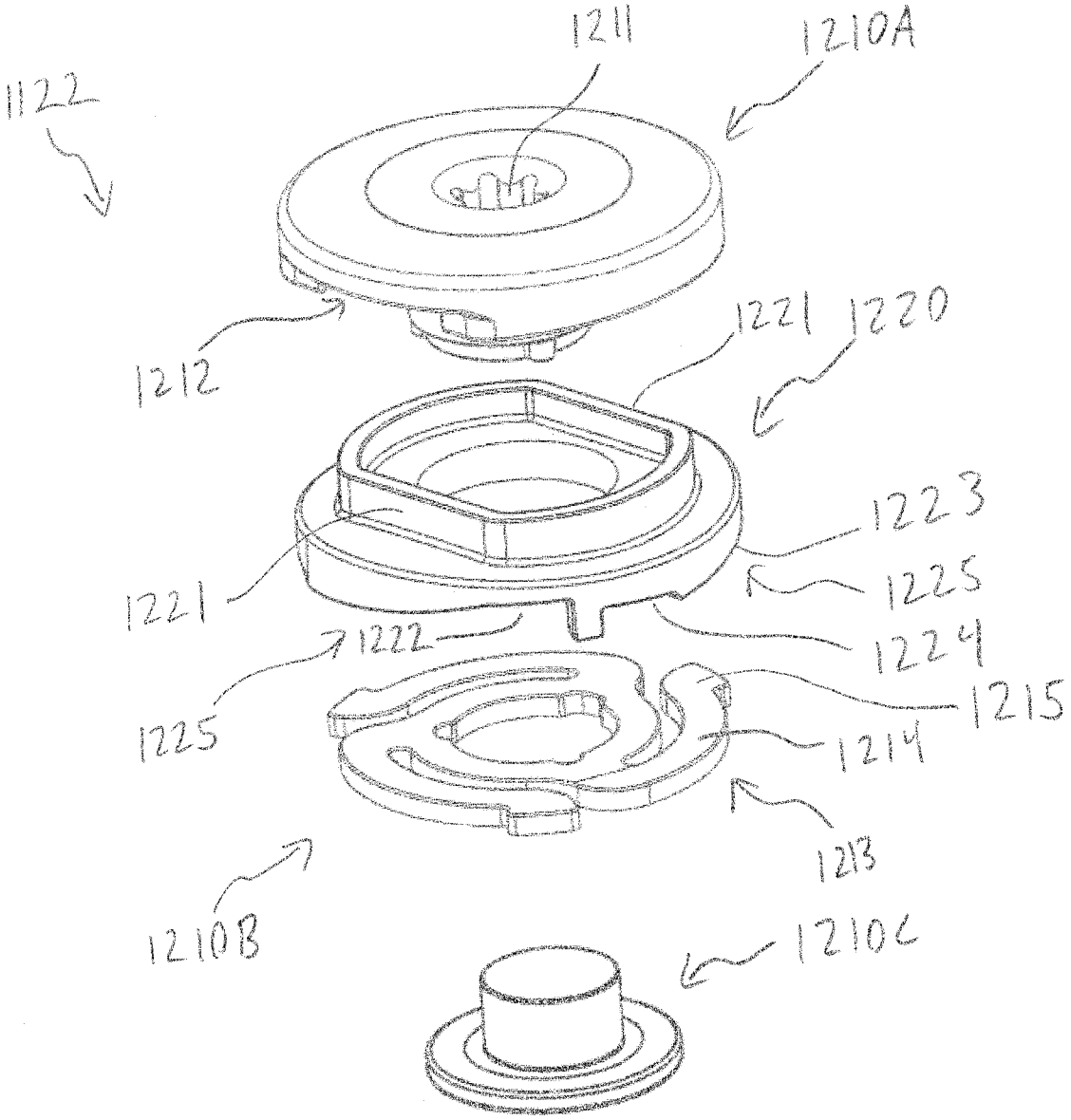
FIG. 46 illustrates an exploded view of the weight retainer of FIG. 43.
Figure 47:
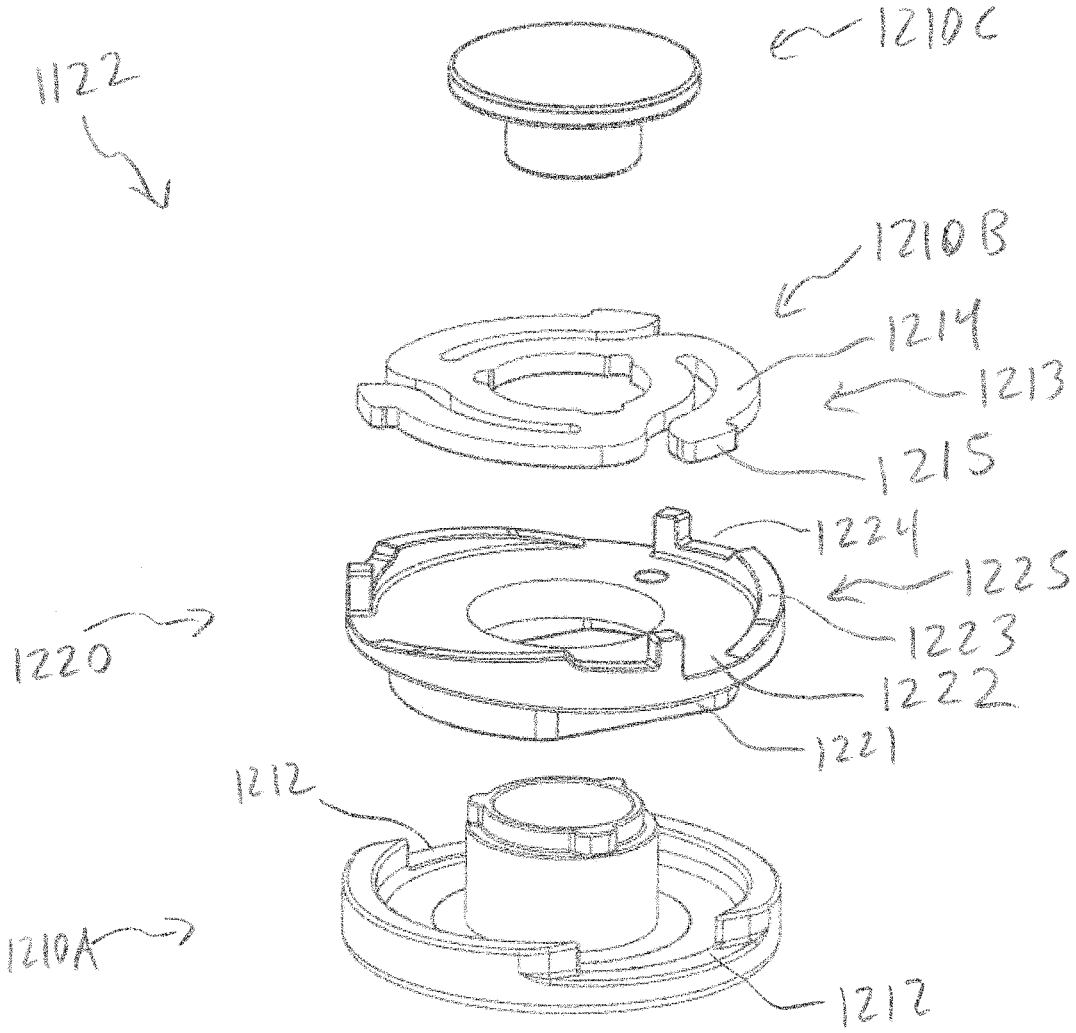
FIG. 47 illustrates an inverted exploded view of the weight retainer of FIG. 43.

FIG. 43 illustrates one embodiment of an unlocked weight retainer 1122 in weight mount 1124 in a weight receptacle 1125. For ease of illustration the weight receptacle 1125 is shown separate from a golf club head 1110. FIG. 44 illustrates a perspective view of the weight retainer 1122 of FIG. 43. FIG. 45 illustrates an additional perspective view of the weight retainer 1122 of FIG. 43. FIG. 46 illustrates an exploded view of the weight retainer 1122 of FIG. 43. FIG. 47 illustrates an inverted exploded view of the weight retainer 1122 of FIG. 43. The weight retainer 1122 includes a rotating portion 1210 and a non-rotating portion 1220. The rotating portion 1210 includes a tool engagement feature 1211 configured to receive a tool so that the user can rotate the rotating portion 1210 relative to the golf club head. The weight retainer 1122 is configured to engage the weight receptacle 1125 and lock to a weight mount 1124 when the rotating portion 1210 is rotated in a first direction relative to the non-rotating portion 1220, and unlock when the rotating portion 1210 is rotated in a second direction.

When the weight retainer 1122 is locked the rotating portion 1210 is forced towards the non-rotating portion 1220, engaging the weight receptacle 1124 and locking the weight retainer 1122 in place.

The weight receptacle 1122 is configured to at least partially reside in the cavity 1189 between the first locking racking 1181 and the second locking rail 1182. At least a portion of the non-rotating portion 1220 resides on a golf club head side of the locking rails 1181, 1182 and at least a portion of the rotating-portion 1210 resides on an exterior side of the locking rails 1181, 1182. The non-rotating portion 1220 can include a pair of slide walls 1221 configured to slide along the locking rails 1181, 1182, and prevent the non-rotating portion 1220 from rotating within the weight receptacle 1125.

The weight retainer 1122 is configured such that the rotating portion 1210 rotates 90 degrees relative to the non-rotating portion 1220 when transitioning from an unlocked position to a locked position. In other embodiments the weight retainer may require rotation between 100 degrees and 80 degrees. In another embodiment, the weight retainer may require rotation between 120 degrees and 60 degrees. In another embodiment, the weight retainer may require rotation between 140 degrees and 40 degrees. In another embodiment, the weight retainer may require rotation between 180 degrees and 10 degrees.

When the weight retainer 1122 is in a locked position the rotating portion 1210 is configured to at least partially reside in the locking recesses 1185 of the weight mount 1124, and abut the locking walls 1186 preventing the weight retainer 1122 from sliding along the weight receptacle 1125. The rotating-portion 1210 can include a pair of recessed portions 1212 configured to clear the thick portions 1185 and the locking walls 1186 of the weight receptacle when the weight retainer 1122 is in an unlocked position and sliding along the weight receptacle 1125.

The non-rotating portion 1220 includes at least one engagement feature 1225 configured to interact with the rotating portion 1210 to force the rotating portion 1210 towards the non-rotating portion 1220 when the rotating portion 1210 is rotated in a first direction. The engagement feature 1225 can include a ramp as illustrated in FIGS. 44-47. The engagement feature 1225 can include an unlocked relief 1222, a transition ramp 1223, and a locking detent 1224.

The rotating portion 1210 can be formed integrally or can include a plurality of pieces joined together to form the rotating portion 1210. As illustrated in FIGS. 46 and 47, the rotating portion 1210 can include a first member 1210A, a second member 1210B, and a third member 1210C. The rotating portion 1210 can include at least one locking feature 1213 configured to engage the engagement feature 1225 of the non-rotating portion 1220 and lock the weight retainer 1122 to the weight mount 1124. The locking feature 1213 includes a deflectable arm 1214 which can include a protrusion 1215.

The locking feature 1213 is configured to engage the unlocked relief 1222 when the weight retainer 1122 is in an unlocked position. The locking feature 1213 is configured to slide up the transition ramp 1223 as the rotating portion 1210 is rotated in a first direction relative to said non-rotating portion 1220 until the deflectable arm 1214 locks into the locking detent 1222 of the engagement feature 1225. As the deflectable arm 1214 slides up the transition ramp 1223 it is deflected so as to force the rotating portion 1210 towards the non-rotating portion 1220. Once the deflectable arm 1214 is located in the locking detent 1224, the rotating portion 1210 and the non-rotating portion 1220 clamp against the locking rails 1181, 1182, and the rotating portion 1210 is lodged in the locking recess 1185 of the weight mount 1124 until the user rotates the rotating portion 1210 in a second direction, releasing the deflectable arm 1214 from the locking detent 1224 and allowing the weight retainer 1122 to slide along the weight receptacle to the preferred weight mount 1124.

Figure 48:
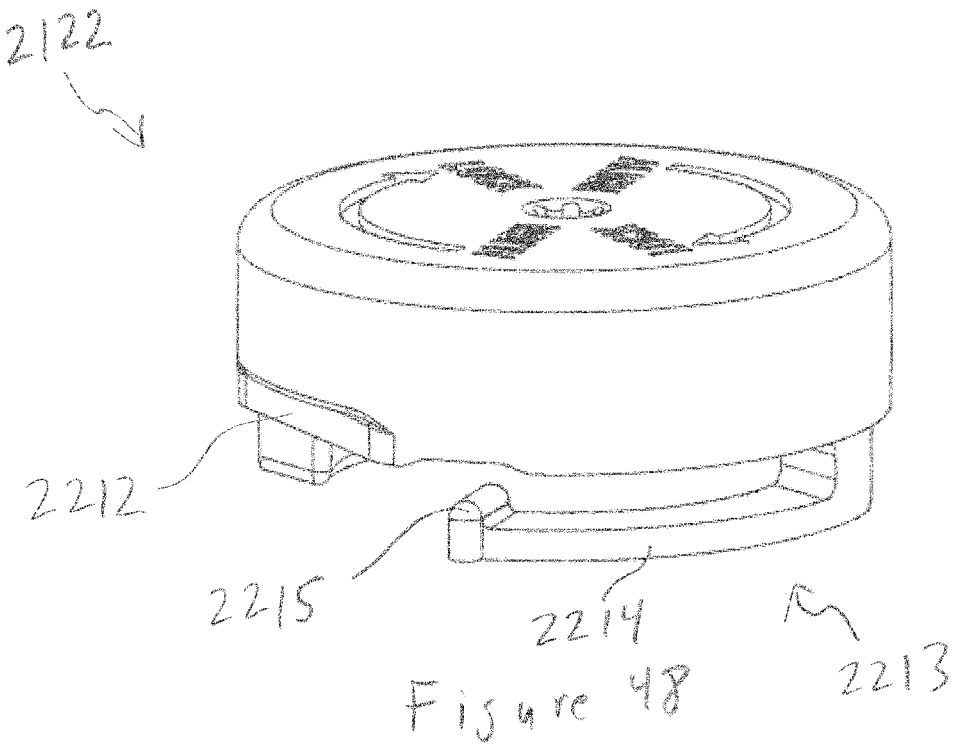
FIG. 48 illustrates a perspective view of an additional embodiment of a weight retainer.
Figure 49:
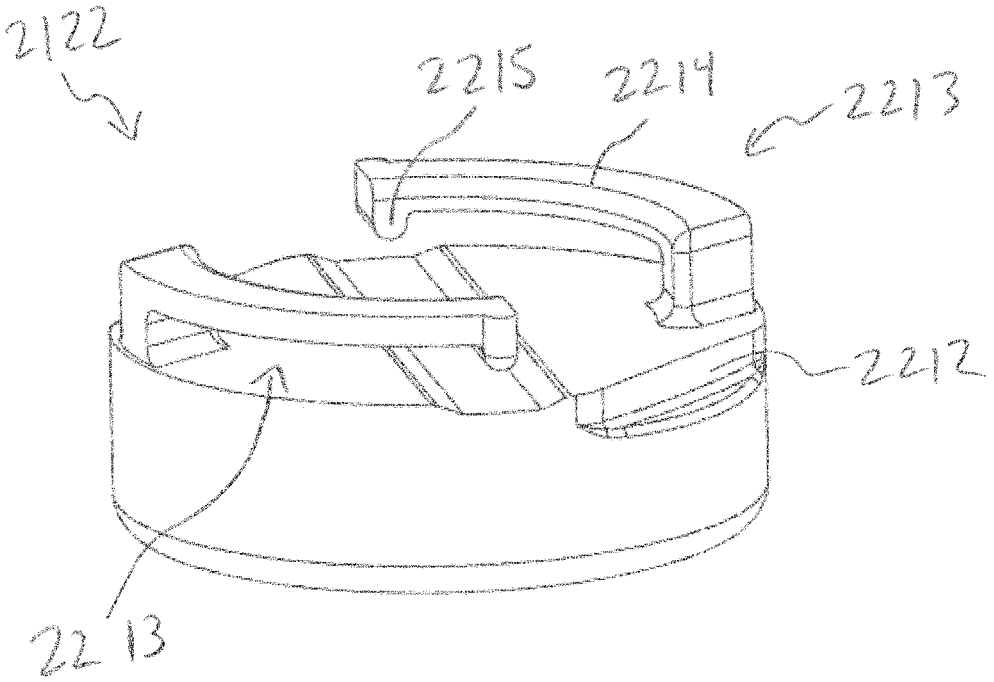
FIG. 49 illustrates a perspective view of the underside of the weight retainer of FIG. 48.
Figure 50:
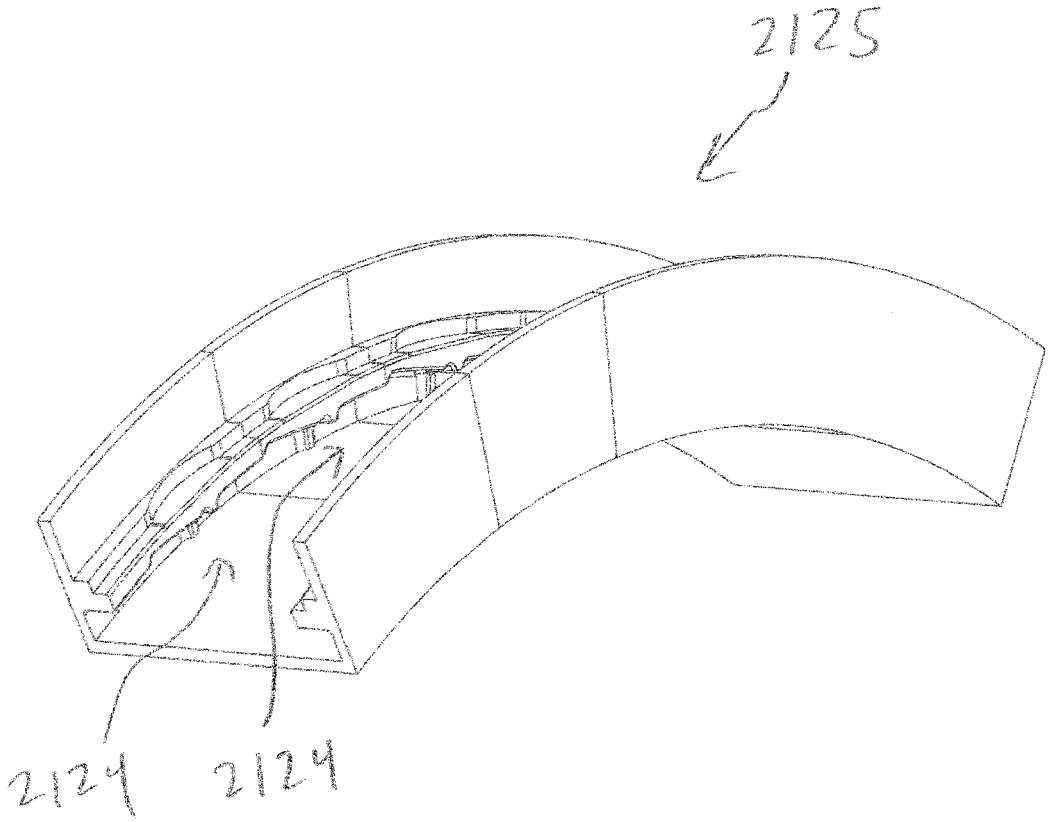
FIG. 50 illustrates a perspective view of an additional embodiment of a weight receptacle.
Figure 51:
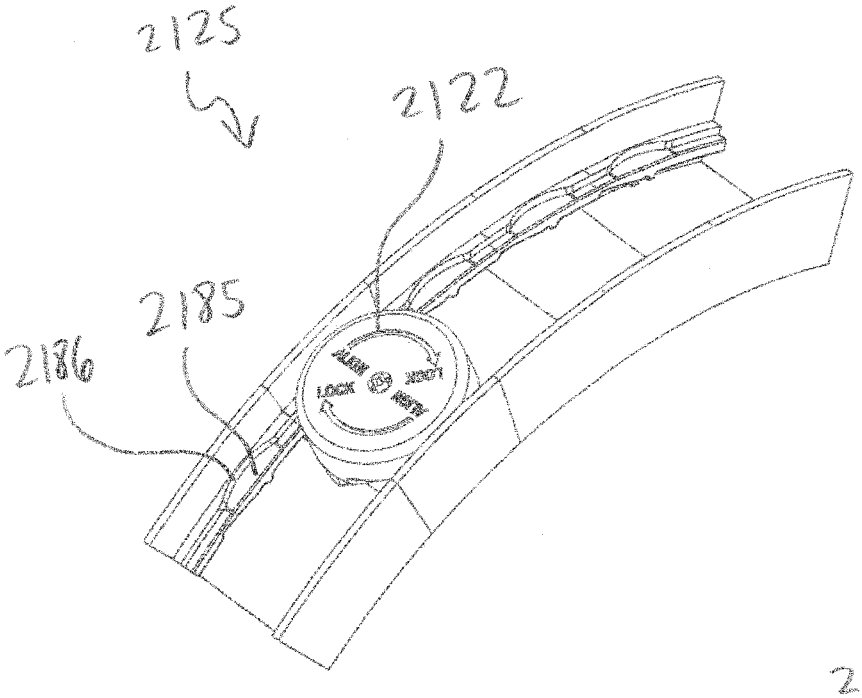
FIG. 51 illustrates a perspective view of the weight retainer of FIG. 48 locked in the weight receptacle of FIG. 50.
Figure 52:
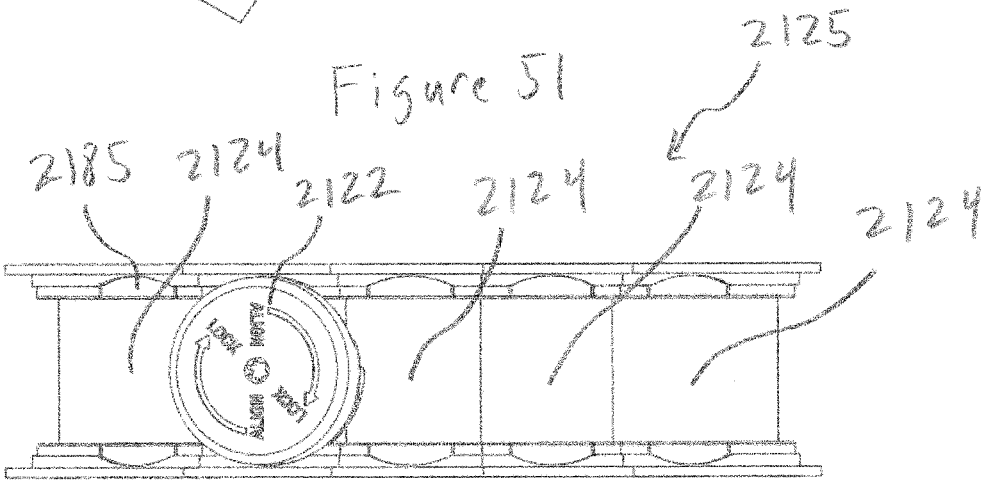
FIG. 52 illustrates a top view of the weight retainer and weight receptacle of FIG. 51.
Figure 53:
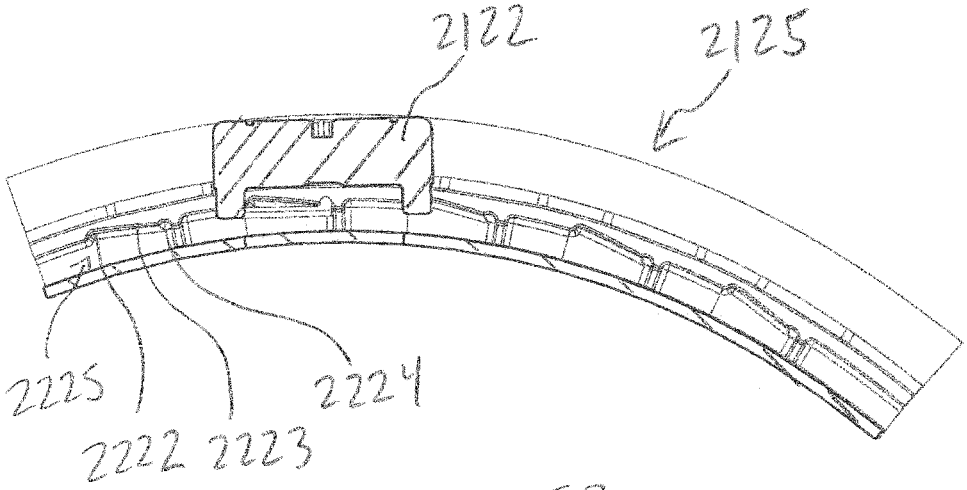
FIG. 53 illustrates a cross-sectional view of the weight retainer and weight receptacle of FIG. 51.
Figure 54:
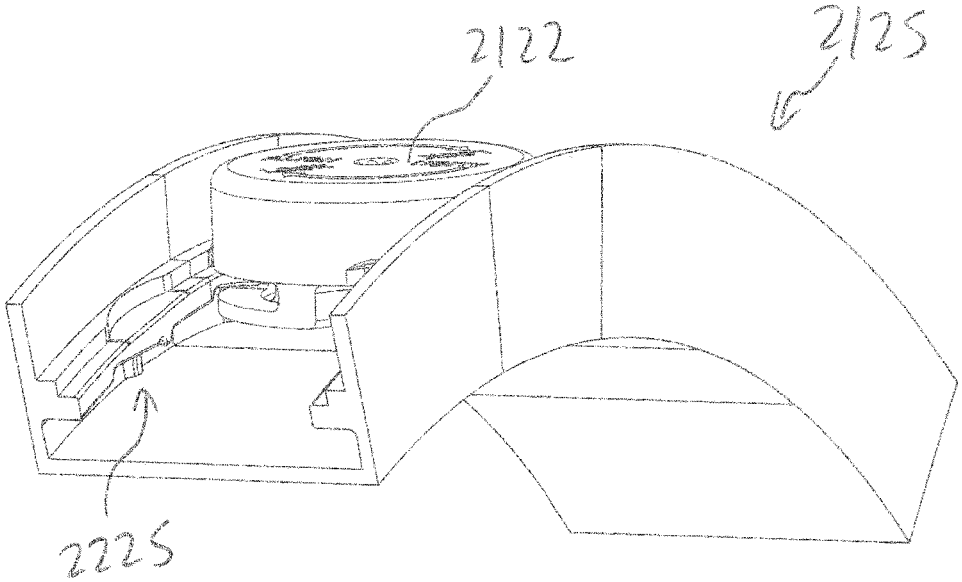
FIG. 54 illustrates an additional perspective view of the weight retainer and weight receptacle of FIG. 51.

FIG. 48 illustrates a perspective view of an additional embodiment of a weight retainer 2122. FIG. 49 illustrates a perspective view of the underside of the weight retainer 2122 of FIG. 48. FIG. 50 illustrates a perspective view of an additional embodiment of a weight receptacle 2125. FIG. 51 illustrates a perspective view of the weight retainer of FIG. 48 locked in the weight receptacle of FIG. 50. FIG. 52 illustrates a top view of the weight retainer and weight receptacle of FIG. 51. FIG. 53 illustrates a cross-sectional view of the weight retainer and weight receptacle of FIG. 51. FIG. 54 illustrates an additional perspective view of the weight retainer and weight receptacle of FIG. 51.

The weight retainer 2122 includes a locking feature 2213 including a deflectable arm 2214 which includes a protrusion 2215. The locking feature 2213 is configured to engage the engagement feature 2225 of the weight mount 2124 of the weight receptacle 2125 illustrated in FIGS. 50-54. The engagement feature 2225 can include an unlocked relief 2222, a transition ramp 2223 and a locking detent 2224. As the weight retainer 2122 is rotated relative to the weight receptacle 2125, the locking feature 2122 is configured to enter the unlocked relief 2222, ride up the transition ramp 2223, and into the locking detent 2224. This action will force the weight retainer 2122 towards the golf club head and lock the weight retainer 2122 in the weight mount 2124 of the weight receptacle 2125. Additionally, the locking wall 2186 of the locking recess 2185 of the weight mount 2124 will prevent the weight retainer 2122 from sliding along the weight receptacle 2125.

Figure 55:
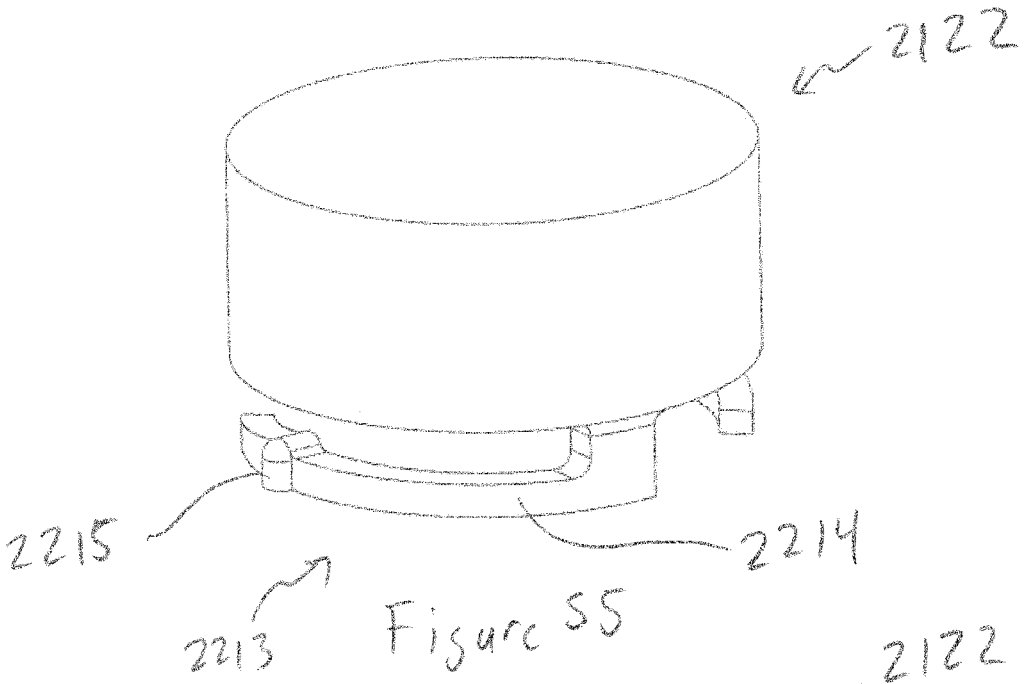
FIG. 55 illustrates a perspective view of an additional embodiment of a weight retainer 2122.
Figure 56:
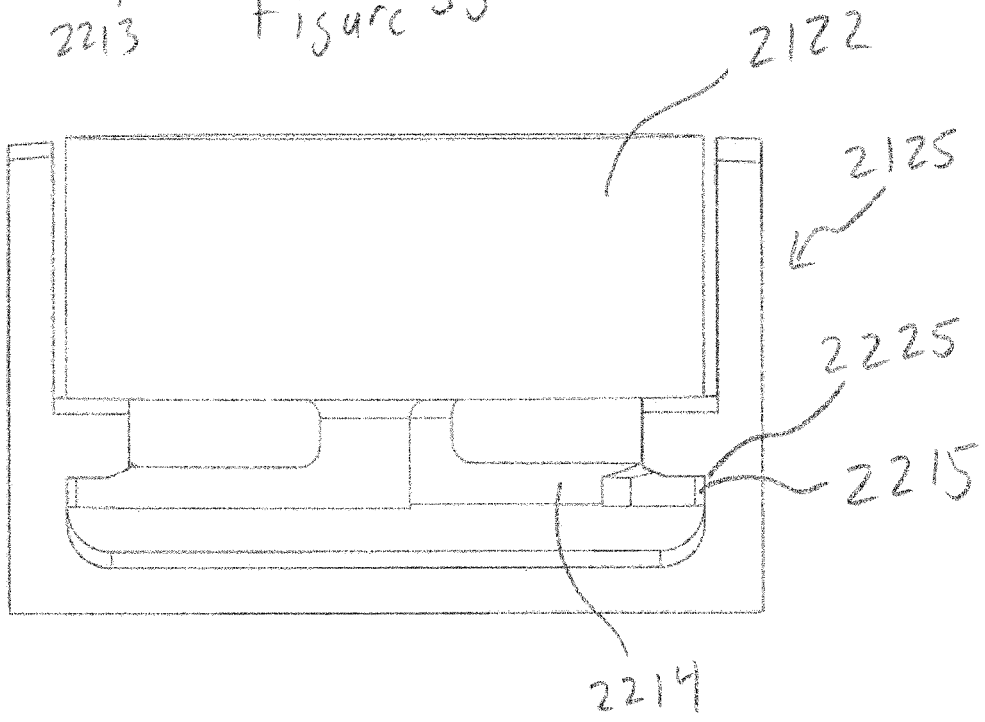
FIG. 56 illustrates an end view of the weigh retainer locked in an additional embodiment of a weight receptacle.

FIG. 55 illustrates a perspective view of an additional embodiment of a weight retainer 2122. FIG. 56 illustrates an end view of the weigh retainer 2122 locked in an additional embodiment of a weight receptacle 2125. This embodiment is similar to those illustrated in FIGS. 48-64, however the weight retainer includes protrusions 2215 extending outwards rather than upwards, configured to engage detents 2224 located in the sides of the weight receptacle 2125. Rather than deflecting in a direction parallel to the rotation axis of the weight retainer 2122, as in embodiments described earlier, the deflectable arms 2214 are configured to deflect in a direction perpendicular to the rotation axis of the weight retainer 2122.

Figure 57:
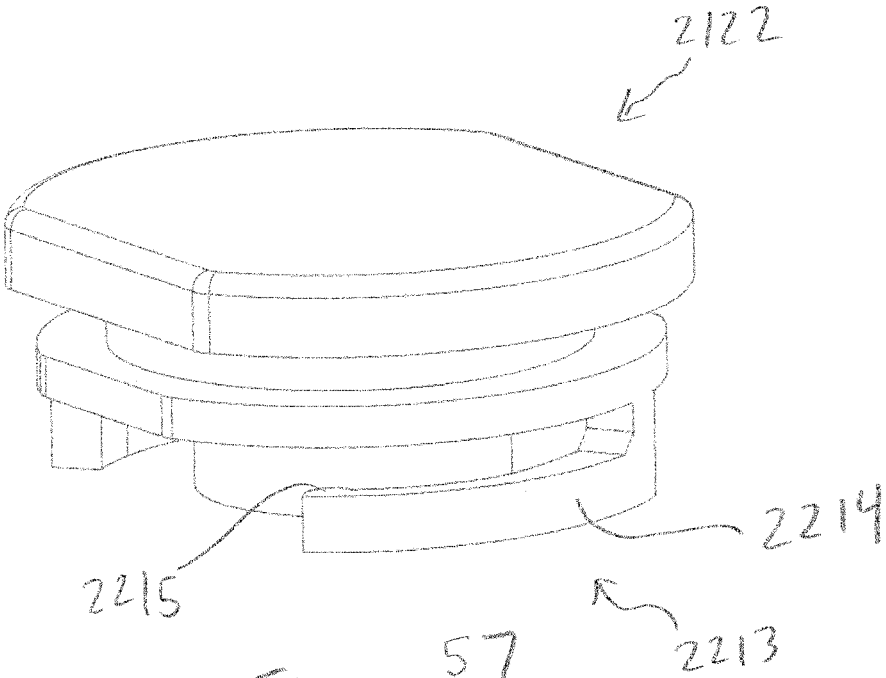
FIG. 57 illustrates a perspective view of an additional embodiment of a weight retainer.
Figure 58:
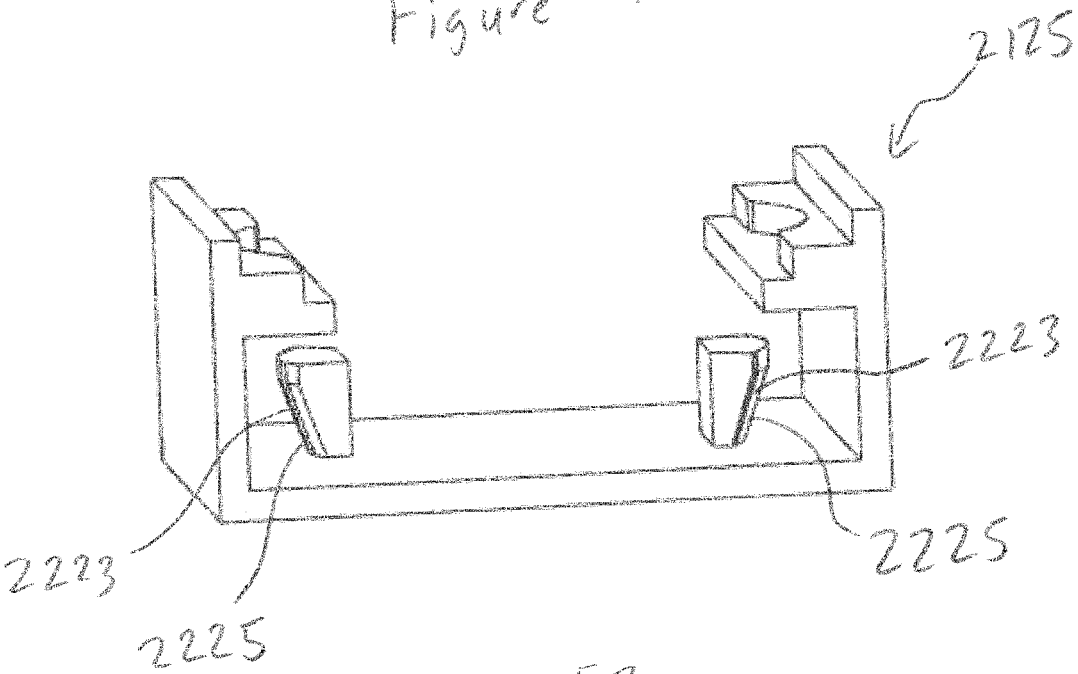
FIG. 58 illustrates a perspective view of a portion of an additional embodiment of a weight receptacle.
Figure 59:
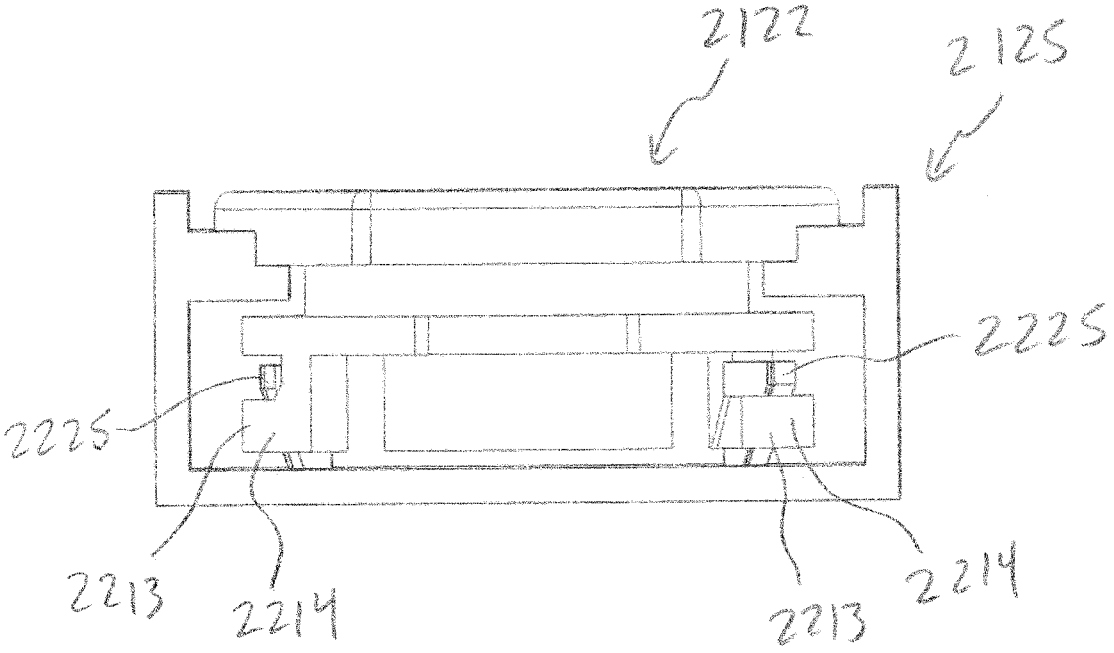
FIG. 59 illustrates an end view of the weight retainer of FIG. 57 locked in the weight receptacle of FIG. 58.

FIG. 57 illustrates a perspective view of an additional embodiment of a weight retainer 2122. FIG. 58 illustrates a perspective view of a portion of an additional embodiment of a weight receptacle 2125. FIG. 59 illustrates an end view of the weight retainer 2122 of FIG. 57 locked in the weight receptacle 2125 of FIG. 58. This embodiment is similar to those illustrated in FIGS. 55 and 56, however rather than having protrusions 2215 extending outwards from the deflectable arm 2214, they extend inwards towards the rotation axis. Additionally, the weight receptacle 2215 includes engagement features 2225 separate from the locking rails and side walls of the weight receptacle 2215. The weight receptacles include ramps 2223 that are also inclined relative to the rotation axis of the weight retainer 2122 such that the weight retainer deflectable arms 2214 bend towards the club head and away from the rotation axis of the weight retainer 2122 as the weight retainer 2122 is rotated in a first direction to lock the weight retainer 2122 in place. The incline can help lock the weight retainer 2122 in place. Also, the protrusions 2215 lock the weight retainer 2122 in from rotation once they extend past the end of the engagement feature 2225.

Figure 60:
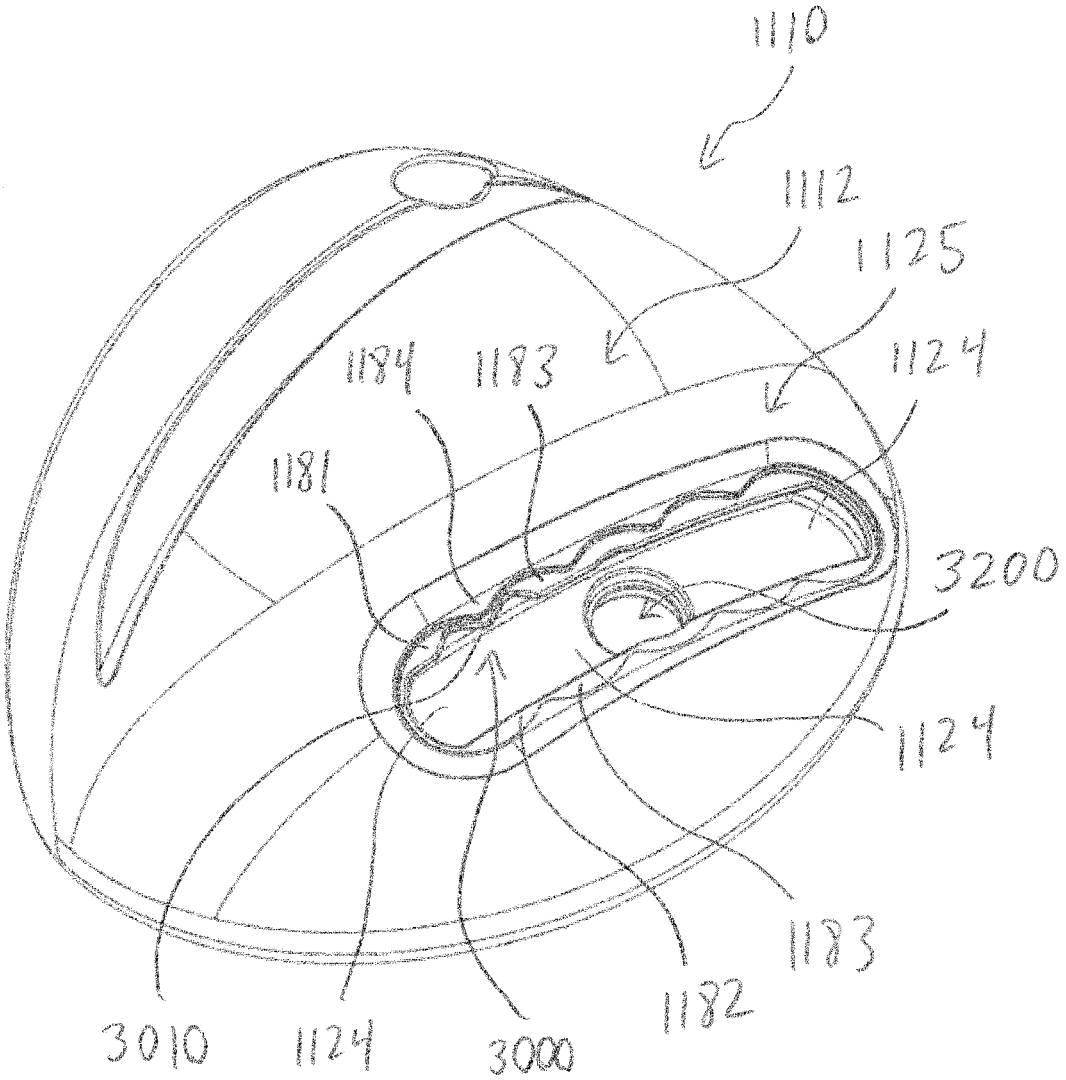
FIG. 60 illustrates a perspective view of an additional embodiment of a golf club head.
Figure 61:
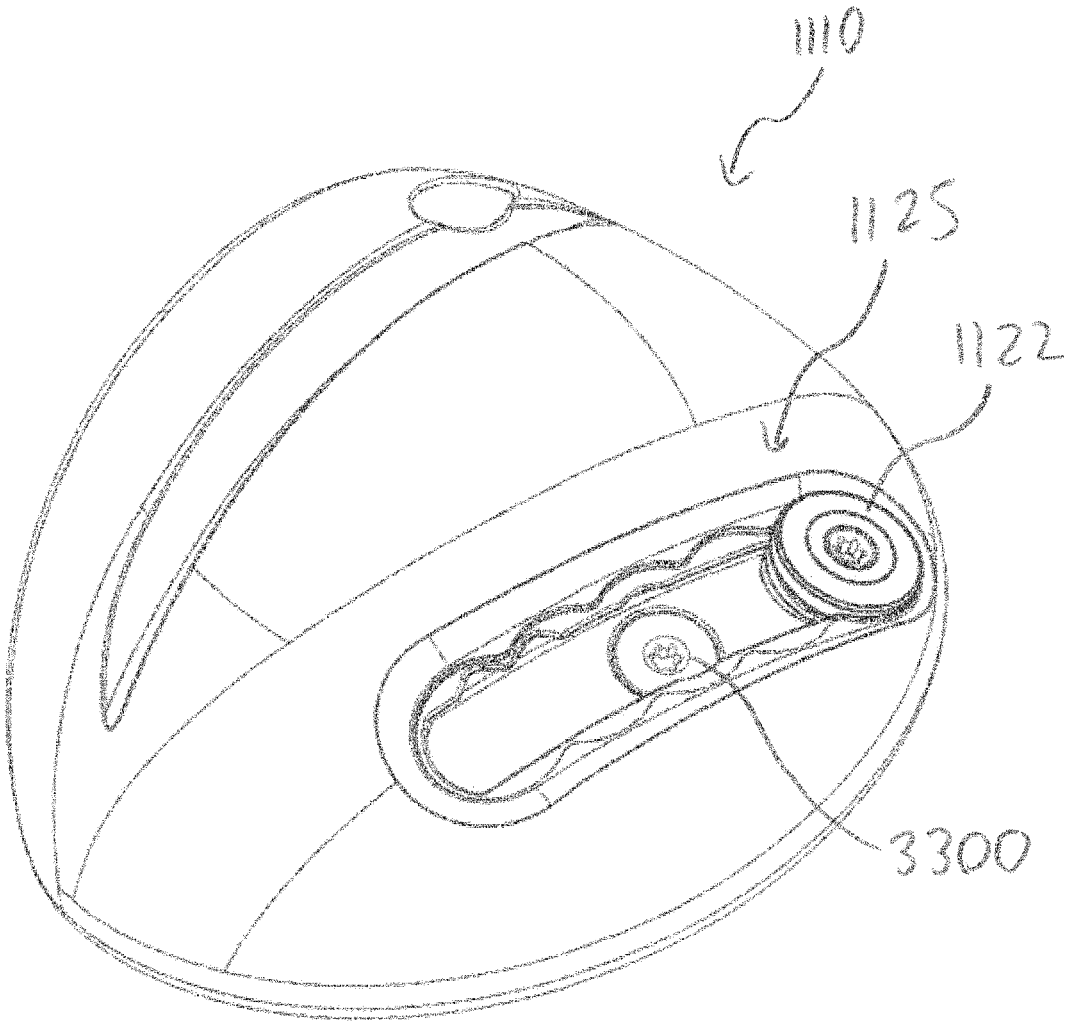
FIG. 61 illustrates the golf club head 1110 of FIG. 60 including a weight retainer and a weight member.
Figure 62:
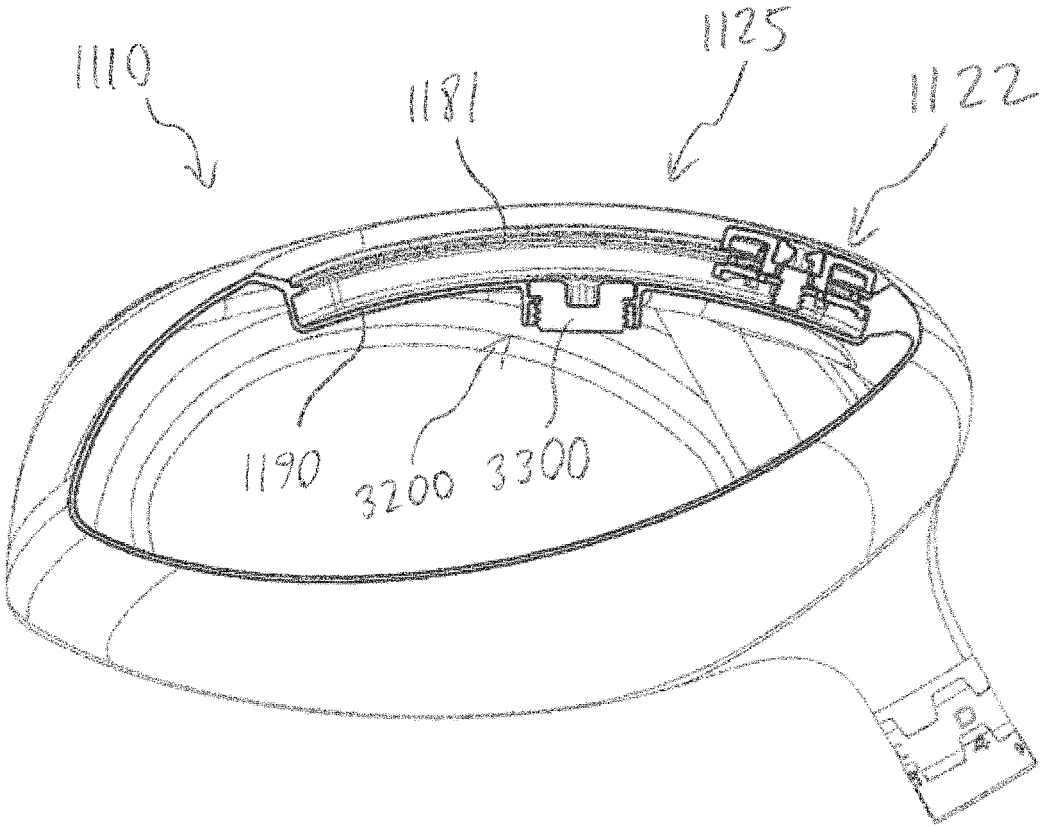
FIG. 62 illustrates a cross-sectional view of the golf club head of FIG. 61.
Figure 63:
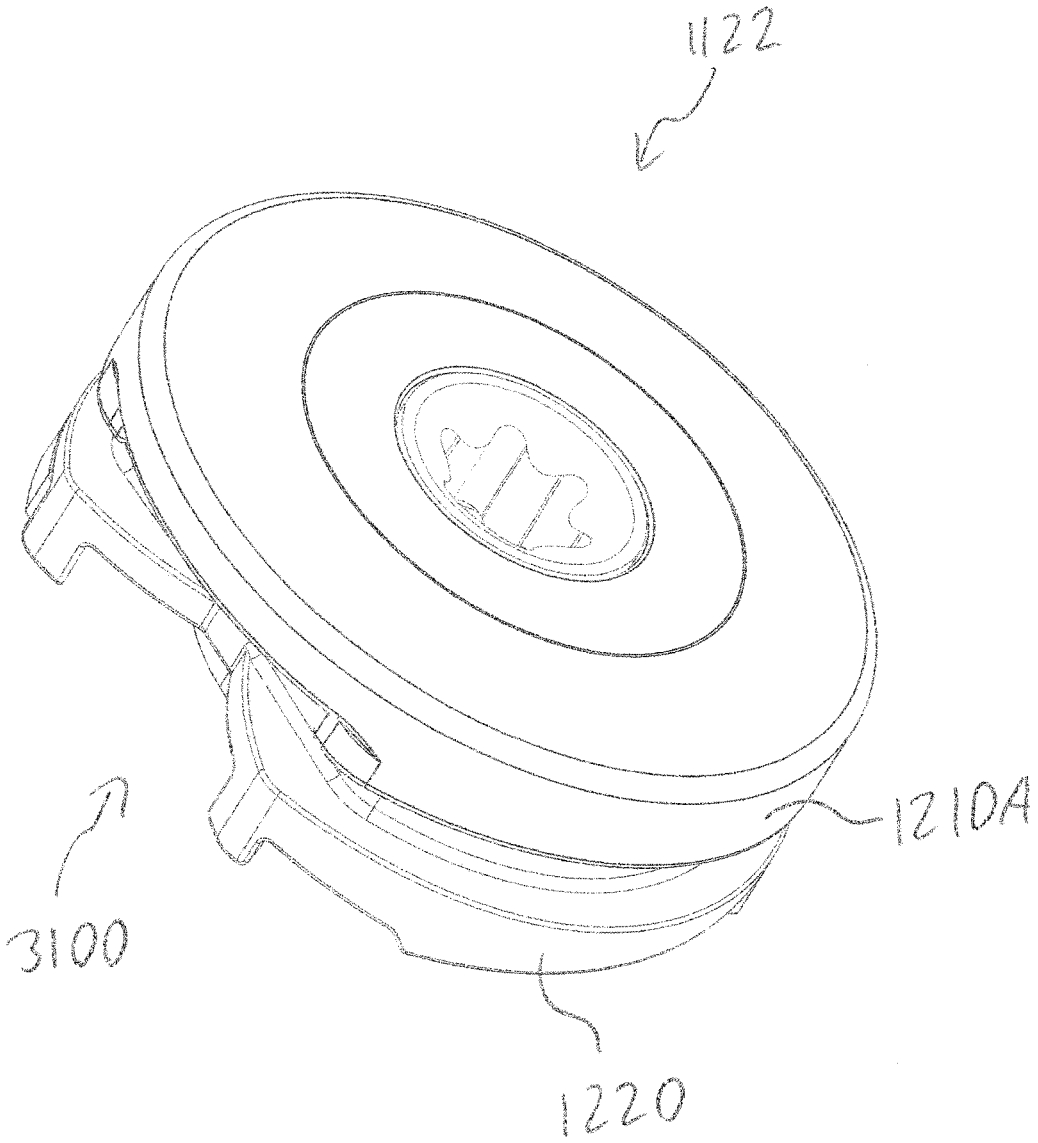
FIG. 63 illustrates a perspective view of the weight retainer of FIG. 61.
Figure 64:
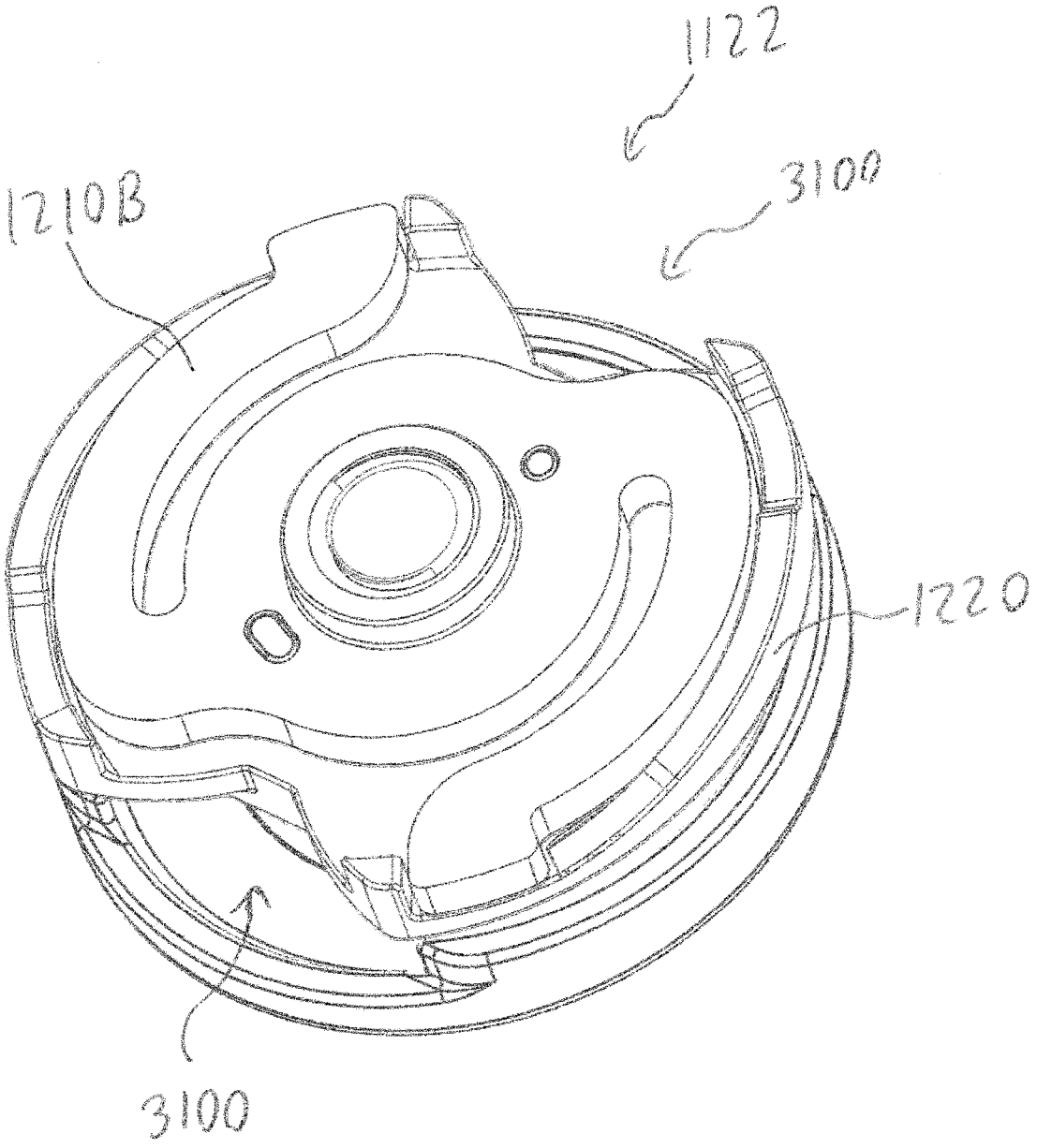
FIG. 64 illustrates an additional perspective view of the weight retainer of FIG. 61.
Figure 65:
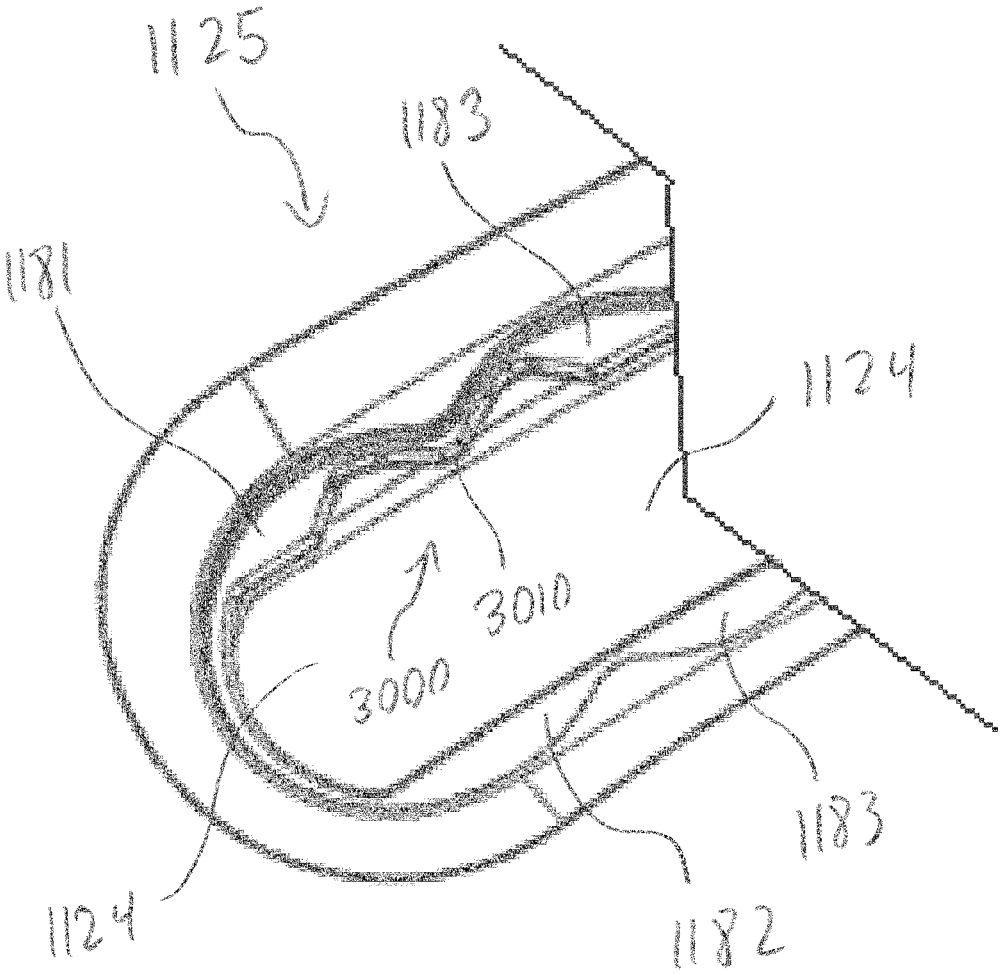
FIG. 65 illustrates a detail view of a portion of the weight receptacle of the golf club head of FIG. 60.
Figure 66:
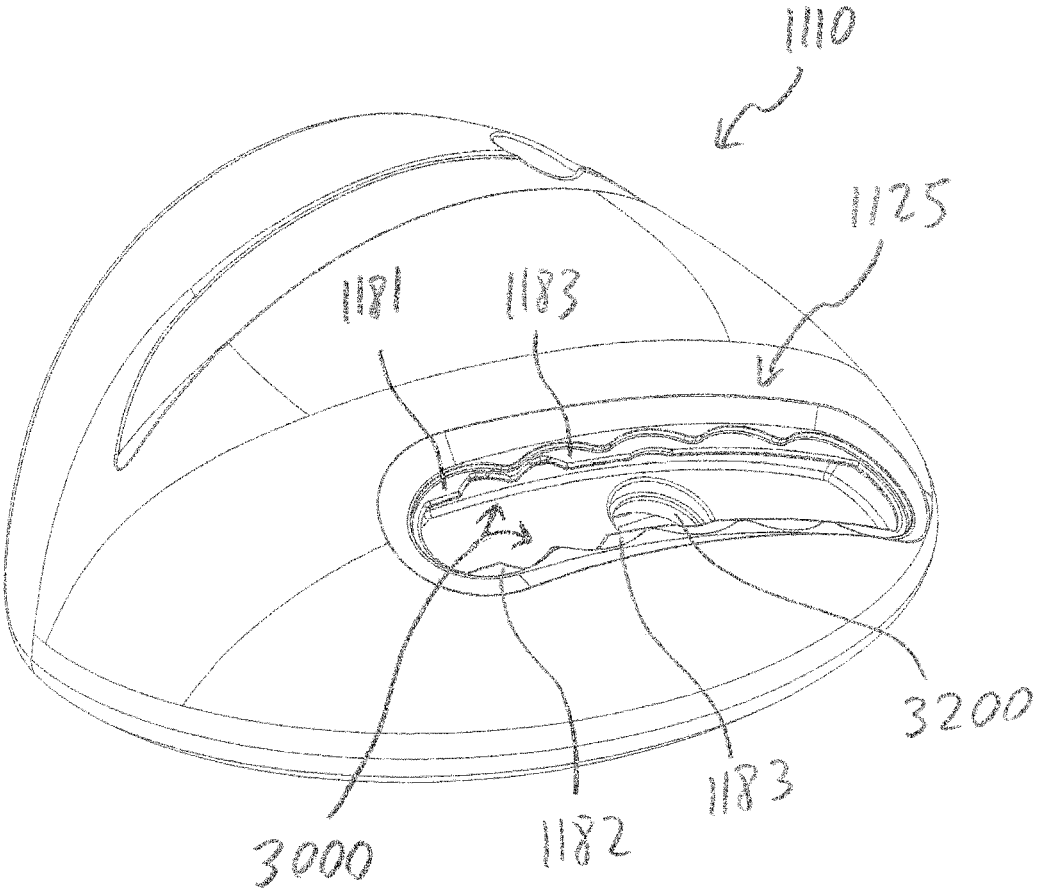
FIG. 66 illustrates a perspective view of an additional embodiment of a golf club head.
Figure 67:
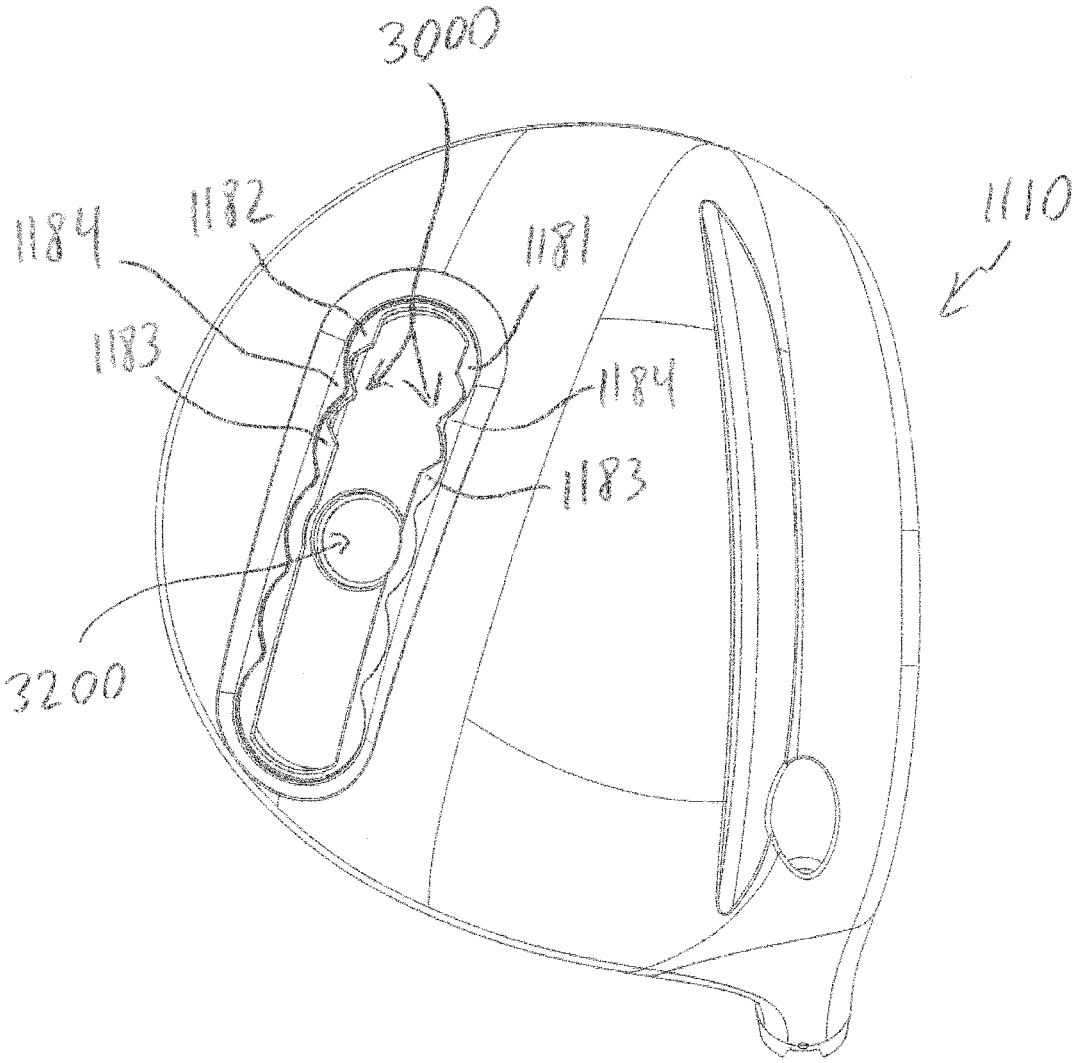
FIG. 67 illustrates a bottom view of the golf club head of FIG. 66.

FIG. 60 illustrates a perspective view of an additional embodiment of a golf club head 1110. FIG. 61 illustrates the golf club head 1110 of FIG. 60 including a weight retainer 1122 and a weight member 3300. FIG. 62 illustrates a cross-sectional view of the golf club head 1110 of FIG. 61. FIG. 63 illustrates a perspective view of the weight retainer 1122 of FIG. 61. FIG. 64 illustrates an additional perspective view of the weight retainer 1122 of FIG. 61. FIG. 65 illustrates a detail view of a portion of the weight receptacle 1125 of the golf club head 1110 of FIG. 60. FIG. 66 illustrates a perspective view of an additional embodiment of a golf club head 1110. FIG. 67 illustrates a bottom view of the golf club head 1110 of FIG. 66.

The weight receptacles 1125 of FIGS. 60-62 and 65-67 are very similar to the weight receptacle 1125 of FIGS. 40-43 discussed earlier, with a few key differences. In an effort to increase the stiffness of the sole 1112 of the golf club head, rather than having an open end to install the weight retainer 1122, like the weight receptacles 1125 of FIGS. 40-43, the weight receptacles 1125 of FIGS. 60-62 and 65-67 do not include an open end, and instead include a weight receptacle installation feature 3000 configured to allow for the installation of the weight retainer 1122. By closing both ends of the weight receptacle 1125, the stiffness of the weight receptacle 1125, and thus the sole 1112 of the golf club head 1110 is increased, which can improve several golf club head characteristics which may include, for example, coefficient of restitution, acoustic properties, etc.

The weight receptacle 1125 of FIGS. 66 and 67 include a weight receptacle installation feature 3000. The weight receptacle installation feature 3000 includes recesses formed in both the first locking rail 1181 and the second locking rail 1182. The recesses are preferably formed in the thin portions 1183 of the locking rails. Rather than installing the weight retainer 1122 into the weight receptacle 1125 in a direction substantially parallel to the direction the weight retainer 1122 travels through the weight receptacle 1125 during C.G. adjustment as in FIGS. 40-42, the weight retainer 1122 is installed into the weight receptacle 1125 of FIGS. 66-67 in a direction substantially perpendicular to the direction the weight retainer 1122 travels through the weight receptacle 1125 during C.G. adjustment. The recesses of the weight receptacle installation feature 3000 allow the weight retainer 1122 to slide into the weight receptacle and then slide along the weight receptacle 1125 until it rests in the appropriate weight mount 1124 and locks into place.

The weight receptacle 1125 of FIGS. 60-62 and 65 also includes a weight receptacle installation feature 3000. The weight receptacle installation feature 3000 includes recesses formed in only the first locking rail 1181, not in both rails like in FIGS. 66 and 67. This embodiment makes the installation of the weight retainer 1122 a bit trickier, but also reduces the chance of the weight retainer 1122 from unintentionally leaving the weight receptacle 1125. Rather than simply lowering the weight retainer 1122 into the weight receptacle 1125 through the weight receptacle installation feature 3000 as in FIGS. 66 and 67, the weight receptacle installation feature 3000 of FIGS. 60-62 and 65 requires the weight retainer to be tilted and slid under the second rail 1182 while a portion of the weight retainer 1122 is still above the first locking rail 1181, and then the portion of the weight retainer 1122 above the first locking rail 1181 is forced towards the golf club head 1110 and through the recess of the weight receptacle installation feature 3000. In order to remove the weight retainer 1122 the process is reversed. As illustrated in FIGS. 60 and 61, the weight receptacle installation feature 3000 is located between two weight mounts 1124 in order to minimize the chance of the weight retainer 1122 from unintentionally leaving the weight receptacle 1125. The only way to remove the weight retainer 1122 is to position the weight retainer 1122 adjacent the weight receptacle installation feature 3000 which is located between two weight mounts 1124 and pull it out in a direction substantially perpendicular to the direction the weight retainer 1122 travels through the weight receptacle 1125 during C.G. adjustment.

The weight retainer 1122 of FIGS. 63 and 64 is very similar to the weight retainer 1122 of FIGS. 43-47 discuss earlier, with a few key differences. As described earlier, the weight receptacle installation feature 3000 is located between two weight mounts 1124. Subsequently, a portion of the thick portion 1184 of the locking rail 1181, 1182 can necessitate the recess of the weight receptacle installation feature 3000 to include a central protrusion 3010. Thus the weight retainer 1122 can include one or more weight retainer installation features 3100, which can be recesses as illustrated in FIGS. 63 and 64. The weight retainer installation features 3100 are located and dimensioned to clear the central protrusions 3010 of the weight receptacle installation features 3000. The weight retainer installation features 3100 can be formed in the non-rotating portion 1220 of the weight retainer.

An additional feature included in the weight receptacle 1125 of the golf club head 1110 of FIGS. 60-62, 66, and 67 is the weight port 3200. The weight port 3200 is configured to receive and engage a weight member 3300 as illustrated in FIGS. 61 and 62. The weight port 3200, as illustrated in FIGS. 60-62 can be located in the weight receptacle 1125. More specifically, the weight port 3200 can be formed in the floor 1190 of the weight receptacle 1125 below the channel. The weight port 3200 allows for the installation of different weight members 3300 depending on the preferred overall golf club head 1100 mass and swing weight for the golf club. By having the weight port 3200 in addition to the weight receptacle 1125 and weight retainer 1122, the mass of the golf club head 1110 can be adjusted without swapping the weight retainer 1122. This allows the mass of the weight retainer 1122 to remain consistent, and thus keeping the C.G. adjustments consistent. If you were to change the mass of the weight retainer 1122, movements of the weight retainer 1122 along the weight receptacle 1125 would have different effects on the C.G. location of the golf club head. As illustrated in FIG. 62, the weight port 3200 can include female threads configured to engage the weight member 3300. The weight member 3300 can include male threads to engage the weight port 3200 and lock the weight member 3300 in place. In other embodiments, other methods of locking the weight member 3300 in place can be used, including, but not limited to, the locking mechanisms described herein.

In an alternative embodiment, not illustrated, a portion of the weight receptacle can be interchangeable. There could be several versions of that portion of the weight receptacle, each having a different mass. By swapping out the portions of the weight receptacle, the mass of the golf club head could be adjusted. This portion of the weight receptacle could also capture the weight retainer, locking the weight retainer in the weight receptacle so that it cannot be removed without removing the portion of the weight receptacle. The portion of the weight receptacle can be affixed to the golf club head in a variety of ways which may include, for example, quarter-turn fasteners, threads, clips, in addition to any of the locking mechanisms described herein.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

The invention claimed is:

1. A golf club head, comprising:

a body having a face, a sole, a crown, and a skirt joining said face, sole, and crown;

a hollow golf club interior within said body;

said body having an exterior surface opposite said hollow golf club interior;

said body having a center of gravity;

wherein said body comprises an elongate weight receptacle;

a weight retainer located in said weight receptacle;

wherein said weight receptacle comprises a plurality of weight mounts;

wherein said weight retainer comprises a rotating portion and a non-rotating portion, said rotating portion rotatably affixed to said non-rotating portion;

wherein between 180 degrees and 10 degrees of rotation of said rotating portion in a first direction relative to said non-rotating portion locks said weight retainer, and wherein between 180 degrees and 10 degrees of rotation of said rotating portion in a second direction relative to said non-rotating portion unlocks said weight retainer; and wherein said weight retainer is configured to slide along said weight receptacle between each of said plurality of weight mounts when said weight retainer is unlocked, and wherein said weight retainer is configured to reside in any of said plurality of weight mounts when said weight retainer is locked;

wherein said weight receptacle comprises a pair of locking rails running along each side of said weight receptacle and a channel formed between said locking rails;

wherein each of said plurality of weight mounts comprises a recess, and wherein said recess comprises a locking wall, wherein said pair of locking rails comprise thick portions and thin portions, said thin portions located adjacent said recesses, and wherein said locking walls are formed between said thin portions and said thick portions.

2. The golf club head of claim 1, wherein between 140 degrees and 40 degrees of rotation of said rotating portion in a first direction relative to said non-rotating portion locks said weight retainer, and wherein between 140 degrees and 40 degrees of rotation of said rotating portion in a second direction relative to said non-rotating portion unlocks said weight retainer.

3. The golf club head of claim 1, wherein between 120 degrees and 60 degrees of rotation of said rotating portion in a first direction relative to said non-rotating portion locks said weight retainer, and wherein between 140 degrees and 40 degrees of rotation of said rotating portion in a second direction relative to said non-rotating portion unlocks said weight retainer.

4. The golf club head of claim 1, wherein said weight retainer abuts said locking wall when said weight retainer is locked, restricting said weight retainer from sliding along said weight receptacle.

5. The golf club head of claim 1, wherein said non-rotating portion is configured to abut said weight receptacle, restricting said non-rotating portion from rotating relative to said weight receptacle.

6. A golf club head, comprising:

a body having a face, a sole, a crown, and a skirt joining said face, sole, and crown;

a hollow golf club interior within said body;

said body having an exterior surface opposite said hollow golf club interior;

said body having a center of gravity;

wherein said body comprises an elongate weight receptacle;

a weight retainer located in said weight receptacle;

wherein said weight receptacle comprises a plurality of weight mounts;

wherein said weight receptacle comprises a plurality of thick portions and a plurality of thin portions, said thick portions residing between each of said plurality of weight mounts;

wherein said weight retainer comprises a rotating portion and a non-rotating portion, said rotating portion rotatably affixed to said non-rotating portion;

wherein rotating said rotating portion in a first direction relative to said non-rotating portion locks said weight retainer, and wherein rotation of said rotating portion in a second direction relative to said non-rotating portion unlocks said weight retainer; and wherein said weight retainer is configured to slide along said weight receptacle between each of said plurality of weight mounts when said weight retainer is unlocked, and wherein said weight retainer is configured to reside in any of said plurality of weight mounts when said weight retainer is locked.

7. The golf club head of claim 6, wherein said weight retainer abuts said thick portions when said weight retainer is locked, restricting said weight retainer from sliding along said weight receptacle.

8. The golf club head of claim 6, wherein said non-rotating portion is configured to abut said weight receptacle, restricting said non-rotating portion from rotating relative to said weight receptacle.

9. The golf club head of claim 6, wherein between 180 degrees and 10 degrees of rotation of said rotating portion in a first direction relative to said non-rotating portion locks said weight retainer, and wherein between 180 degrees and 10 degrees of rotation of said rotating portion in a second direction relative to said non-rotating portion unlocks said weight retainer.

10. A golf club head, comprising:

a body having a face, a sole, a crown, and a skirt joining said face, sole, and crown;

a hollow golf club interior within said body;

said body having an exterior surface opposite said hollow golf club interior;

said body having a center of gravity;

wherein said body comprises an elongate weight receptacle;

a weight retainer located in said weight receptacle;

wherein said weight receptacle comprises a pair of locking rails running along each side of said weight receptacle and a channel formed between said locking rails;

wherein said weight receptacle comprises a plurality of weight mounts;

wherein each of said plurality of weight mounts comprises a recess, and wherein said recess comprises a locking wall; and wherein said weight retainer is configured to slide along said weight receptacle between each of said plurality of weight mounts when said weight retainer is unlocked, and wherein said weight retainer is configured to reside in any of said plurality of weight mounts when said weight retainer is locked;

wherein said pair of locking rails comprise thick portions and thin portions, said thin portions located adjacent said recesses, and wherein said locking walls are formed between said thin portions and said thick portions.

11. The golf club head of claim 10, wherein between 180 degrees and 10 degrees of rotation of a portion of said weight retainer in a first direction relative to said weight receptacle locks said weight retainer, and wherein between 180 degrees and 10 degrees of rotation of said portion of said weight retainer in a second direction relative to said weight receptacle unlocks said weight retainer.

12. The golf club head of claim 11, wherein between 140 degrees and 40 degrees of rotation of said portion of said weight retainer in a first direction relative to said weight receptacle locks said weight retainer, and wherein between 180 degrees and 10 degrees of rotation of said portion of said weight retainer in a second direction relative to said weight receptacle unlocks said weight retainer.

13. The golf club head of claim 12, wherein between 120 degrees and 60 degrees of rotation of said portion of said weight retainer in a first direction relative to said weight receptacle locks said weight retainer, and wherein between 180 degrees and 10 degrees of rotation of said portion of said weight retainer in a second direction relative to said weight receptacle unlocks said weight retainer.

14. The golf club head of claim 10, wherein said weight retainer abuts said locking wall when said weight retainer is locked, restricting said weight retainer from sliding along said weight receptacle.

15. The golf club head of claim 10, wherein weight retainer comprises a non-rotating portion rotatably affixed to said portion of said weight retainer.

16. The golf club head of claim 15, wherein said non-rotating portion is configured to abut said weight receptacle, restricting said non-rotating portion from rotating relative to said weight receptacle.

17. The golf club head of claim 10, wherein said weight receptacle comprises a weight receptacle installation feature configured to receive said weight retainer, wherein said weight receptacle installation feature comprises voids formed in each of said pair of locking rails.

* * * * *